US006871026B2

(12) United States Patent
Shimura et al.

(10) Patent No.: US 6,871,026 B2
(45) Date of Patent: Mar. 22, 2005

(54) APPARATUS FOR AND METHOD OF FORMING IMAGE UNDER CONTROLLED IMAGE FORMING CONDITION

(75) Inventors: Hidetsugu Shimura, Nagano-ken (JP); Takashi Hama, Nagano-ken (JP); Hidenori Kin, Nagano-ken (JP); Keiichi Taguchi, Nagano-ken (JP); Hiroshi Nakazato, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 50 days.

(21) Appl. No.: 10/642,521

(22) Filed: Aug. 18, 2003

(65) Prior Publication Data

US 2004/0105689 A1 Jun. 3, 2004

(30) Foreign Application Priority Data

| | | |
|---|---|---|
| Aug. 22, 2002 | (JP) | 2002-241460 |
| Oct. 1, 2002 | (JP) | 2002-288737 |
| Jun. 20, 2003 | (JP) | 2003-176061 |
| Jun. 20, 2003 | (JP) | 2003-176062 |
| Jun. 20, 2003 | (JP) | 2003-176063 |

(51) Int. Cl.[7] ..... G03G 15/00
(52) U.S. Cl. ..... 399/12; 399/49
(58) Field of Search ..... 399/9, 12, 13, 399/38, 49

(56) References Cited

U.S. PATENT DOCUMENTS

| | | | | |
|---|---|---|---|---|
| 6,029,021 | A * | 2/2000 | Nishimura et al. | 399/49 |
| 6,181,888 | B1 * | 1/2001 | Scheuer et al. | 399/49 |
| 6,477,338 | B2 * | 11/2002 | Hisano et al. | 399/49 |
| 6,505,012 | B2 * | 1/2003 | Maebashi et al. | 399/49 |
| 2002/0018660 | A1 | 2/2002 | Sato | |
| 2002/0041770 | A1 | 4/2002 | Nakazato et al. | |
| 2002/0098004 | A1 | 7/2002 | Hama et al. | |

FOREIGN PATENT DOCUMENTS

| | | | |
|---|---|---|---|
| EP | 1-193-566 | A2 | 4/2002 |
| EP | 1-225-484 | A2 | 7/2002 |
| JP | 10-186769 | A | 7/1998 |
| JP | 2000-231228 | A | 8/2000 |
| JP | 2002-108029 | A | 4/2002 |
| JP | 2002-116614 | A | 4/2002 |
| JP | 2002-214854 | A | 7/2002 |
| JP | 2002-214855 | A | 7/2002 |
| JP | 2002-214856 | | 7/2002 |

* cited by examiner

*Primary Examiner*—Hoan Tran
(74) *Attorney, Agent, or Firm*—Sughrue Mion, PLLC

(57) ABSTRACT

A condition controlling process is executed when parameters expressing a state of toner within a developer reaches predetermined threshold values. On each one of two parameters, namely, a dot count value which is indicative of a toner consumption amount (an integrated value of the number of dots formed using an exposure beam) and a developer roller rotating time which is indicative of the degree of toner fatigue, a threshold value (denoted at the dotted lines) which triggers execution of the condition controlling process is set. At the time that the path d of dots which are expressed as combinations of these parameters intersects each dotted line (the intersections (1) through (6)), the condition controlling process is executed.

51 Claims, 44 Drawing Sheets

FIG. 14A HIGH-DENSITY PATCH IMAGE

| TONER CHARACTER INFORMATION ="0" | | DEVELOPER ROLLER ROTATING TIME (sec) | | | |
|---|---|---|---|---|---|
| | | ~1325 | ~3975 | ~6625 | ~10600 |
| DOT COUNT VALUE | ~1000000 | 0.990 | 0.988 | 0.984 | 0.982 |
| | ~2000000 | 0.988 | 0.984 | 0.982 | 0.982 |
| | ~6666666 | 0.984 | 0.982 | 0.982 | 0.982 |
| | ~12000000 | 0.982 | 0.982 | 0.982 | 0.982 |

FIG. 14B LOW-DENSITY PATCH IMAGE

| TONER CHARACTER INFORMATION ="0" | | DEVELOPER ROLLER ROTATING TIME (sec) | | | |
|---|---|---|---|---|---|
| | | ~1325 | ~3975 | ~6625 | ~10600 |
| DOT COUNT VALUE | ~1000000 | 0.185 | 0.182 | 0.181 | 0.180 |
| | ~2000000 | 0.182 | 0.181 | 0.180 | 0.180 |
| | ~6666666 | 0.181 | 0.180 | 0.180 | 0.180 |
| | ~12000000 | 0.180 | 0.180 | 0.180 | 0.180 |

FIG. 33A: HIGH-DENSITY PATCH IMAGE

| TONER INDIVIDUALITY INFORMATION ="0" | | DEVELOPER ROLLER ROTATING TIME (sec) | | | |
|---|---|---|---|---|---|
| | | ~1325 | ~3975 | ~6625 | ~10600 |
| DOT COUNT VALUE | ~1000000 | 0.990 | 0.988 | 0.984 | 0.982 |
| | ~2000000 | 0.988 | 0.984 | 0.982 | 0.982 |
| | ~6666666 | 0.984 | 0.982 | 0.982 | 0.982 |
| | ~12000000 | 0.982 | 0.982 | 0.982 | 0.982 |

FIG. 33B: LOW-DENSITY PATCH IMAGE

| TONER INDIVIDUALITY INFORMATION ="0" | | DEVELOPER ROLLER ROTATING TIME (sec) | | | |
|---|---|---|---|---|---|
| | | ~1325 | ~3975 | ~6625 | ~10600 |
| DOT COUNT VALUE | ~1000000 | 0.185 | 0.182 | 0.181 | 0.180 |
| | ~2000000 | 0.182 | 0.181 | 0.180 | 0.180 |
| | ~6666666 | 0.181 | 0.180 | 0.180 | 0.180 |
| | ~12000000 | 0.180 | 0.180 | 0.180 | 0.180 |

FIG. 36A: HIGH-DENSITY PATCH IMAGE/BLACK TONER

| TONER INDIVIDUALITY INFORMATION ="0" | | DEVELOPER ROLLER ROTATING TIME (sec) | | | | | |
|---|---|---|---|---|---|---|---|
| | | ~600 | ~1325 | ~3975 | ~6625 | ~9275 | ~10600 |
| DOT COUNT VALUE | ~500000 | 0.988 | 0.988 | 0.986 | 0.986 | 0.984 | 0.982 |
| | ~1000000 | 0.988 | 0.988 | 0.986 | 0.986 | 0.984 | 0.982 |
| | ~2000000 | 0.986 | 0.986 | 0.986 | 0.986 | 0.984 | 0.982 |
| | ~4000000 | 0.986 | 0.986 | 0.986 | 0.986 | 0.984 | 0.982 |
| | ~6666666 | 0.984 | 0.984 | 0.984 | 0.984 | 0.984 | 0.982 |
| | ~12000000 | 0.982 | 0.982 | 0.982 | 0.982 | 0.982 | 0.982 |

FIG. 36B: HIGH-DENSITY PATCH IMAGE/MAGENTA TONER

| TONER INDIVIDUALITY INFORMATION ="0" | | DEVELOPER ROLLER ROTATING TIME (sec) | | | | | |
|---|---|---|---|---|---|---|---|
| | | ~600 | ~1325 | ~3975 | ~6625 | ~9275 | ~10600 |
| DOT COUNT VALUE | ~500000 | 0.977 | 0.974 | 0.970 | 0.968 | 0.965 | 0.961 |
| | ~1000000 | 0.974 | 0.974 | 0.970 | 0.968 | 0.965 | 0.961 |
| | ~2000000 | 0.970 | 0.970 | 0.970 | 0.968 | 0.965 | 0.961 |
| | ~4000000 | 0.968 | 0.968 | 0.968 | 0.968 | 0.965 | 0.961 |
| | ~6666666 | 0.965 | 0.965 | 0.965 | 0.965 | 0.965 | 0.961 |
| | ~12000000 | 0.961 | 0.961 | 0.961 | 0.961 | 0.961 | 0.961 |

FIG. 37A: HOME POSITION
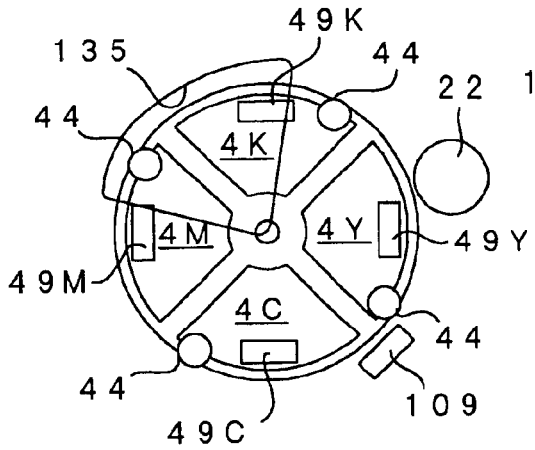
FIG. 37B: DEVELOPING POSITION
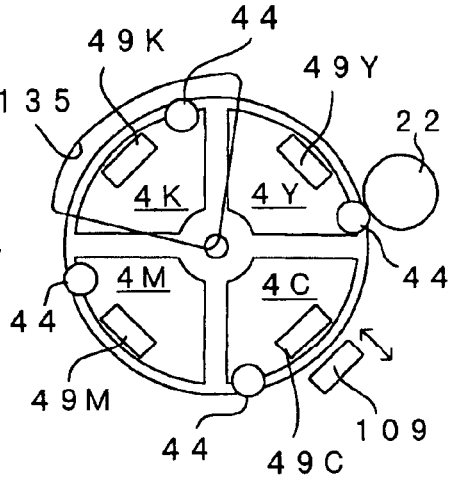
FIG. 37C: ATTACHING/DETACHING POSITION
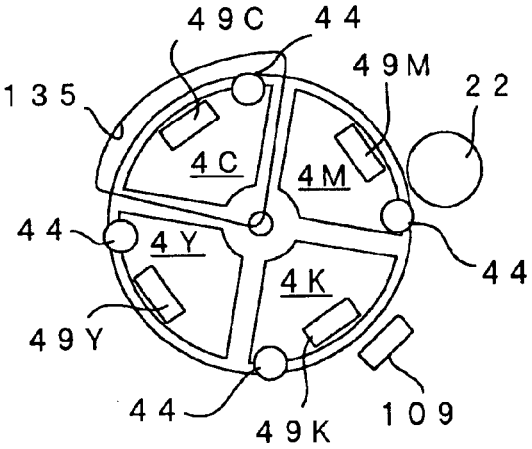

APPARATUS FOR AND METHOD OF FORMING IMAGE UNDER CONTROLLED IMAGE FORMING CONDITION

BACKGROUND OF THE INVENTION

1. Field of the Invention

The present invention relates to an image forming apparatus and an image forming method in which a condition controlling process of controlling an image forming condition is executed based on a density detection result on a patch image.

2. Description of the Related Art

In image forming apparatuses, such as copier machines, printers and facsimile machines, to which electrophotographic techniques are applied, an image density of a toner image may change depending on a difference between individual apparatuses, a change with time, an environment surrounding the apparatus such as a temperature and a humidity level, etc. Against this background, various types of techniques have been proposed aiming at stabilization of an image density. These techniques include one which requires to form a small test image (patch image) on an image carrier for instance and optimize an image forming condition, such as a developing bias which influences a density of an image, based on a density of the patch image. According to this technique, predetermined toner images are formed on an image carrier while changing an image forming condition, and image densities of toner images are detected or image densities of toner images obtained by transferring these toner images onto other transfer member such as an intermediate transfer medium are detected on an assumption that these toner images are patch images. An image forming condition is adjusted such that these patch image densities will match with a predetermined target density, to thereby obtain a desired image density. The series of operations corresponds to the process of adjusting the image forming condition described above, i.e., the so-called condition controlling process.

While various types of techniques for measuring a patch image density (hereinafter referred to as "patch sensing techniques") have been proposed, those which use optical means are most popular. In other words, light is irradiated upon a surface area within an image carrier or a transfer member which carries a patch image, an optical sensor receives light reflected or transmitted by this surface area and a patch image density is identified based on the amount of the received light.

When an image forming apparatus which adjusts an image forming condition based on a patch image density is to form a toner image having an excellent image quality by appropriately setting the image forming condition, an important issue to is how to accurately detect a density of a formed patch image. Despite this, the patch sensing techniques using an optical sensor mentioned above have the following problem.

That is, with respect to an image forming apparatus to which such a conventional patch sensing technique is applied, it is known that although an image forming condition is adjusted regularly so that a patch image density will be constant, i.e., an output from an optical sensor will be constant, densities of images formed on a final transfer material such as a paper and a film are not always constant. These density changes are created with time in accordance with an operating state of the apparatus such as a remaining toner amount within the apparatus. For instance, in the event that a large number of the same images are formed since attachment of a new cartridge housing toner to the apparatus, image densities of the images in some cases change gradually.

Further, the image forming apparatus described above executes the condition controlling process immediately after a power source of the apparatus has been just turned on or when the number of prints reaches a predetermined value. However, execution of the condition controlling process at such timing alone does not make it easy to perform image formation while always ensuring a stable image quality.

SUMMARY OF THE INVENTION

A major object of the present invention is to provide an image forming apparatus and an image forming method according to which it is possible to execute a condition controlling process at proper timing and accordingly form an image which has an excellent image quality.

The other object of the present invention is to skip the condition controlling process when not needed and to consequently prevent a wasteful use of toner, a processing time, etc.

Further, other objective is to suppress a change with time in image density and stably form a toner image which has an excellent image quality.

According a first aspect of the present invention, toner state information which expresses a state of a toner housed within a developer is updated in accordance with an operating state of an apparatus. When the toner state information satisfies a predetermined control start condition, a toner image is formed as a patch image, an image forming condition which influences an image density is optimized based on a toner density of the patch image, and an image density is consequently controlled.

According a second aspect of the present invent ion, when a process cartridge attached to a main body is removed from the main body and thereafter again attached to the main body, whether thus attached process cartridge is the same as the process cartridge removed earlier is determined, and the condition controlling process is executed when it is determined that the two are not the same, but the condition controlling process is not executed when it is determined that the two are the same.

According a third aspect of the present invention, when a process cartridge is attached to a main body, a judgment is made regarding whether thus attached process cartridge is the same as a process cartridge which used to be attached to the main body before execution of the condition controlling process which took place prior to the attachment, and when it is determined that the two are not the same, the condition controlling process is executed, but when it is determined that the two are the same, the condition controlling process is not executed.

According a fourth aspect of the present invention, toner images are formed as patch images using developers which are attached to a main body, and a condition controlling process, which is for controlling of an image forming condition for formation of toner images using the developers, is executed based on a detection result on densities of the patch images. On each one of the developers which are attached to the main body, whether it is necessary to execute the condition controlling process on each developer is determined based on information indicative of a state of use of each developer, and when it is determined that it is necessary to execute the condition controlling process on at least one developer, the condition controlling process is executed on the developer which has just been determined to require the condition controlling process, but the condition controlling process is executed on the other developers.

According a fifth aspect of the present invention, when at least one developer was removed from a main body and a new developer has been attached to the main body, the condition controlling process is executed on the attached developer but not on the other developers which have been remaining attached to the main body since before the attachment.

According a sixth aspect of the present invention, a density target value is changed in accordance with an operating state of an apparatus, a toner density of a toner image formed as a patch image is detected, and an image forming condition which influences an image density is optimized based on a result of the detection and the density target value, whereby an image density is controlled.

As a part of "information regarding a state of use of a developer" described in relation to the present invention, toner state information may be used which represents a state of toner which is housed within a developer which is mounted to a main body of the apparatus. While there are various types of parameters which express a state of use of a developer, according to findings of the inventor of the present invention, one which represents a state of toner inside a developer is known to be largely influential over a quality of an image which is formed. Whether the condition controlling process is necessary or not is determined based on toner state information which represents a state of toner, and hence, a toner consumption, a processing time and the like associated with execution of a wasteful process are suppressed while favorably maintaining an image quality.

Further, an "initial state" described in the following refers to characteristics of toner at the time of injection of the toner in a developer. In the case of a newly manufactured developer, this term refers to characteristics of toner at the time of injection of the toner during manufacturing. In the event that toner is re-injected in a used developer for re-use of the toner, this term refers to characteristics of thus re-injected toner. The initial state of the toner, i.e., characteristics such as a particle diameter distribution and an electrification characteristic can be found through actual measurement during manufacturing of toner.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIGS. 14A and 14B are drawings which show examples of look-up tables which are for calculating a control target value;

FIGS. 33A and 33B are drawings which show an example of look-up tables;

FIGS. 36A and 36B are drawings which show other examples of the look-up tables;

FIGS. 37A through 37C are schematic diagrams which show a stop position of a developer cartridge;

DETAILED DESCRIPTION OF THE PREFERRED EMBODIMENTS

<First Embodiment>

(I) Structure of Apparatus

Figure 1:
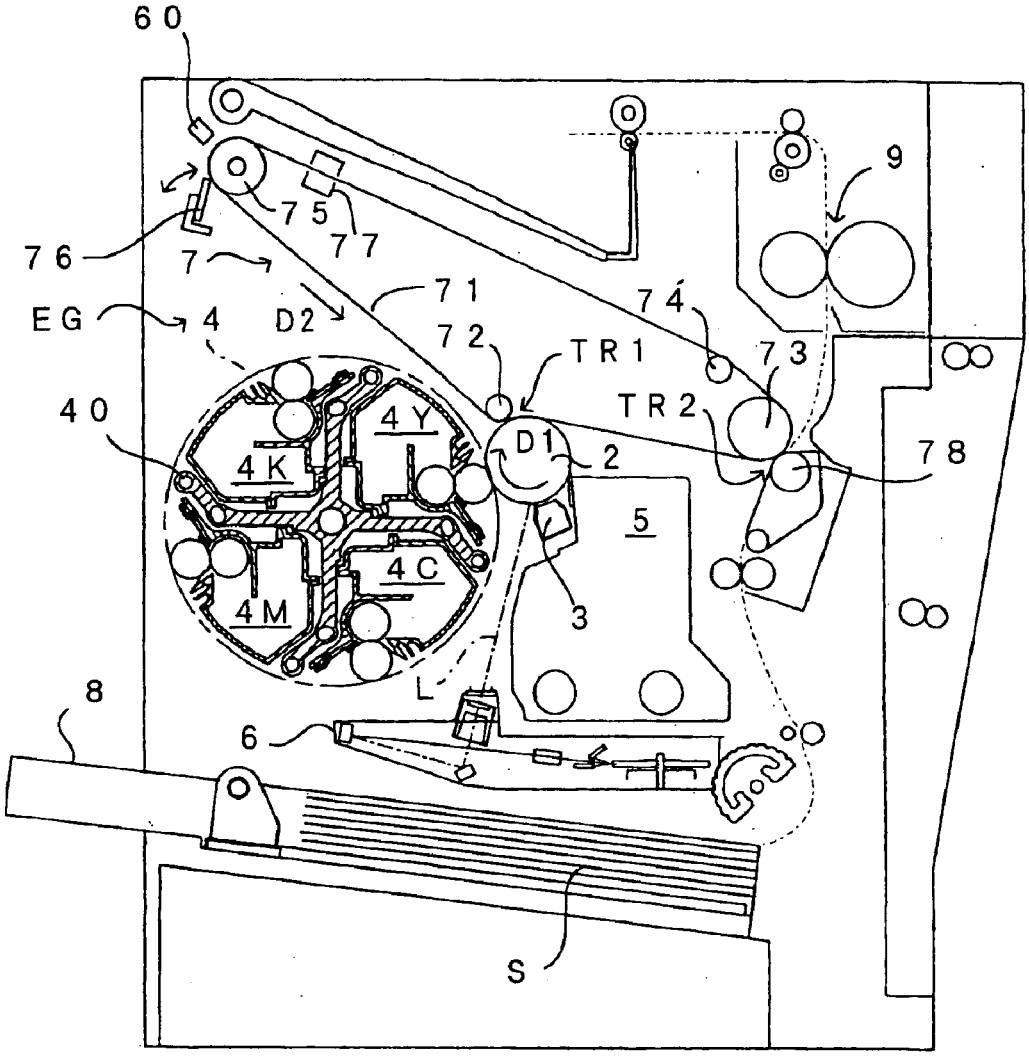
FIG. 1 is a drawing of a first embodiment of an image forming apparatus according to the present invention.
Figure 2:
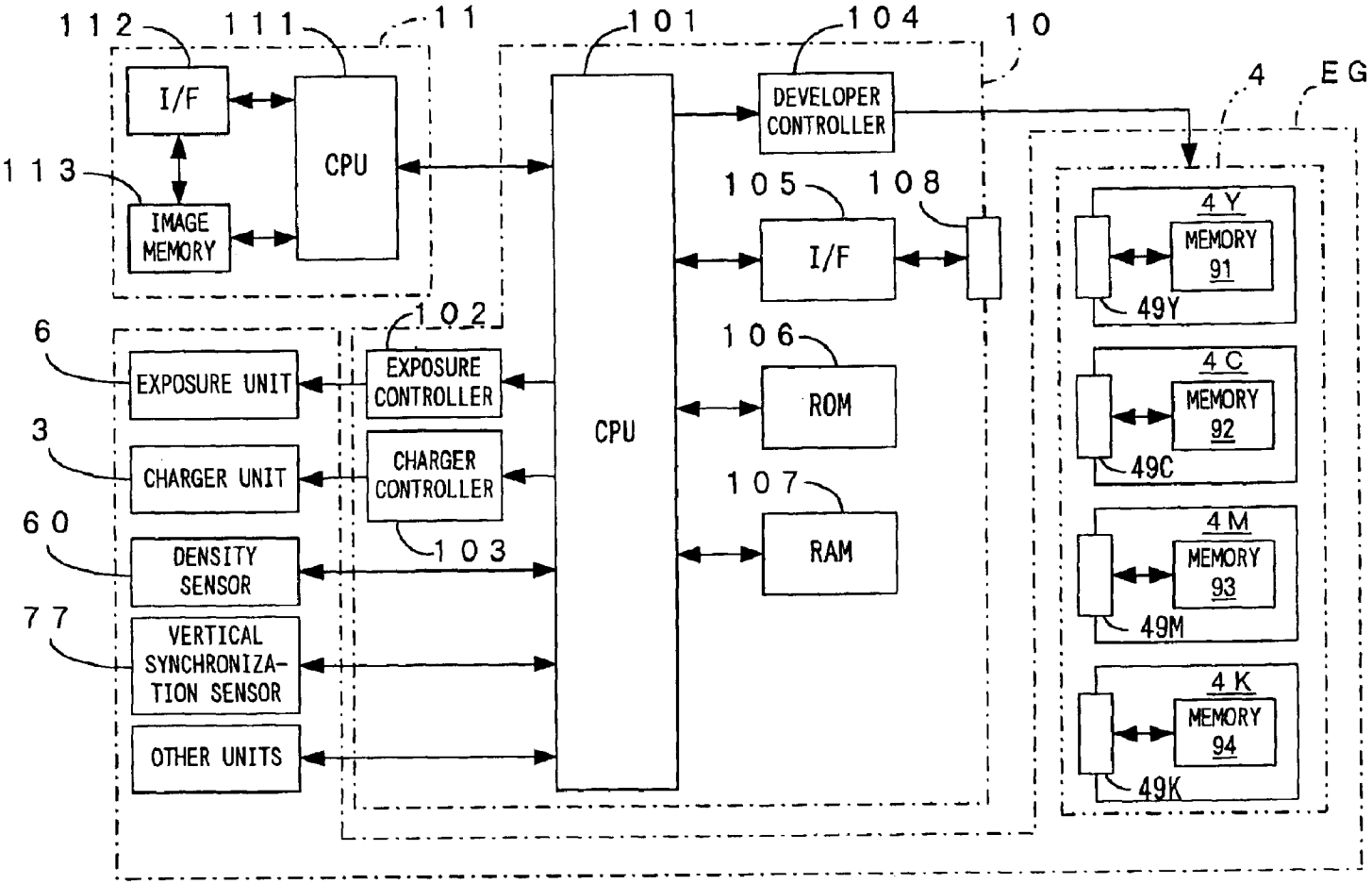
FIG. 2 is a block diagram of an electric structure of the image forming apparatus which is shown in FIG. 1.

FIG. 1 is a drawing of a first embodiment of an image forming apparatus according to the present invention. FIG. 2 is a block diagram of an electric structure of the image forming apparatus which is shown in FIG. 1. This image forming apparatus is an apparatus which superposes toner in four colors of yellow (Y), magenta (M), cyan (C) and black (K) and accordingly forms a full-color image, or uses only toner in black (K) and accordingly forms a monochrome image. In this image forming apparatus, when an image signal is fed to a main controller 11 from an external apparatus such as a host computer in response to an image formation request from a user, an engine controller 10 controls respective portions of an engine EG in accordance with an instruction received from the main controller 11 and an image which corresponds to the image signal is formed on a sheet S.

In the engine EG, a photosensitive member 2 is disposed so that the photosensitive member 2 can freely rotate in the arrow direction D1 in FIG. 1. Around the photosensitive member 2, a charger unit 3, a rotary developer unit 4 and a cleaner 5 are disposed in the rotation direction D1. A charger controller 103 applies a charging bias upon the charger unit 3, whereby an outer circumferential surface of the photosensitive member 2 is charged uniformly to a predetermined surface potential.

An exposure unit 6 emits a light beam L toward the outer circumferential surface of the photosensitive member 2 which is thus charged by the charger unit 3. The exposure unit 6, thus functioning as "exposure means" of the present invention, makes the light beam L expose on the photosensitive member 2 in accordance with a control instruction fed from an exposure controller 102 and forms an electrostatic latent image corresponding to the image signal. For instance, when an image signal is fed to a CPU 111 of the main controller 11 via an interface 112 from an external apparatus such as a host computer, a CPU 101 of the engine controller 10 outputs a control signal corresponding to the image signal at predetermined timing, the exposure unit 6 emits the light beam L upon the photosensitive member 2, and an electrostatic latent image corresponding to the image signal is formed on the photosensitive member 2. Further, when a patch image which will be described later is to be formed in accordance with a necessity, a control signal corresponding to a patch image signal which expresses a predetermined pattern is fed from the CPU 101 to the exposure controller 102, and an electrostatic latent image corresponding to this pattern is formed on the photosensitive member 2. In this fashion, the photosensitive member 2 functions as an "image carrier" of the present invention, according to this embodiment.

The developer unit 4 develops thus formed electrostatic latent image with toner. In other words, the developer unit 4 comprises a support frame 40 which is disposed for free rotation about a shaft, a rotation driver not shown, and a yellow developer 4Y, a cyan developer 4C, a magenta developer 4M and a black developer 4K which are freely attachable to and detachable from the support frame 40 and house toner of the respective colors. A developer controller 104 controls the developer unit 4 as shown in FIG. 2. The developer unit 4 is driven into rotations based on a control instruction from the developer controller 104, and the developers 4Y, 4C, 4M and 4K are selectively positioned at a predetermined developing position facing the photosensitive member 2 and supply the toner of the selected color onto the surface of the photosensitive member 2. As a result, the electrostatic latent image on the photosensitive member 2 is visualized with the toner of the selected color. Shown in FIG. 1 is a state that the yellow developer 4Y is positioned at the developing position.

Figure 3:
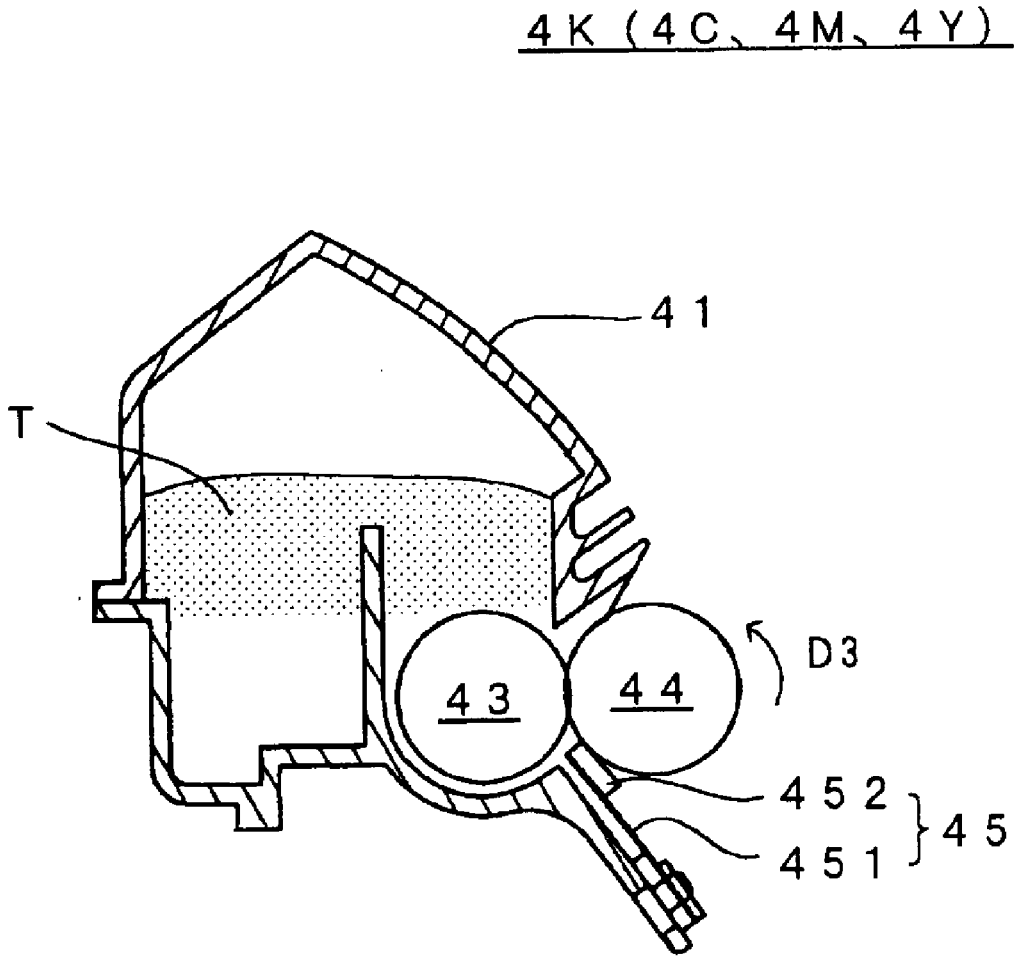
FIG. 3 is a cross sectional view of a developer of the image forming apparatus.

Since the developers 4Y, 4C, 4M and 4K all have the same structure, a structure of the developer 4K will now be described in more detail with reference to FIG. 3. The other developers 4Y, 4C and 4M remain the same in structure and function. FIG. 3 is a cross sectional view of the developer of the image forming apparatus. In this developer 4K, a supply roller 43 and a developer roller 44 are axially attached to a housing 41 which houses toner T inside. As the developer 4K is positioned at the developing position described above, the developer roller 44 which functions as a "toner carrier" of the present invention abuts on the photosensitive member 2 or gets positioned at an opposed position with a predetermined gap from the photosensitive member 2, and the rollers 43 and 44 rotate in a predetermined direction as they are engaged with the rotation driver (not shown) which is disposed to the main body. The developer roller 44 is made as a cylinder of metal, such as iron, copper and aluminum, or an alloy such as stainless steel, or so as to receive a developing bias as described later. As the two rollers 43 and 44 rotate while remaining in contact, the black toner is rubbed against a surface of the developer roller 44 and a toner layer having predetermined thickness is accordingly formed on the surface of the developer roller 44.

Further, in the developer 4K, a restriction blade 45 is disposed which restricts the thickness of the toner layer formed on the surface of the developer roller 44 into the predetermined thickness. The restriction blade 45 comprises a plate-like member 451 of stainless steel, phosphor bronze or the like and an elastic member 452 of rubber, a resin material or the like attached to a front edge of the plate-like member 451. A rear edge of the plate-like member 451 is fixed to the housing 41, which ensures that the elastic member 452 attached to the front edge of the plate-like member 451 is positioned on the upstream side to the rear edge of the plate-like member 451 in a rotation direction D3 of the developer roller 44. The elastic member 452 elastically abuts on the surface of the developer roller 44, thereby restricting the toner layer formed on the surface of the developer roller 44 finally into the predetermined thickness.

Toner particles which form the toner layer formed on the surface of the developer roller 44 are charged, due to friction with the supply roller 43 and the restriction blade 45. Although the example described below assumes that the toner has been negatively charged, it is possible to use toner which becomes positively charged as potentials at the respective portions of the apparatus are appropriately changed.

The toner layer thus formed on the surface of the developer roller 44 is gradually transported, owing to the rotations of the developer roller 44, to an opposed position facing the photosensitive member 2 on which surface the electrostatic latent image has been formed. As the developing bias from the developer controller 104 is applied upon the developer roller 44, the toner carried on the developer roller 44 partially adheres to respective portions within the surface of the photosensitive member 2 in accordance with surface potentials in these portions. The electrostatic latent image on the surface of the photosensitive member 2 is visualized as a toner image in this toner color in this manner.

While the developing bias applied upon the developer roller 44 may be a direct current voltage or a developing bias which is obtained by superimposing an alternating current voltage upon a direct current voltage, in an image forming apparatus of the non-contact developing type in which the photosensitive member 2 and the developer roller 44 in particular are located away from each other and toner transfers between the two for the purpose of development with the toner, it is preferable for efficient toner transfer that the developing bias has a voltage waveform which is obtained by superimposing an alternating current voltage, such as a sine wave, a chopping wave and a square wave, upon a direct current voltage. Although the value of a direct current voltage and the amplitude, the frequency, the duty ratio and the like of an alternating current voltage may have any desired values, in the following description, a direct current component (average value) of the developing bias will be referred to as an average developing bias Vavg, regardless of whether the developing bias contains an alternating current component.

A preferable example of the developing bias described above used in an image forming apparatus of the non-contact developing type will now be described. For instance, the waveform of the developing bias is obtained by superimposing an alternating current voltage having a square wave upon a direct current voltage, the frequency of the square wave is 3 kHz and a peak-to-peak voltage Vpp is 1400 V. In addition, as described later, although it is possible to change the developing bias Vavg as one of density control factors in this embodiment. The developing bias may be changed in the variable range of (−110 V) to (−330 V) for example, considering an influence over an image density, a variation in characteristics of the photosensitive member 2, etc. These numerical figures are not limited to those mentioned above, but should rather be appropriately changed in accordance with the structure of the apparatus.

In addition, as shown in FIG. 2, memories 91 through 94, which store data regarding a production batch and/or the history of use of the developers, characteristics of the toner inside and the like, are disposed to the respective developers 4Y, 4C, 4M and 4K. Connectors 49Y, 49C, 49M and 49K are disposed to the respective developers 4Y, 4C, 4M and 4K. These are selectively connected with a connector 108 which is disposed to the main body in accordance with a necessity, allow that data are transferred between the CPU 101 and the respective memories 91 through 94 via an interface 105, and thus manage various types of information on the developers such as management of consumables. While data are sent and received with the connector 108 of the main body and the connector 49Y and the like of the developers mechanically fit with each other in this embodiment, the data transfer may be non-contact data transfer using other electromagnetic means such as radio communications. Further, the memories 91 through 94 which store data unique to the respective developers 4Y, 4C, 4M and 4K are preferably non-volatile memories which are capable of saving the unique data even when a power source is OFF, when the developers have been detached from the main body or on other occasions. Flash memories, ferroelectric memories, EEPROMs and the like may be used as such non-volatile memories.

The structure of the apparatus will be described continuously, referring to FIG. 1 again. The toner image developed by the developer unit 4 in the manner described above is primarily transferred onto an intermediate transfer belt 71 of a transfer unit 7 in a primary transfer region TR1. The transfer unit 7 comprises the intermediate transfer belt 71 which runs across a plurality of rollers 72 through 75, and a driver (not shown) which drives a roller 73 into rotations to thereby drive the intermediate transfer belt 71 into rotations in a predetermined rotation direction D2. At a position facing the roller 73 across the intermediate transfer belt 71, a secondary transfer roller 78 is disposed which is attached to and detached from a surface of the belt 71 by an electromagnetic clutch not shown. For transfer of a color image onto the sheet S, toner images in the respective colors on the photosensitive member 2 are superposed one atop the other on the intermediate transfer belt 71, thereby forming a color image. Further, on the sheet S unloaded from a cassette 8 and transported to a secondary transfer region TR2 which is located between the intermediate transfer belt 71 and the secondary transfer roller 78, the color image is secondarily transferred. The sheet S now seating thus formed color image is transported to a discharging tray which is disposed to a top surface portion of the main body of the apparatus via a fixing unit 9. Static eliminating means not shown resets a surface potential of the photosensitive member 2 as it is after the primary transfer of the toner image onto the intermediate transfer belt 71. After removal of the toner remaining on the surface of the photosensitive member 2 by a cleaner 5, the charger unit 3 charges the photosensitive member 2.

When it is necessary to further form images, the operation above is repeated, a necessary number of images are accordingly formed, and the series of image forming operation ends. The apparatus remains on standby until a new image signal is received, and for the purpose of suppressing an energy consumption in the standby state, the apparatus switches from the standby operation to a suspended state. In short, the photosensitive member 2, the developer roller 44, the intermediate transfer belt 71 and the like stop rotating and the application of the developing biases upon the developer roller 44 and the charger unit 3 is stopped, whereby the apparatus enters the operation-suspended state.

Further, a cleaner 76, a density sensor 60 and a vertical synchronization sensor 77 are disposed in the vicinity of the roller 75. Of these, the cleaner 76 can move freely to be attached to and detached from the roller 75, owing to the electromagnetic clutch not shown. In a condition that the cleaner 76 has moved to the roller 75, a blade of the cleaner 76 abuts on the surface of the intermediate transfer belt 71 which runs around the roller 75 and removes the toner which remains adhering to the outer circumferential surface of the intermediate transfer belt 71 after the secondary transfer. Meanwhile, the vertical synchronization sensor 77 is a sensor which detects a reference position of the intermediate transfer belt 71, and functions as a vertical synchronization sensor which is for obtaining a synchronizing signal which is outputted in relation to rotations of the intermediate transfer belt 71, namely, a vertical synchronizing signal Vsync. In this apparatus, the operations of the respective portions of the apparatus are controlled based on the vertical synchronizing signal Vsync, to thereby time the operations of the respective portions to each other and to accurately superimpose toner images of the respective colors one atop the other. In addition, the density sensor 60 is disposed facing the surface of the intermediate transfer belt 71, and has such a structure which permits the density sensor 60 to measure a density of a patch image which is formed on the outer circumferential surface of the intermediate transfer belt 71. In this fashion, the density sensor 60 functions as an "density detecting means" of the present invention, according to this embodiment.

In FIG. 2, denoted at 113 is an image memory which is disposed to the main controller 11 to store an image signal which is fed from an external apparatus such as a host computer via the interface 112. Denoted at 106 is a ROM which stores a calculation program executed by the CPU 101, control data for control of the engine EG, etc. Denoted at 107 is a RAM which temporarily stores a calculation result derived by the CPU 101, other data, etc.

Figure 4:
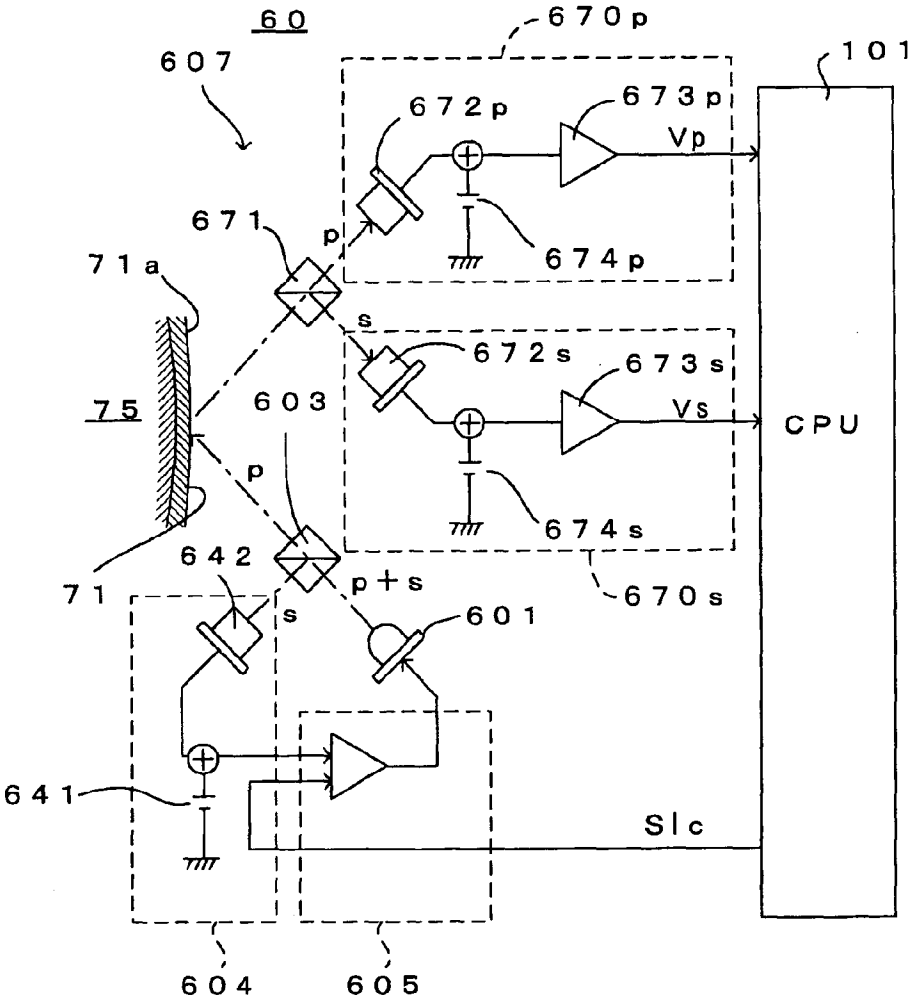
FIG. 4 is a drawing which shows a structure of a density sensor.

FIG. 4 is a drawing which shows a structure of the density sensor. The density sensor 60 comprises a light emitter element 601, such as an LED, which functions as "light emitting means" of the present invention and which irradiates light upon a wound area 71*a* which corresponds to a surface area of the intermediate transfer belt 71 which lies on the roller 75. Disposed to the density sensor 60 are a polarizer beam splitter 603, a light receiver unit for monitoring irradiated light amount 604 and an irradiated light amount adjusting unit 605, for the purpose of adjusting the irradiated light amount of irradiation light in accordance with a light amount control signal Slc which is fed from the CPU 101 as described later.

The polarizer beam splitter 603 is, as shown in FIG. 4, disposed between the light emitter element 601 and the intermediate transfer belt 71. The polarizer beam splitter 603 splits light emitted from the light emitter element 601 into p-polarized light, whose polarizing direction is parallel to the surface of incidence of the irradiation light on the intermediate transfer belt 71, and s-polarized light whose polarizing direction is perpendicular to the surface of incidence of the irradiation light. The p-polarized light impinges as it is upon the intermediate transfer belt 71, while the s-polarized light impinges upon the light receiver unit 604 for monitoring irradiated light amount after emitted from the polarizer beam splitter 603, so that a signal which is in proportion to the irradiated light amount is outputted to the irradiated light amount adjusting unit 605 from a light receiver element 642 of the light receiver unit 604.

Based on the signal from the light receiver unit 604 and a light amount control signal Slc from the CPU 101 of the engine controller 10, the irradiated light amount adjusting unit 605 feedback-controls the light emitter element 601 and adjusts the irradiated light amount of the light irradiated upon the intermediate transfer belt 71 from the light emitter element 601 into a value which corresponds to the light amount control signal Slc. The irradiated light amount can thus be changed and adjusted appropriately within a wide range according to this embodiment.

In addition, an input offset voltage 641 is applied to the output side of the light receiver element 642 of the light receiver unit 604 for monitoring irradiated light amount, and the light emitter element 601 is maintained turned off unless the light amount control signal Slc exceeds a certain signal level according to this embodiment. This prevents the light emitter element 601 from erroneously turning on because of a noise, a temperature drift, etc.

As the light amount control signal Slc having a predetermined level is fed to the irradiated light amount adjusting unit 605 is fed from the CPU 101, the light emitter element 601 turns on and p-polarized light is irradiated as irradiation light upon the intermediate transfer belt 71. The p-polarized light is reflected by the intermediate transfer belt 71. Of light components of the reflection light, a reflection light amount detector unit 607 detects the light amount of the p-polarized light and the light amount of the s-polarized light respectively, and signals corresponding to the respective light amounts are outputted to the CPU 101.

As shown in FIG. 4, the reflection light amount detector unit 607 comprises a polarized light beam splitter 671, a light receiver unit 670*p* and a light receiver unit 670*s*. The polarized light beam splitter 671 is disposed on an optical path of the reflection light. The light receiver unit 670*p* receives p-polarized light transmitted by the polarization light beam splitter 671 and outputs a signal which corresponds to the light amount of the p-polarized light. And the light receiver unit 670*s* receives s-polarized light split by the polarization light beam splitter 671 and outputs a signal which corresponds to the light amount of the s-polarized light. In the light receiver unit 670*p*, a light receiver element 672*p* receives the p-polarized light from the polarization light beam splitter 671, and after an amplifier circuit 673*p* amplifies an output from the light receiver element 672*p*, an amplified signal is outputted as a signal Vp which corresponds to the light amount of the p-polarized light to the CPU 101. Meanwhile, like the light receiver unit 670*p*, the light receiver unit 670*s* comprises a light receiver unit 672*s* and an amplifier circuit 673*s* and outputs a signal Vs which corresponds to the light amount of the s-polarized light. Hence, it is possible to independently calculate the light amounts of the mutually different two component light (the p-polarized light and the s-polarized light) among the light components of the reflection light.

Further, in this embodiment, output offset voltages 674*p* and 674*s* are respectively applied to the output side of the light receiver elements 672*p* and 672*s*, and even when outputs from the respective light receiver elements are zero, that is, even when the reflection light amounts are zero, the amplifier circuits 673*p* and 673*s* reach a predetermined positive potential. This permits to output appropriate output voltages which correspond to the reflection light amounts while avoiding a dead zone in the vicinity of the zero inputs to the amplifier circuits 673*p* and 673*s*.

The signals representing these output voltages Vp and Vs are fed to the CPU 101 via an A/D converter circuit not shown, and the output voltages Vp and Vs are sampled at predetermined time intervals (which are 8 msec in this embodiment). Based on the results of the sampling, the CPU 101 adjusts density control factors for stabilization of an image density, such as the developing bias and the exposure energy, which affect an image density. The condition controlling process is executed at proper timing which may be the time of turning on of the power source of the apparatus, immediately after any of the units has been exchanged, etc. To be more specific, while changing the density control factors above over multiple stages for each one of the toner colors, the image forming operation is executed in accordance with an image signal which is image data which correspond to a predetermined patch image pattern and are stored in advance in the ROM 106, whereby a small test image (patch image) corresponding to the image signal is formed. The density sensor 60 then detects a patch image density, and each density control factor is adjusted so that an optimal image forming condition to achieve a desired image density based on the result of the detection will be obtained. Adjustment operation of the density control factors will now be described.

(II) Condition Controlling Process

Figure 5:
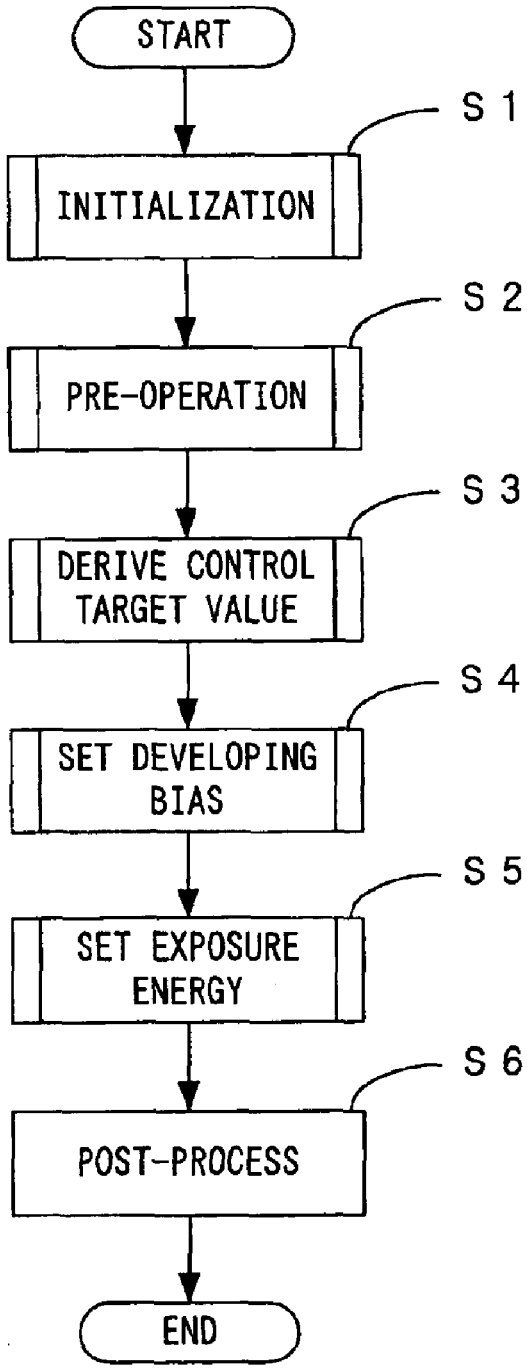
FIG. 5 is a flow chart which shows the outline of optimization of a density control factor in the first embodiment.

FIG. 5 is a flow chart which shows the outline of the condition controlling process of the density control factors in this embodiment. The operation includes six sequences in the following order: initialization (Step S1); a pre-operation (Step S2); a process of deriving a control target value (Step S3); a developing bias setting process (Step S4); an exposure energy setting process (Step S5); and a post-process (Step S6). In these sequences, steps S3 through S5 correspond to an "optimization" of the present invention. Detailed operations in the respective sequences will now be described.

(A) Initialization

Figure 6:
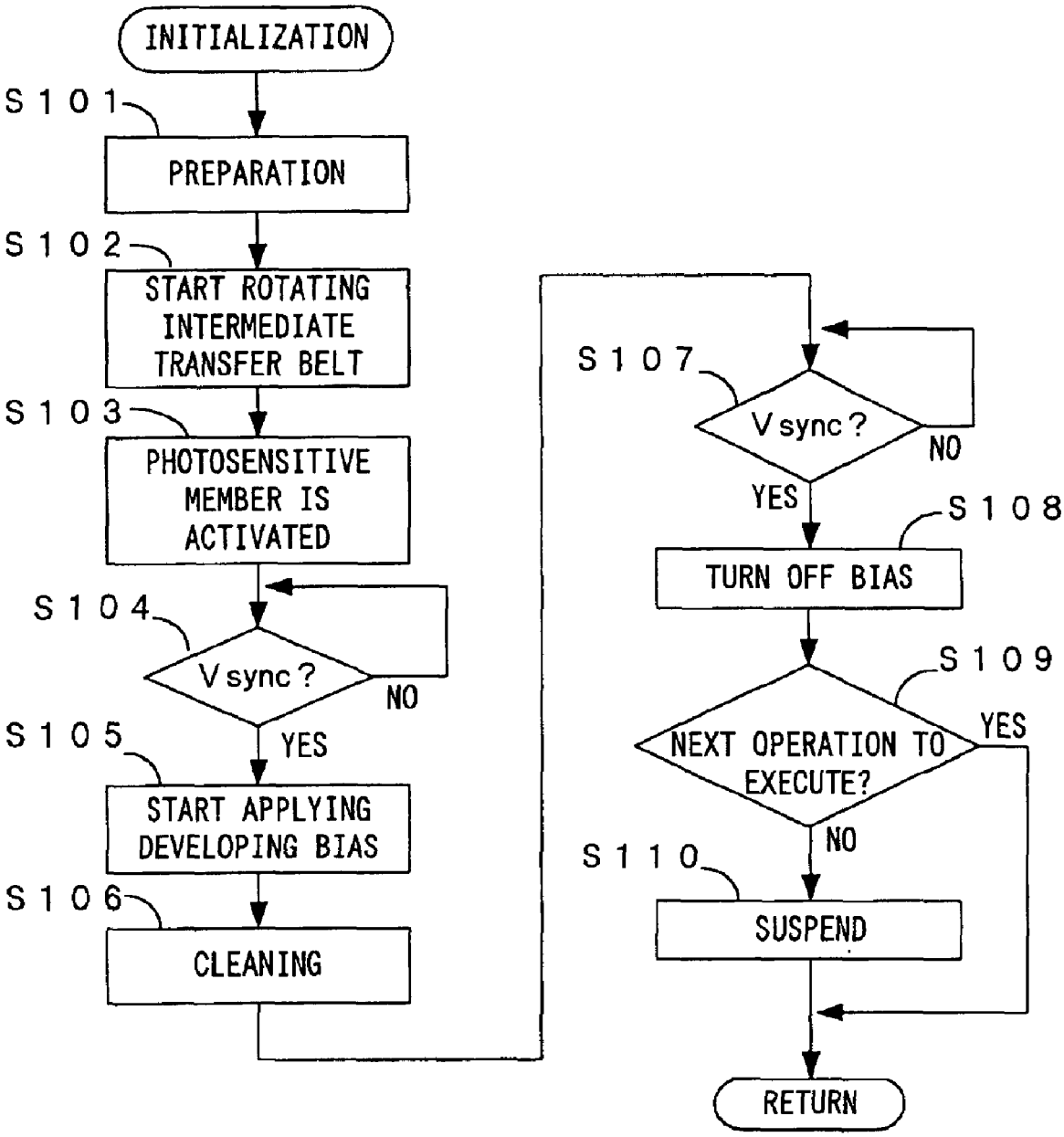
FIG. 6 is a flow chart which shows initialization in the first embodiment.

FIG. 6 is a flow chart which shows initialization in this embodiment. During the initialization, first, as preparation (Step S101), the developer unit 4 is driven into rotations and positioned at a so-called home position, and the cleaner 76 and the secondary transfer roller 78 are moved to positions away from the intermediate transfer belt 71 using the electromagnetic clutch. In this condition, driving of the intermediate transfer belt 71 is started (Step S102) and the photosensitive member 2 is driven into rotations and static elimination is started so that the photosensitive member 2 is activated (Step S103).

As the vertical synchronizing signal Vsync which is indicative of the reference position of the intermediate transfer belt 71 is detected and rotations of the intermediate transfer belt 71 is accordingly confirmed (Step S104), application of predetermined biases upon the respective portions of the apparatus is started (Step S105). That is, the charger controller 103 applies the charging bias upon the charger unit 3 to thereby charge the photosensitive member 2 to a predetermined surface potential, and a bias generator not shown then applies a predetermined primary transfer bias upon the intermediate transfer belt 71.

In this condition, the intermediate transfer belt 71 is cleaned (Step S106). In short, the cleaner 76 abuts on the surface of the intermediate transfer belt 71 and the intermediate transfer belt 71 is then rotated approximately one round in this condition, thereby removing the toner, dirt and the like which remain adhering to the surface of the intermediate transfer belt 71. The secondary transfer roller 78 applied with a cleaning bias then abuts on the intermediate transfer belt 71. The cleaning bias has the opposite polarity to that of a secondary transfer bias which is applied upon the secondary transfer roller 78 during execution of an ordinary image forming operation. Hence, the toner which remains adhering to the secondary transfer roller 78 moves to the surface of the intermediate transfer belt 71, and the cleaner 76 removes the toner off from the surface of the intermediate transfer belt 71. As the cleaning of the intermediate transfer belt 71 and the secondary transfer roller 78 ends in this fashion, the secondary transfer roller 78 is moved away from the intermediate transfer belt 71 and the cleaning bias is turned off. Upon receipt of the next vertical synchronizing signal Vsync (Step S107), the charging bias and the primary transfer bias are turned off (Step S108).

Further, in this embodiment, the CPU 101 can execute initialization not only when adjustment of density control factors is to be performed but instead when needed independently of other processing. So, when the next process is to be executed following this (Step S109), the initialization is ended in the condition that the process has been executed up to the step S108 described above, and the next process is carried out. When the next process is not in a plan, as a suspend process (Step S110), the cleaner 76 is moved away from the intermediate transfer belt 71, and the static eliminating process and the drive-rotations of the intermediate transfer belt 71 is stopped. In this case, it is preferable that the intermediate transfer belt 71 is stopped in such a manner that the reference position of the intermediate transfer belt 71 is immediately before an opposed position facing the vertical synchronization sensor 77. This is because the state the intermediate transfer belt 71 is rotating is confirmed by means of detection of the vertical synchronizing signal Vsync when the intermediate transfer belt 71 is in rotations in subsequent processing, and it is therefore possible to determine in a short period of time whether there is abnormality based on whether the vertical synchronizing signal Vsync is detected immediately after the start of the driving in the manner described above.

(B) Pre-Operation

Figure 7:
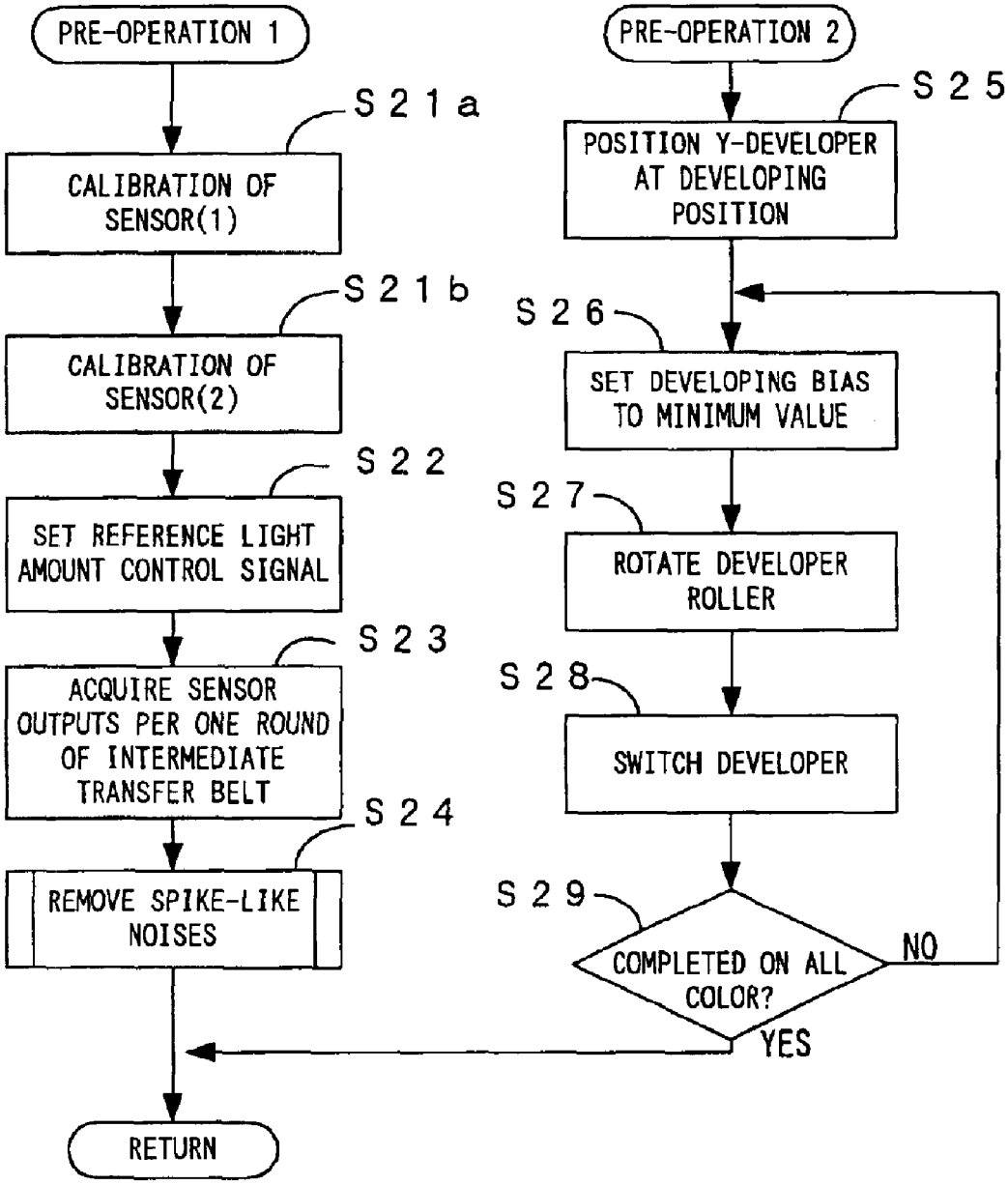
FIG. 7 is a flow chart which shows a pre-operation in the first embodiment.

FIG. 7 is a flow chart which shows a pre-operation in this embodiment. During the pre-operation, as pre-processing prior to formation of a patch image which will be described later, two processes are performed in parallel. More specifically, in parallel to adjustment of operating conditions for the respective portions of the apparatus in an effort to accurately optimize the density control factors (a pre-operation 1), the developer rollers 44 disposed to the respective developers 4Y, 4C, 4M and 4K are rotated idle (a pre-operation 2).

(B-1) Setting Operating Conditions (Pre-Operation 1)

During the left-hand side flow (the pre-operation 1) in FIG. 7, first, the density sensor 60 is calibrated (Step S21*a*, Step S21*b*). The calibration (1) at the step S21*a* requires to detect the output voltages Vp and Vs from the light receiver units 670*p* and 670*s* as they are when the light emitter element 601 of the density sensor 60 is OFF, and to store these as dark outputs Vpo and Vso. Next, during the calibration (2) at the step S21*b*, the light amount control signal Sic to be fed to the light emitter element 601 is changed so as to achieve two types of ON-states which are a low light amount and a high light amount, and the output voltage Vp from the light receiver unit 670*p* with each light amount is detected. From these three values, a reference light amount of the light emitter element 601 is calculated which ensures that the output voltage Vp in a toner adhesion-free state will be at a predetermined reference level (which is a value obtained by adding the dark output Vpo to 3 V in this embodiment). A level of the light amount control signal Slc which ensures that the light amount of the light emitter element 601 will be the reference light amount is thus calculated, and the calculated value is set as a reference light amount control signal (Step S22). Following this, when it becomes necessary to turn on the light emitter element 601, the CPU 101 outputs the reference light amount control signal to the irradiated light amount adjusting unit 605 and the light emitter element 601 is feedback-controlled so as to emit light always in the reference light amount.

The output voltages Vp and Vs as they are when the light emitter element 601 is OFF are stored as "dark outputs" of this sensor system. As these values are subtracted from the output voltages Vp and Vs at the time of detection of a density of a toner image, an influence of the dark outputs is eliminated and the density of the toner image is detected at a high accuracy, as described later.

An output signal from the light receiver element 672*p* with the light emitter element 601 turned on is dependent upon the amount of reflection light from the intermediate transfer belt 71. But as described later, since the condition of the surface of the intermediate transfer belt 71 is not always optically uniform, for the purpose of calculating the output in such a condition, it is desirable to calculate an average value across one round of the intermediate transfer belt 71. Further, while it is not necessary to detect output signals representing one round of the intermediate transfer belt 71 when the light emitter element 601 is OFF, in order to reduce a detection error, it is preferable to average out output signals obtained at more than one points.

In this embodiment, since the surface of the intermediate transfer belt 71 is white, reflectance of light is high. The reflectance however decreases when the toner in any color adheres on the intermediate transfer belt 71. Hence, in this embodiment, as the amount of the toner adhering to the surface of the intermediate transfer belt 71 increases, the output voltages Vp and Vs from the light emitter units decrease from the reference level. And therefore, it is possible to estimate the amount of the adhering toner, and further an image density of a toner image, from the values of the output voltages Vp and Vs.

In addition, since the reflection characteristics are different between color (Y, C, M) toner and black (K) toner, this embodiment requires to calculate a density of a patch image formed with black toner described later based on the light amount of p-polarized light included in reflection light from the patch image, but to calculate a density of a patch image formed with color toner based on a light amount ratio of p-polarized light and s-polarized light. Hence, it is possible to accurately calculate an image density over a wide dynamic range.

Referring back to FIG. 7, the pre-operation will be continuously described. The condition of the surface of the intermediate transfer belt 71 is not always optically uniform, and fused toner during use may gradually lead to discoloration, dirt, etc. To prevent a change in surface condition of the intermediate transfer belt 71 from causing an error in detection of a density of a toner image, this embodiment requires to acquire a foundation profile covering one round of the intermediate transfer belt 71, namely, information regarding shading on the surface of the intermediate transfer belt 71 which does not carry a toner image. To be more specific, the light emitter element 601 is made emit light in the reference light amount calculated earlier, the intermediate transfer belt 71 is made rotate one round while sampling the output voltages Vp and Vs from the light receiver units 670*p* and 670*s* (Step S23), and the sample data (the number of samples in this embodiment: 312) are stored as a foundation profile in a RAM 107. With the shading in the respective areas on the surface of the intermediate transfer belt 71 grasped in advance in this fashion, it is possible to more accurately estimate a density of a toner image which is formed on the intermediate transfer belt 71.

Figure 8A:
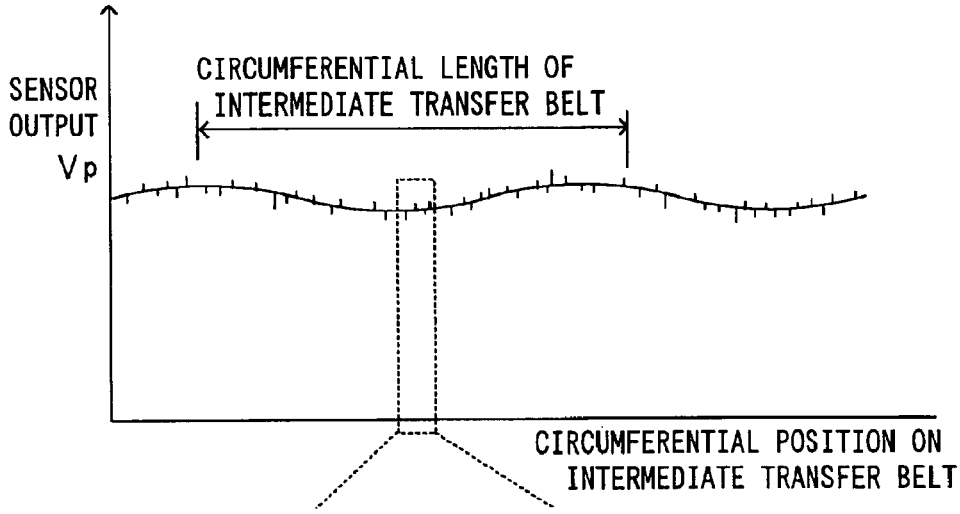
FIGS. 8A and 8B are drawings which show an example of a foundation profile of an intermediate transfer belt.
Figure 8B:
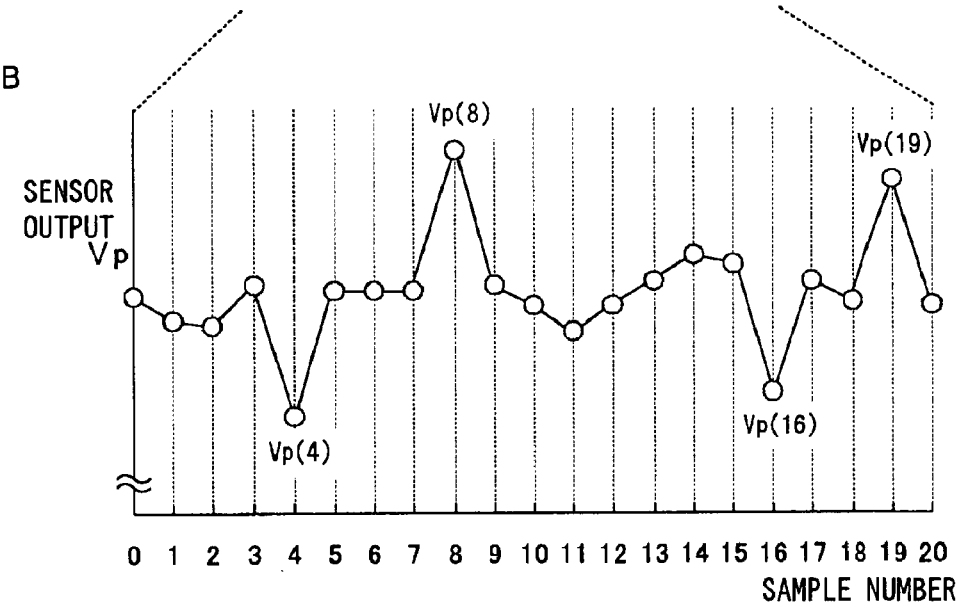

By the way, in some cases, changes in reflectance due to a very small scars or dirt on the roller 75 and the intermediate transfer belt 71, and further, spike-like noises attributed to an electric noise mixed in a sensor circuit may get superimposed on the output voltages Vp and Vs from the density sensor 60 described above. FIGS. 8A and 8B are drawings which show an example of the foundation profile of the intermediate transfer belt. When one detects with the density sensor 60 and plots the amount of reflection light from the surface of the intermediate transfer belt 71 over one round or more of the intermediate transfer belt 71, the output voltage Vp from the density sensor 60 cyclically changes in accordance with the circumferential length or the rotating cycles of the intermediate transfer belt 71, and further, narrow spike-like noises may sometimes get superimposed over the waveform of the output voltage Vp. These noises may possibly contain both a component which is in synchronization to the rotating cycles and an irregular component which is not in synchronization to the rotating cycles. FIG. 8B shows a part of such a sample data string as it is enlarged. In FIG. 8B, two data pieces denoted at Vp(8) and Vp(19) among the respective sample data pieces are dominantly larger than the other data pieces and two data pieces denoted at Vp(4) and Vp(16) are dominantly smaller than the other data pieces because of superimposition of the noises. Although only the p-polarized light component among the two outputs from the sensor is described here, a similar concept applies to the s-polarized light component, too.

A detectable spot diameter of the density sensor 60 is about 2 to 3 mm for instance, while discoloration, dirt and the like of the intermediate transfer belt 71 are generally in a size of a larger range. Hence, one can conclude that these local spikes in the data are due to the influence of the noises described above. When a foundation profile, a density of a patch image or the like is calculated based on such sample data which contain superimposed noises and density control factors are set in accordance with the result of the calculation, it may become impossible to set each density control factor always to a proper condition and an image quality may deteriorate.

Noting this, as shown in FIG. 7, after sampling the outputs from the sensor over one round of the intermediate transfer belt 71 at the step S23, the spike-like noises are removed in this embodiment (Step S24).

Figure 9:
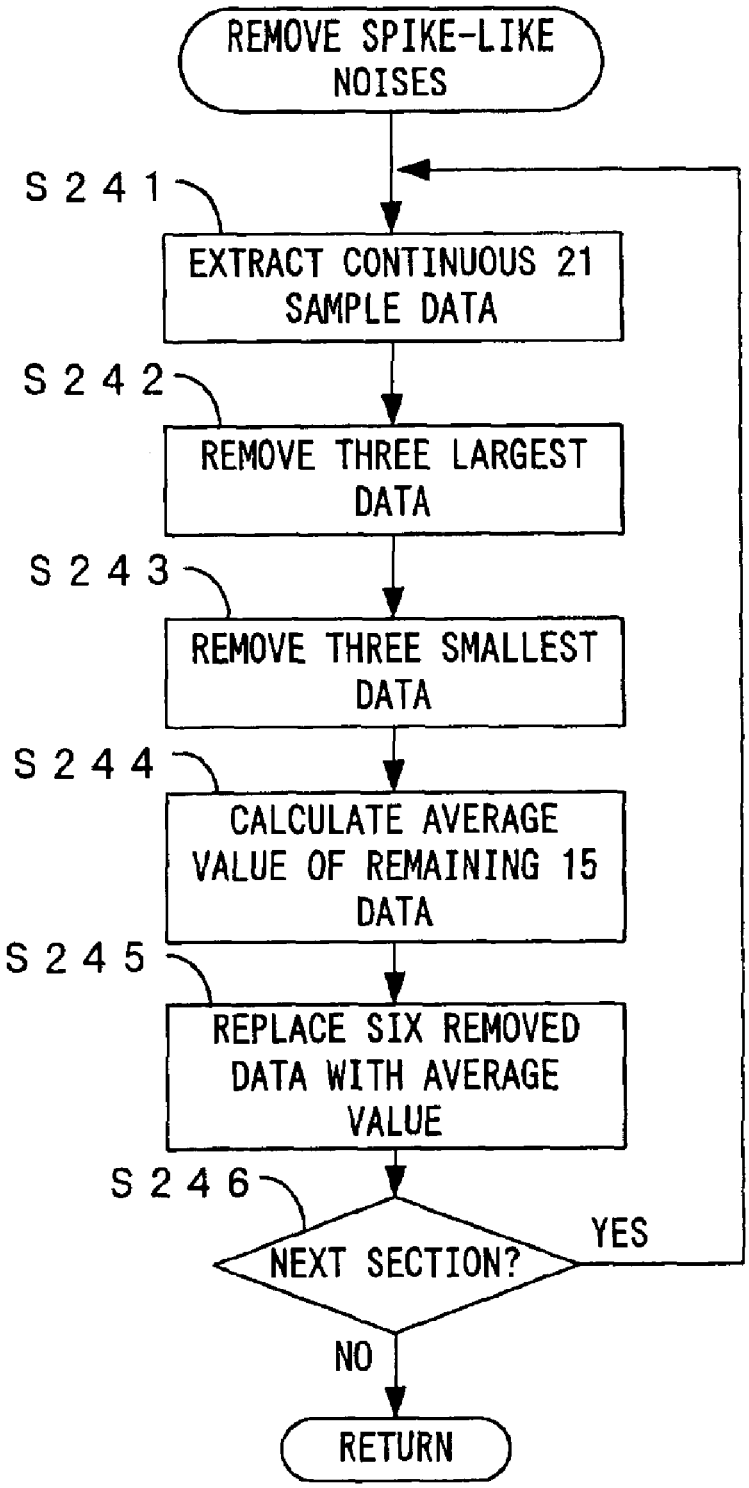
FIG. 9 is a flow chart which shows a spike-like noise removing process in the first embodiment.

FIG. 9 is a flow chart which shows a spike-like noise removing process in this embodiment. During the spike-like noise removing process, of an acquired sample data string as it is "raw," that is, as it has not been processed, a continuous local section (whose length corresponds to 21 samples in this embodiment) is extracted (Step S241), and after removing data pieces having the three highest and the three lowest levels from the 21 sample data pieces contained in this section (Step S242, Step S243), an arithmetic average of the remaining 15 data pieces is calculated (Step S244). The average value is regarded as an average level in this section, and the six data pieces removed at the steps S242 and S243 are replaced with the average value, whereby a noise-free "corrected" sample data string is obtained (Step S245). Further, the steps S241 through S245 are repeated for the next section as well when necessary, thereby removing spike-like noises (Step S246).

Figure 10:
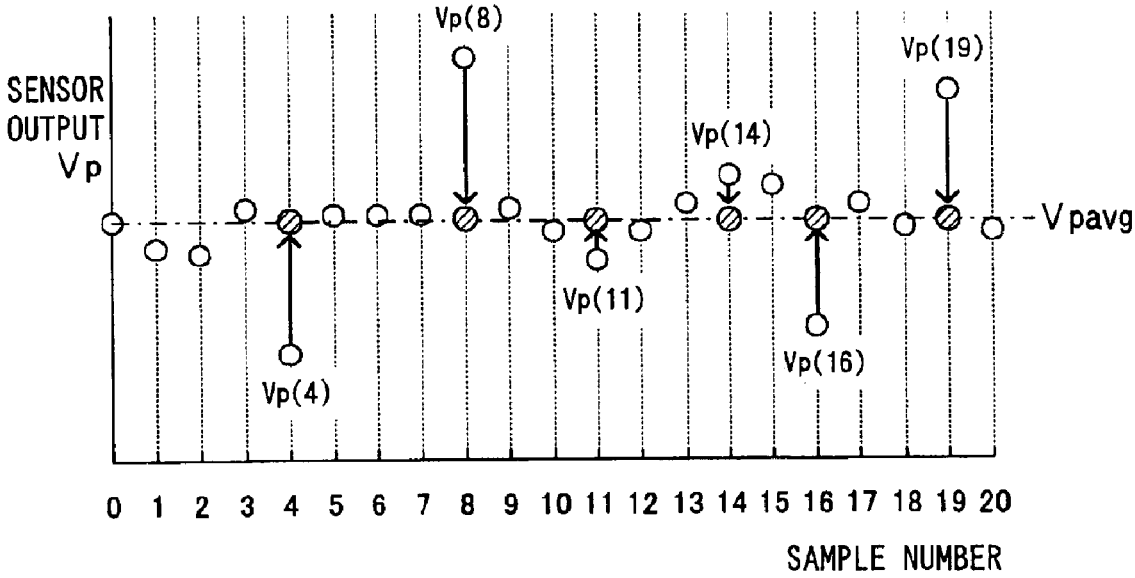
FIG. 10 is a drawing which shows spike-like noise removal in the first embodiment.

Removal of spike-like noises during the process above will now be described in more detail on the data string shown in FIG. 8B, while referring to FIG. 10. FIG. 10 is a drawing which shows spike-like noise removal in this embodiment. In the data string shown in FIG. 8B, the influence of the noises seems to be visible over the two data pieces Vp(8) and Vp(19) which are dominantly larger than the other data pieces and the two data pieces Vp(4) and Vp(16) which are dominantly smaller than the other data pieces. Since the spike-like noise removing process requires to remove the three largest sample data pieces (Step S242 in FIG. 9), those which are to be removed are the three data pieces Vp(8), Vp(14) and Vp(19) including the two data pieces which seem to contain the noises. In a similar manner, the three data pieces Vp(4), Vp(11) and Vp(16) including the two data pieces which seem to contain the noises are also removed (Step S243 in FIG. 9). As these six data pieces are replaced with the average value Vpavg of the other 15 data pieces (denoted at the shadowed circles) as shown in FIG. 10, the spike-like noises which used to be contained in the original data are removed.

For spike-like noise removal, the number of samples to be extracted and the number of data pieces to be removed are not limited to those described above but may be any desired numbers. However, since it becomes impossible to obtain a sufficient noise removing effect and an error may intensify depending on a choice of these numbers, it is desirable to carefully determine these numerical figures in view of the following points.

That is, extraction of too short a section of a data string as compared to the frequency of noises pushes up the possibility that noises are not included in the section within which spike-like noise removal will be executed and increases the number of calculations, and therefore, is not efficient. On the other hand, extraction of too long a section ends up in averaging out even significant variations in sensor output, namely, variations which represent a density change of an object of detection, and thus makes it impossible to correctly calculate a density profile despite the original purpose.

Further, since the frequency of noises is not constant, uniform removal of a predetermined number of largest or smallest data pieces from an extracted data string may result in removal of data such as data pieces Vp(11) and Vp(14) which do not contain noises, or on the contrary, may fail to sufficiently remove noises. Even when a few noise-free data components get removed, as shown in FIG. 10, since a difference between the data pieces Vp(11) and Vp(14) and the average value Vpavg is relatively small, an error attributed to replacement of these data pieces with the average value Vpavg is small. On the other hand, when the noise-containing data pieces are left not removed, replacement of the other data pieces with an average value calculated including these noise-containing data pieces may increase an error. Hence, it is desirable to calculate a ratio of the number of data pieces to be removed to the number of extracted sample data pieces such that the ratio will be comparable to or slightly higher than the frequency of noises created in the actual apparatus.

The spike-like noise removing process in this embodiment is designed as described above, based on the empirical fact that the frequency of data pieces shifted to be larger than an originally intended profile due to an influence of noises was about the same as the frequency of data pieces shifted to be smaller than the originally intended profile due to the influence of the noises and that the frequency of the noises themselves was about 25% or lower (five or fewer samples out of 21 samples) as shown in FIG. 8A.

Various other methods than the one described above may be used as a method of removing spike-like noises. For instance, it is possible to remove spike-like noises by processing "raw" sample data obtained through sampling with conventional low-pass filtering. However, since conventional filtering changes not only noise-containing data but also neighboring data from original values although it is possible to make a noise waveform less sharp, a large error may arise depending on the state of noises.

On the contrary, according to this embodiment, since the corresponding number of largest or smallest data pieces to the frequency of noises are replaced with an average value in sample data and the other data pieces are left unchanged, it is less likely that such an error will arise.

The spike-like noise removing process is executed not only for calculation of the foundation profile described above, but is performed also on sample data which were acquired as the amount of reflection light for the purpose of calculating an image density of a toner image as described later.

(B-2) Idling of Developer (Pre-Operation 2)

It is known that when the power source is OFF or even when the power source is ON, if there has been continuation of the operation-suspended state without any image forming operation performed over a long period of time before the next image forming operation, an image may have a cyclic density variation. This phenomenon will be hereinafter referred to "shutdown-induced banding." The inventors of the present invention have found that the cause of shutdown-induced banding is because toner fixedly adheres to the developer roller 44 after left carried on the developer roller 44 of each developer for a long time and because the layer of the toner on the developer roller 44 gradually becomes uneven as the amount of the adhering toner and the retention force of the adhering toner are not uniform on the surface of the developer roller 44. For instance, in the developer 4K according to this embodiment shown in FIG. 3, when the developer roller 44 has stopped rotating, the supply roller 43 or the restriction blade 45 abuts locally on the developer roller 44, with the toner rests on the developer roller 44 under pressure. Further, while a portion of the surface located inside the housing 41 is covered with a great amount of the toner and the toner T rests on the developer roller 44 under pressure with the supply roller 43 abutting on, a portion of the surface located outside the housing 41 is exposed to air as it carries a thin layer of the toner. The condition of the surface of the developer roller 44 is thus uneven in the circumferential direction of the developer roller 44.

Noting this, for the purpose of eliminating shutdown-induced banding before formation of a patch image, each developer roller 44 is rotated idle in the image forming apparatus according to this embodiment. As the right-hand side flow (the pre-operation 2) in FIG. 7 shows, first, the yellow developer 4Y is positioned at the developing position facing the photosensitive member 2 (Step S25), and after setting the average developing bias Vavg to a value having the smallest absolute value within a variable range of the average developing bias (Step S26), the developer roller 44 is rotated at least one round using the rotation driver (not shown) which is disposed to the main body (Step S27). Following this, while rotating the developer unit 4 and thereby switching the developer (Step S28), the other developers 4C, 4M and 4K are positioned at the developing position in turn and the developer roller 44 disposed to each developer is rotated one round or more. As each developer roller 44 is rotated idle one round or more in this manner, a toner layer on the surface of each developer roller 44 is peeled off and re-formed by the supply roller 43 and the restriction blade 45. Hence, thus re-formed more uniform toner layer is used for subsequent formation of a patch image, which makes it less likely to see a density variation attributed to shutdown-induced banding.

During the pre-operation 2 described above, the average developing bias Vavg is set so as to have the smallest absolute value at the step S26. The reason is as follows.

As described later, with respect to the average developing bias Vavg serving a density control factor which affects an image density, the larger the absolute value |Vavg| of the average developing bias Vavg is, the higher a density of a formed toner image becomes. This is because the larger the absolute value |Vavg| becomes, a potential difference increases which develops between an area in the electrostatic latent image on the photosensitive member 2 exposed with the light beam L, namely, the surface area which the toner is to adhere to, and the developer roller 44, and the movement of the toner from the developer roller 44 is further facilitated. However, at the time of acquisition of the foundation profile of the intermediate transfer belt 71, a such toner movement is not desirable. This is because as the toner which has moved from the developer roller 44 to the photosensitive member 2 transfers onto the intermediate transfer belt 71 within the primary transfer region TR1, the transferred toner changes the amount of reflection light from the intermediate transfer belt 71, and it becomes impossible to correctly calculate the foundation profile.

In this embodiment, as described later, the average developing bias Vavg can be changed over stages within a predetermined variable range, as one of density control factors. Noting this, with the average developing bias Vavg set to a value having the smallest absolute value within the variable range, such a state is realized which least likely leads to a movement of toner from the developer roller 44 to the photosensitive member 2, and adhesion of the toner to the intermediate transfer belt 71 is suppressed to minimum. For a similar reason, in an apparatus in which a developing bias contains an alternating current component, it is preferable that the amplitude of the developing bias is set to be smaller than an amplitude for ordinary image formation. For example, as described earlier, in an apparatus requiring the peak-to-peak voltage Vpp of the developing bias to be 1400 V, the peak-to-peak voltage Vpp may be about 1000 V In an apparatus using a duty ratio of the developing bias, the electrifying bias and the like for instance as density control factors, too, it is preferable that the density control factors are set appropriately so as to realize a condition which less likely leads to a movement of toner as that described above.

Further, this embodiment requires to simultaneously execute the pre-operation 1 and the pre-operation 2 described above parallel to each other, for the purpose of shortening a processing time. In other words, while the pre-operation 1 demands, for acquisition of the foundation profile, to rotate the intermediate transfer belt 71 idle at least one round or more preferably three rounds including two rounds needed for calibration of the sensor, it is preferable to rotate the developer roller 44 idle as much as possible also during the pre-operation 2. Since these processes can be executed independently of each other, parallel execution makes it possible to shorten a period of time needed for the entire operation while ensuring time needed for each one of these processes. In this embodiment, two pre-operation processes, namely, the pre-operation 1 which includes "preceding processing" of the present invention and the pre-operation 2 which includes "idling" of the present invention, are executed in parallel.

(C) Derive Control Target Value

In the image forming apparatus according to this embodiment, as described later, two types of toner images are formed as patch images and each density control factor is adjusted so that densities of these toner images will have a density target value. The target value is not a constant value but may be changed in accordance with an operating state of the apparatus. The reason is as follows.

As described earlier, in the image forming apparatus according to this embodiment, the amount of reflection light from a toner image which has been visualized on the photosensitive member 2 and primarily transferred on the surface of the intermediate transfer belt 71 is detected, and an image density of the toner image is estimated. While there are widely used conventional techniques for calculating an image density from the amount of reflection light from a toner image, as described below in detail, a correlation between the amount of reflection light from a toner image carried on the intermediate transfer belt 71 (or the sensor outputs Vp and Vs which correspond to the light amount) and an optical density (OD value) of a toner image formed on the sheet S which is a final recording medium is not determined uniformly but changes slightly depending on the conditions of the apparatus, the toner, etc. Hence, even when each density control factor is controlled so that the amount of reflection light from a toner image will be constant according to conventional techniques, a density of an image eventually formed on the sheet S will change depending on the condition of the toner.

Figure 11A:
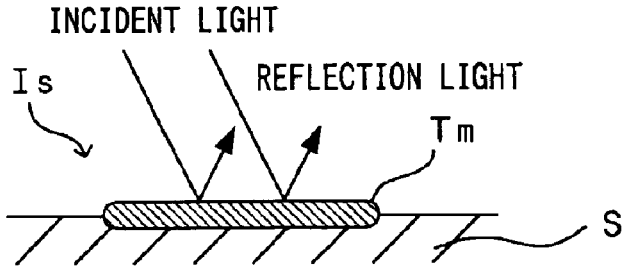
FIGS. 11A, 11B and 11C are schematic diagrams which show a relationship between a particle diameter of toner and the amount of reflection light.
Figure 11B:
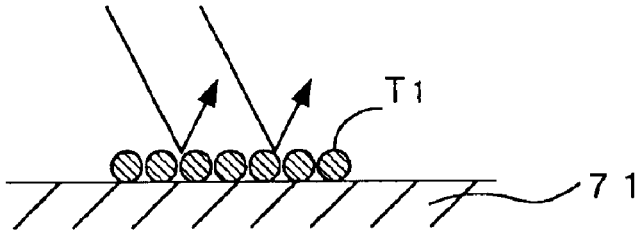
Figure 11C:
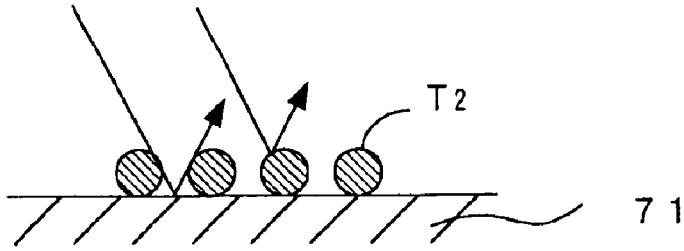

One cause that the sensor outputs fail to match with an OD value on the sheet S is that toner fused on the sheet S after a fixing process reflects differently from toner merely adhering to the surface of the intermediate transfer belt 71 without getting fixed to the surface of the intermediate transfer belt 71. FIGS. 11A, 11B and 11C are schematic diagrams which show a relationship between a particle diameter of toner and the amount of reflection light. As shown in FIG. 11A, in an image Is eventually formed on the sheet S, toner Tm melted by heat and pressure during the fixing process has fused on the sheet S. Hence, while an optical density (OD value) of the image represents the amount of reflection light as it is with the toner fused, the value of the optical density is determined mainly by a toner density on the sheet S (which can be expressed as a toner mass per unit surface area for instance).

On the contrary, in the case of the toner image on the intermediate transfer belt 71 which has not been through the fixing process, toner particles merely adhere to the surface of the intermediate transfer belt 71. Hence, even when the toner density is the same (That is, even when the OD value after the fixing is the same.), the amount of reflection light is not necessarily the same between a state that toner T1 having a small particle diameter shown in FIG. 11B has adhered in a high density and a state that toner T2 having a large particle diameter shown in FIG. 11C has adhered in a low density and the surface of the intermediate transfer belt 71 is locally exposed. In other words, even when the amount of reflection light from the pre-fixing toner image is the same, a post-fixing image density (OD value) does not always become the same. The experiment conducted by the inventors of the present invention has identified that in general, when the amount of reflection light is the same, if a ratio of toner having a large particle diameter to toner particles which form a toner image, a post-fixing image density tends to be high.

Figure 12A:
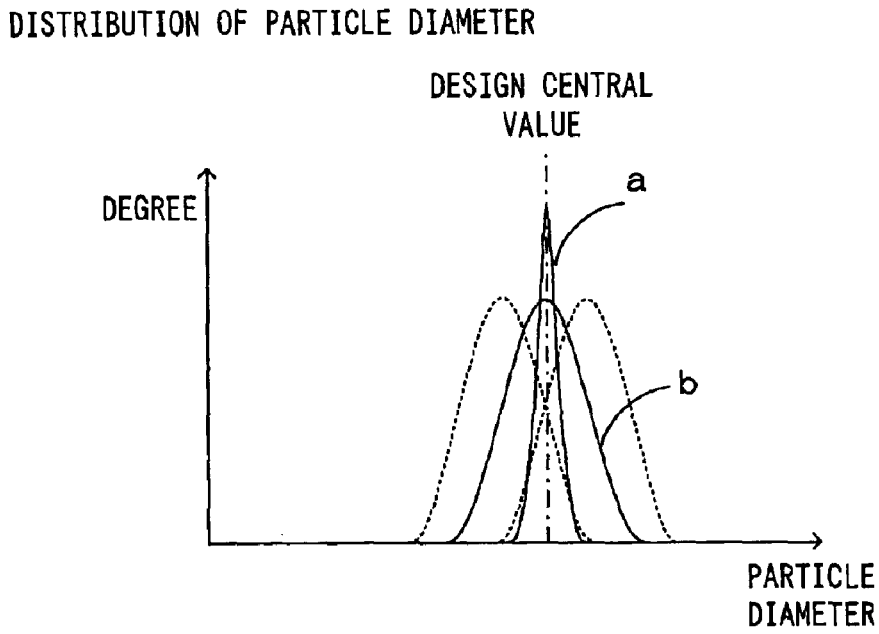
FIGS. 12A and 12B are drawings which show how a toner particle diameter distribution and a change in OD value relate to each other.
Figure 12B:
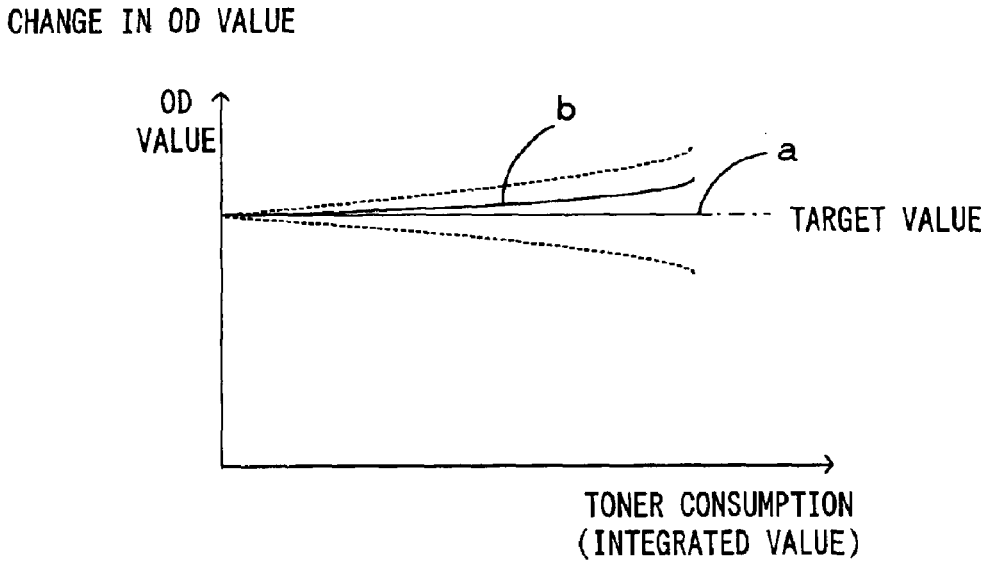

In this manner, a correlation between an OD value on the sheet S and the amount of reflection light from a toner image on the intermediate transfer belt 71 changes in accordance with the condition of toner, and particularly, a distribution of toner particle diameters. FIGS. 12A and 12B are drawings which show how a particle diameter distribution of toner and a change in OD value relate to each other. It is ideal that particle diameters of toner particles housed for formation of a toner image in the respective developers are all aligned to a design central value. However, as shown in FIG. 12A, in reality, the particle diameters are distributed in various manners depending on the type of the toner, a method of manufacturing the toner and the like of course. Even in the case of toner manufactured to meet the same specifications, the distribution slightly changes for each production batch and each product.

Since the mass, the electrification amount and the like of toner having various particle diameters are different, when an image is formed with the toner having such a particle diameter distribution, use of these toner is not uniform. Rather, such toner whose particle diameters are suitable to the apparatus is selectively used, and the other toner are left in the developers without used very much. Hence, as the toner consumption increases, the particle diameter distribution of the toner remaining in the developers changes.

As described earlier, since the amount of reflection light from a pre-fixing toner image changes in accordance with the diameters of the particles which form the toner, even though each density control factor is adjusted so that the amount of reflection light will be constant, a density of a image fixed on the sheet S does not always become constant. FIG. 12B shows a change in optical density (OD value) of an image on the sheet S which was formed while controlling each density control factor so that the amount of reflection light from a toner image, namely, the output voltages from the density sensor 60 will be constant. In the event that the toner particle diameters are well aligned in the vicinity of the design central value as denoted at the curve a in FIG. 12A, even when the consumption of the toner in the developers advances, the OD value is maintained approximately at a target value, as denoted at the curve a in FIG. 12B. On the contrary, as denoted at the curve b in FIG. 12A, when toner whose particle diameter distribution is wider is used, although toner whose particle diameters are close to the design central value is mainly used and an OD value almost the same as a target value is obtained initially as denoted at the curve b in FIG. 12B, as the toner consumption increases, the proportion of the popular toner decreases, toner having larger particle diameters starts to be used for formation of an image, and the OD value gradually increases. Further, as denoted at the dotted curves in FIG. 12A, a median value of the distribution is sometimes off the design value from the beginning depending on a production batch of the toner or the developers, and the OD value on the sheet S accordingly changes in various manners as more toner is used as denoted at the dotted curves in FIG. 12B.

Factors which influence a characteristic of toner include, in addition to a particle diameter distribution of the toner described above, the condition of pigment dispersion within mother particles of the toner, a change in electrifying characteristic of the toner owing to the condition of mixing of the toner mother particles and an additive, etc. Since a toner characteristic slightly varies among products, an image density on the sheet S is not always constant and the extent of a density change varies depending on toner which is used. Hence, in a conventional image forming apparatus in which each density control factor is controlled so that output voltages from a density sensor will be constant, a variation in image density because of a variation in toner characteristic is unavoidable and it therefore is not always possible to obtain a satisfactory image quality.

Noting this, in this embodiment, with respect to each one of two types of patch images described later, a control target value for an image density evaluation value (described later) which represents the image density is set in accordance with an operating state of the apparatus, and each density control factor is adjusted so that the evaluation value for each patch image will be the control target value, whereby an image density on the sheet S is maintained constant. The control target value corresponds to a density target value of the present invention.

Figure 13:
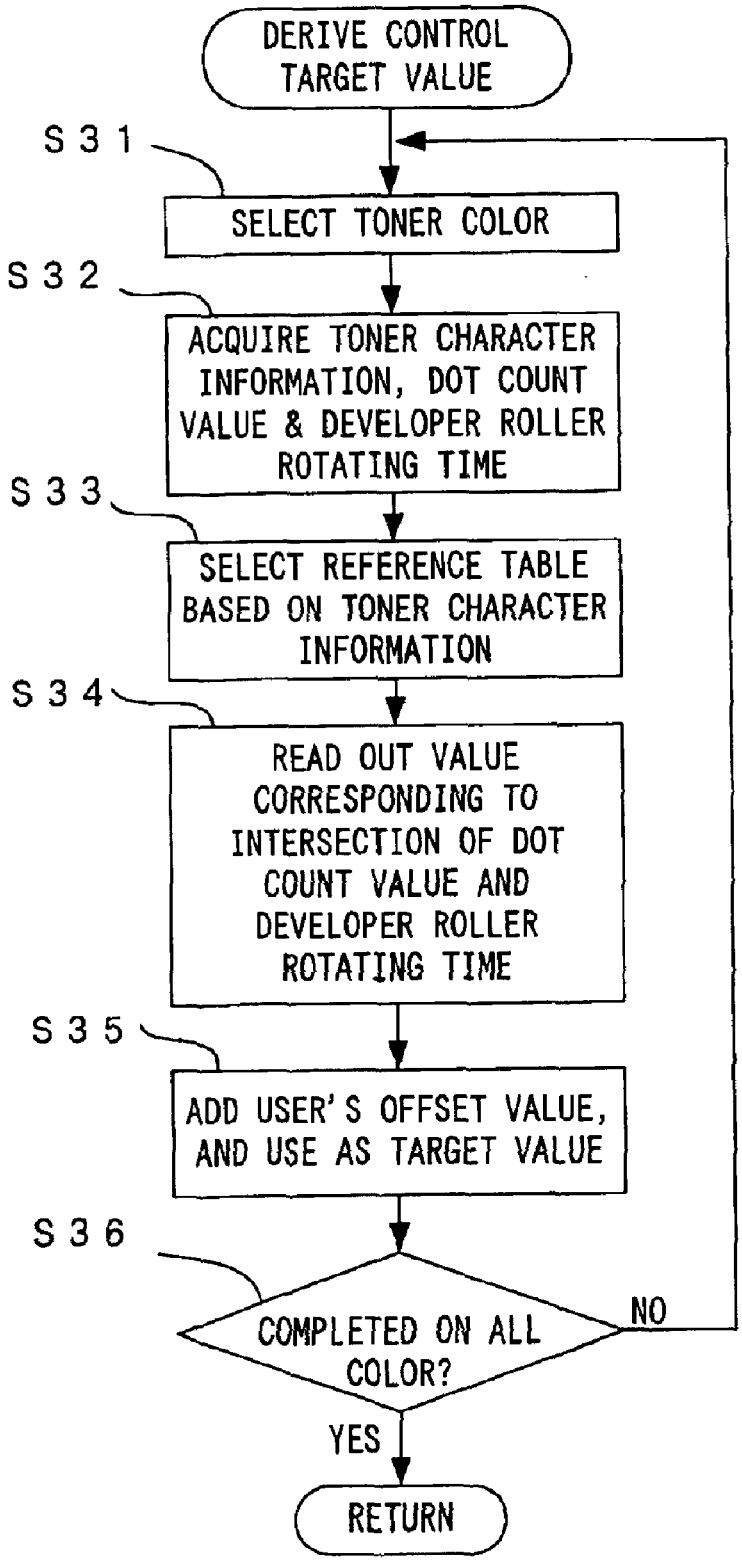
FIG. 13 is a flow chart which shows a process of deriving a control target value in the first embodiment.

FIG. 13 is a flow chart which shows a process of deriving the control target values in this embodiment. In this process, for each toner color, a control target value suiting the condition of use of the toner, namely, an initial characteristic such as a particle diameter distribution of the toner upon introduction into the developers, and the amount of the toner which remains the developer, are calculated. First, one of the toner colors is selected (Step S31), and the CPU 101 acquires, as information for estimating the condition of use of the toner, "toner character information" regarding the selected toner color, a "dot count" value which expresses the number of dots formed by the exposure unit 6 and information regarding a "developer roller rotating time (Step S32)". Although the description here relates to an example that a control target value corresponding to the black color is calculated, the description should remain similar on the other toner colors, too.

"Toner character information" is data written in a memory 94 which is disposed to the developer 4K in accordance with characteristics of the toner which is housed in the developer 4K. In this apparatus, noting that various characteristics such as the particle diameter distribution of the toner described above are different among different production batches, the characteristics of the toner are classified into eight types. The type of the toner is then determined based on an analysis during production, and 3-bit data representing the type are fed as toner character information to the developer 4K. This data are read out from the memory 94 when the developer 4K is mounted to the developer unit 4 and stored in the RAM 107 of the engine controller 10.

Meanwhile, a "dot count value" is information for estimating the amount of the toner which remains within the developer 4K. While to calculate from an integrated value of the number of formed images is the simplest method of estimating the remaining amount of the toner, it is difficult to learn about an accurate remaining amount with this method since the amount of the toner consumed by formation of one image is not constant. On the other hand, the number of dots formed by the exposure unit 6 on the photosensitive member 2 is indicative of the number of dots which are visualized on the photosensitive member 2 with the toner, the number of dots more accurately represents the consumed amount of the toner. Noting this, in this embodiment, the number of dots as it is when the exposure unit 6 has formed an electrostatic latent image on the photosensitive member 2 which is to be developed by the developer 4K is counted and stored in the RAM 107. Thus stored dot count value is used as information which represents the amount of the toner which remains within the developer 4K.

In addition, a "developer roller rotating time" is information for estimating in more detail the characteristics of the toner which remains within the developer 4K. As described earlier, there is the toner layer on the surface of the developer roller 44, and some of the toner moves onto the photosensitive member 2 and development is realized. At this stage, on the surface of the developer roller 44, the toner which has not contributed to the development is transported to an abutting position on the supply roller 43 and peeled off by the supply roller 43, thereby forming a new toner layer. As adhesion to and peeling off from the developer roller 44 is repeated in this manner, the toner is fatigued and the characteristics of the toner gradually change. Such a change in toner characteristics intensifies as the developer roller 44 rotates further. Hence, even when the amounts of toner remaining within the developer 4K is the same, there sometimes is a difference in characteristics between fresh toner which has not been used yet and old toner which has repeatedly adhered and has been peeled off. Densities of images formed using these toner may not necessarily be the same.

Noting this, in this embodiment, the condition of the toner housed inside the developer 4K is estimated based on a combination of two pieces of information, one being a dot count value which represents a remaining toner amount and the other being a developer roller rotating time which represents the extent of a change in toner characteristics, and a control target value is set more finely in accordance with the toner condition in order to stabilize an image quality. In this embodiment, the dot count value and the developer roller rotating time correspond to a secondary toner information of the present invention. These pieces of information are used also for the purpose of enhancing the ease of maintenance through management of the states of wear-out of the respective portions of the apparatus.

The secondary toner information is written in the memory 94 of the developer 4K before detaching the developer 4K out of the main body. Hence, as the developer 4K is mounted to the developer unit 4, the CPU 101 of the engine controller 10 reads this information out, thereby making it possible to grasp the history of the developer 4K, i.e., the consumption or the condition of the toner housed inside the developer 4K. In the event that a developer once removed by a user is re-attached once again or that another developer is attached to the apparatus, the apparatus automatically detects the condition of the housed toner and set an operation condition, so as to easy to handle the apparatus for user.

From these information regarding the operating state of the apparatus thus acquired, a control target value suiting the operating state is determined. This embodiment requires to calculate in advance through experiments optimal control target values which are proper to toner character information which expresses the type of the toner and to characteristics of the remaining toner estimated based on a combination of the dot count value and the developer roller rotating time. These values are stored as look-up tables by toner type in the ROM 106 of the engine controller 10. Based on thus acquired toner character information, the CPU 101 selects one table which is to be referred to in accordance with the type of the toner (Step S33), and reads out from the table a value which corresponds to the combination of the dot count value and the developer roller rotating time at that time (Step S34).

Further, in the image forming apparatus according to this embodiment, as a user enters an input through a predetermined operation on an operation part not shown, a density of an image to be formed is increased or decreased within a predetermined range in accordance with the user's preference or when such is necessary. In short, every time the user increases or decreases the image density by one notch in response to the value thus read out from the look-up table described above, a predetermined offset value which may be 0.005 per notch for instance is added or subtracted, and the result of this is set as a control target value Akt for the black color at that time and stored in the RAM 107 (Step S35). The control target value Akt for the black color is determined in this manner. The offset value is stored in the memory and used for deriving the target value next unless user changes the operation.

FIGS. 14A and 14B are drawings which show examples of look-up tables which are for calculating a control target value. This table is a table which is referred to when toner whose color is black and whose characteristics belong to "type 0" is to be used. This embodiment uses, for each one of two types of patch images, one for a high density and the other for a low density as described later, and for each toner color, eight types of tables which respectively correspond to eight types of toner characteristics, and these tables are stored in the ROM 106 of the engine controller 10. Shown in FIG. 14A is an example of a table which corresponds to a high-density patch image, while shown in FIG. 14B is an example of a table which corresponds to a low-density patch image. How to make these look-up tables will be described later.

When the toner character information acquired at the step S32 described above expresses the "type 0" for example, at the following step S33, the table shown in FIGS. 14A and 14B corresponding to the toner character information "0" is selected respectively out from the eight types of tables. The control target value Akt is then calculated based on thus acquired dot count value and developer roller rotating time. For example, for a high-density patch image, when the dot count value is 1500000 counts and the developer roller rotating time is 2000 sec, the value 0.984 which corresponds to the combination of these two is found to be the control target value Akt with reference to FIG. 14A. Further, when a user has set the image density one notch higher than a standard level, the value 0.989 which is obtained by adding 0.005 to this value is the control target value Akt. In a similar manner, it is possible to calculate a control target value for a low-density patch image.

The control target value Akt calculated in this fashion is stored in the RAM 107 of the engine controller 10. During later setting of each density control factor, it is ensured that an evaluation value calculated based on the amount of reflection light from a patch image matches with this control target value.

As described above, the control target value is calculated for the toner color through execution of the steps S31 through S35 described above. The process above is repeated for each toner color (Step S36), and control target values Ayt, Act and Amt and the control target value Akt on all toner colors are found. The subscripts y, c, m and k represent the respective toner colors, i.e., yellow, cyan, magenta and black, while the subscript t expresses that these values are control target values.

(D) Setting of Developing Bias

In this image forming apparatus, the average developing bias Vavg fed to the developer roller 44 and an energy E per unit surface area of the exposure beam L which exposes the photosensitive member 2 (hereinafter referred to simply as "exposure energy") are variable, and with these values adjusted, an image density is controlled. The following describes an example that optimal values of these two are calculated while changing the average developing bias Vavg over six stages of V0 to V6 from the low level side and changing the exposure energy E over four stages of a level 0 to a level 3 from the low level side. The variable ranges and the number of stages in each variable range, however, may be changed appropriately in accordance with the specifications of the apparatus. In an apparatus wherein the variable range of the average developing bias Vavg described above is from (−110 V) to (−330 V), the lowest level V0 corresponds to (−110 V) with the smallest absolute voltage value and the highest level V5 corresponds to (−330 V) with the largest absolute voltage value.

Figure 15:
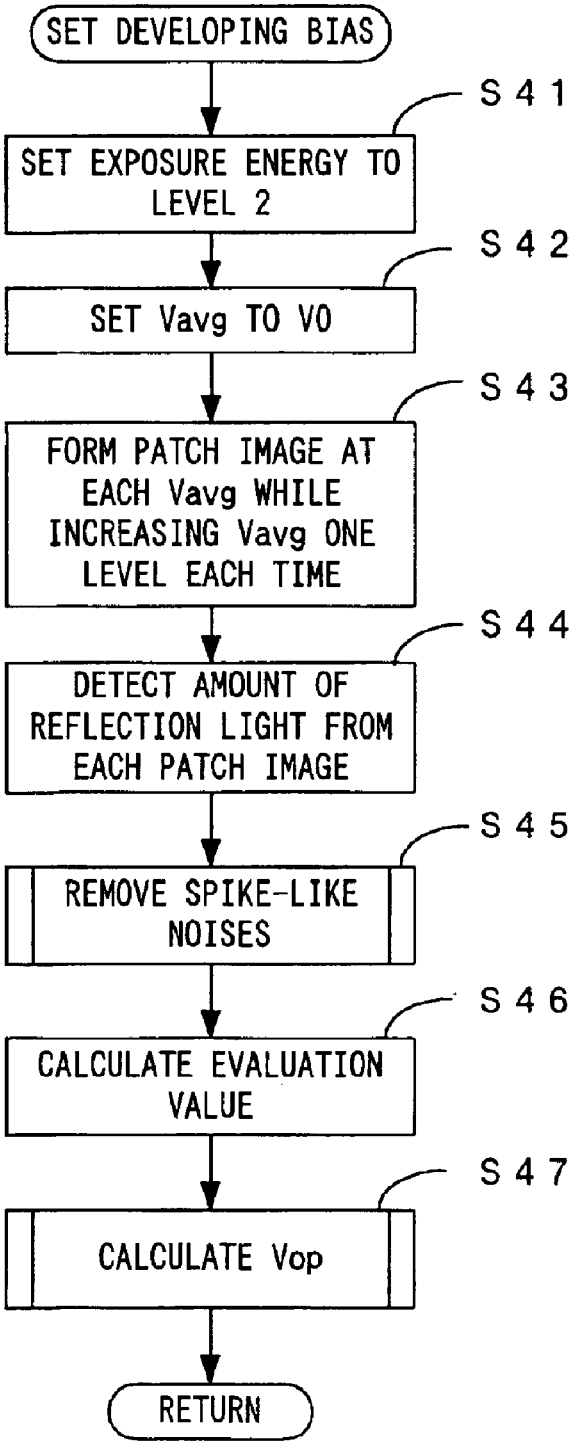
FIG. 15 is a flow chart which shows a developing bias setting process in the first embodiment.
Figure 16:
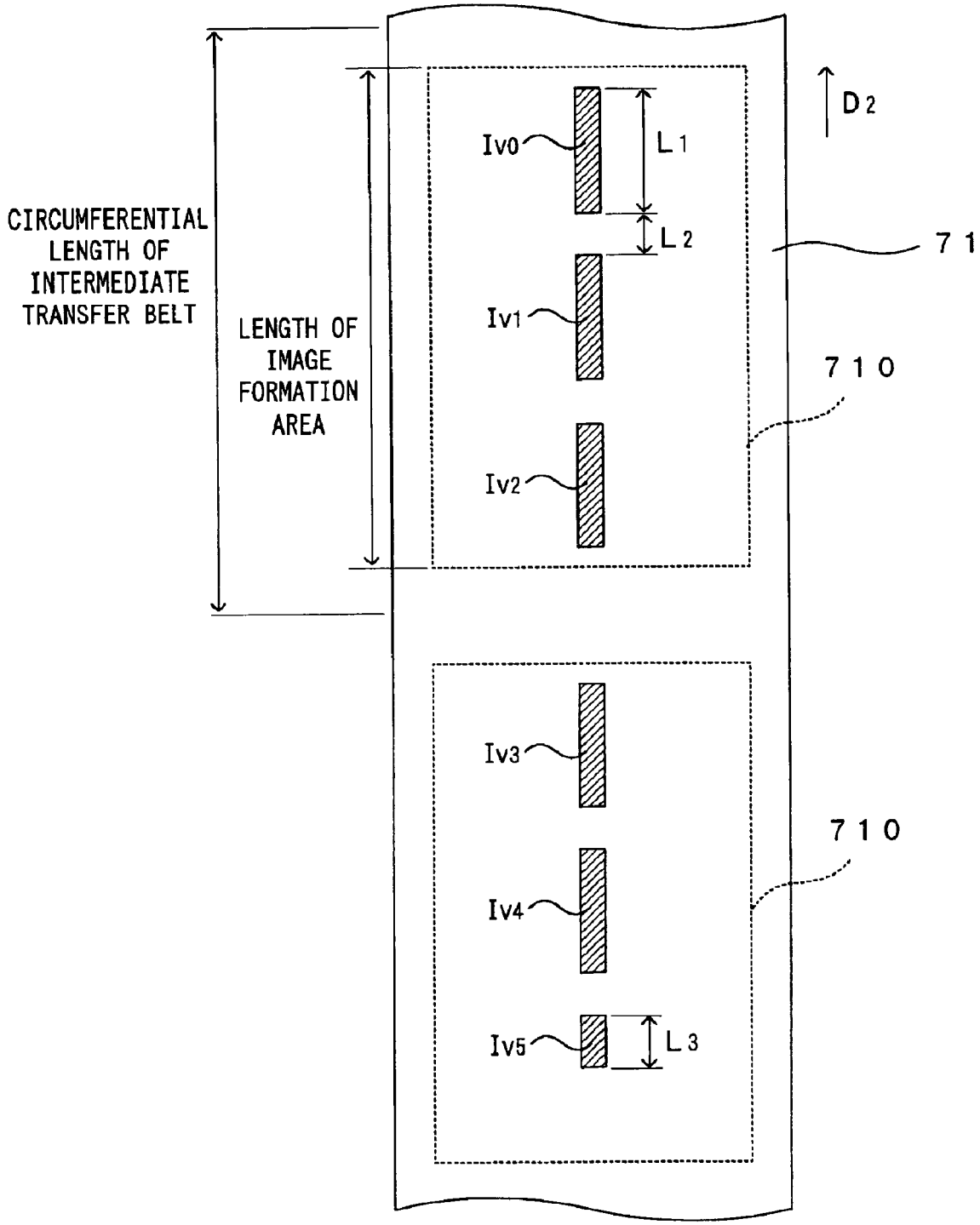
FIG. 16 is a drawing which shows a high-density patch image.

FIG. 15 is a flow chart which shows a developing bias setting process in this embodiment, and FIG. 16 is a drawing which shows a high-density patch image. During this process, first, the exposure energy E is set to the level 2 (Step S41), and while increasing the average developing bias Vavg from the lowest level VO by one level each time, a solid image which is to serve a high-density patch image is formed with each bias value (Step S42, Step S43).

While six patch images Iv0 through Iv5 are sequentially formed on the surface of the intermediate transfer belt 71 as shown in FIG. 16 in response to the average developing bias Vavg which is changed over the six stages, the first five patch images Iv0 through Iv4 have a length L1. The length L1 is set to be longer than the circumferential length of the photosensitive member 2 which has a cylinder-like shape. On the other hand, the last patch image Iv5 is formed to have a shorter length L3 than the circumferential length of the photosensitive member 2. The reason will be described later. Further, when the average developing bias Vavg is changed, there is a slight delay until the potential of the developer roller 44 becomes uniform, and therefore, the patch images are formed at intervals L2 considering the delay. While an area which can carry a toner image within the surface of the intermediate transfer belt 71 is an image formation area 710 in reality which is shown in FIG. 16, since the patch images have such shapes and arrangement as described above, about three patch images can be formed in the image formation area 710. The six patch images are thus distributed over two rounds of the intermediate transfer belt 71 as shown in FIG. 16.

Figure 17B:
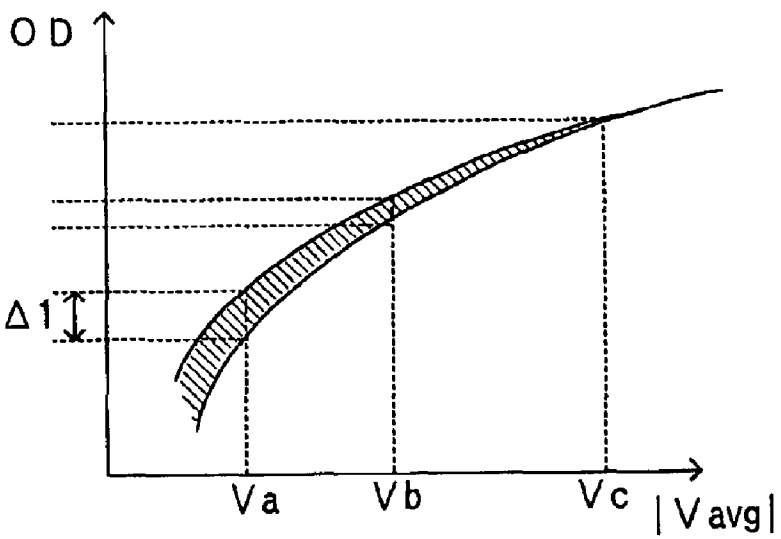
FIGS. 17A and 17B are drawings which show a variation in image density which appears at the cycles of rotation of a photosensitive member.
Figure 17A:
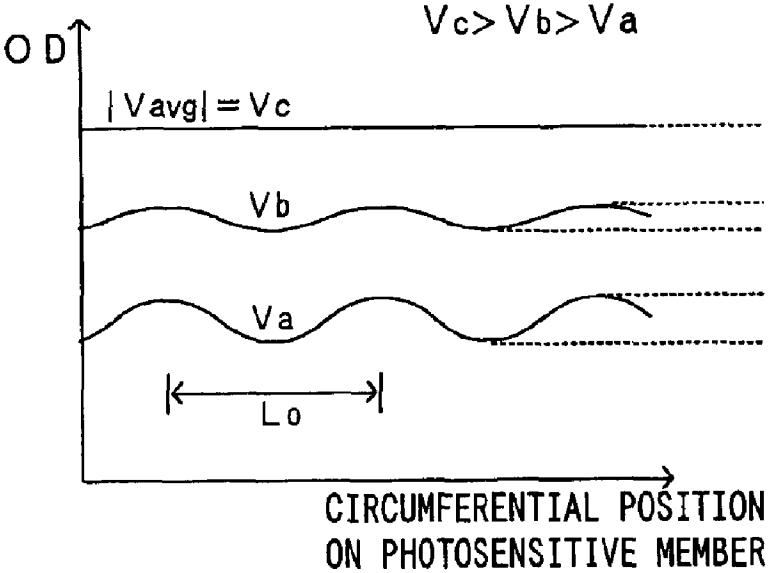

The reason that the lengths of the patch images are set as above will now be described with reference to FIGS. 17A and 17B. FIGS. 17A and 17B are drawings which show a variation in image density which appears at the cycles of rotation of the photosensitive member. As shown in FIG. 1, while the photosensitive member 2 is formed in a cylindrical shape (with a circumferential length of L0), the shape may not sometimes be completely cylindrical or may sometimes have eccentricity due to a production-induced variation, thermal deformation, etc. In such a case, an image density of a toner image may include cyclic variations which correspond to the circumferential length L0 of the photosensitive member 2. The reason is as follows. In an apparatus of the contact developing type in which development with toner is achieved with the photosensitive member 2 and the developer roller 44 abutting on each other, the abutting pressure between the two changes. Meanwhile, in an apparatus of the non-contact developing type in which development using toner is achieved with the two disposed away from each other, the strength of an electric field which causes transfer of the toner between the two changes. Therefore, a probability of a toner movement from the developer roller 44 to the photosensitive member 2 accordingly changes cyclically at the rotating cycles of the photosensitive member 2 in any apparatus.

The widths of the density variations are large particularly when the absolute value |Vavg| of the average developing bias Vavg is relatively small and decrease as the value |Vavg| increases as shown in FIG. 17A. For instance, when a patch image is formed with the absolute value |Vavg| of the average developing bias set to a relatively small value V0, as shown in FIG. 17B, the corresponding image density OD changes within the range of a width Δ1 depending on the location on the photosensitive member 2. In a similar manner, even when a patch image is formed with other developing bias, the corresponding image density changes within a certain range as denoted at the shadowed portion in FIG. 17B. In this fashion, the density OD of the patch image varies depending on not only the average developing bias Vavg but also the position of the patch image formed on the photosensitive member 2. Hence, to calculate an optimal value of the average developing bias Vavg from the image density of the patch image, it is necessary to eliminate an influence of density variations which correspond to the rotating cycles of the photosensitive member 2 exerted over the patch image.

Noting this, in this embodiment, a patch image having the length L1 which exceeds the circumferential length L0 of the photosensitive member 2 is formed, and an average value of densities calculated over the length L0 of the patch image is used as the image density of the patch image. This effectively suppresses an influence of density variations which correspond to the rotating cycles of the photosensitive member 2 exerted over the density of each patch image, which in turn makes it possible to properly calculate an optimal value of the average developing bias Vavg based on the density.

In this embodiment, as shown in FIG. 16, of the respective patch images Iv through Iv5, the last patch image Iv5 formed with the average developing bias Vavg set to the maximum has the shorter length L3 than the circumferential length L0 of the photosensitive member 2. This is because it is not necessary to calculate an average value over the cycles of the photosensitive member 2 as density variations corresponding to the rotating cycles of the photosensitive member 2 are small in a patch image formed under the condition that the absolute value |Vavg| is large as shown in FIG. 17B and as described above. In this manner, a period of time needed to form and process a patch image is shortened, and the consumption of toner during formation of the patch image is reduced.

It is desirable to form a patch image in such a manner that the length of the patch image will be larger than the circumferential length L0 of the photosensitive member 2, for the purpose of eliminating an influence of density variations created in accordance with the cycles of the photosensitive member over optimization of density control factors. However, it is not necessary that all patch images have such a length. How many patch images should have such a length needs be determined appropriately in accordance with the extent of density variations which appear in each apparatus, a desired image quality level, etc. For instance, in the event that an influence of density variations at the cycles of the photosensitive member is relatively small, the patch image Iv0 formed with the average developing bias Vavg set to the minimum may have the length L1 and the other patch images Iv1 through Iv5 may have the shorter length L3.

Although all patch images may be formed to have the length L1 on the contrary, in this case, there arises a problem that a processing time and the consumption of toner increase. In addition, it is not preferable in terms of image quality to create density variations corresponding to the cycles of rotation of the photosensitive member even when the average developing bias Vavg is maximum, and therefore, the variable range of the average developing bias Vavg should be determined so that such density variation will not appear at least when the average developing bias Vavg is set to the maximum value. When the variable range of the average developing bias Vavg is set so, such density variations will not appear while the variable range of the average developing bias Vavg is at the maximum, and hence, it is not necessary that a patch image has the length L1.

Referring back to FIG. 15, the developing bias setting process will be continuously described. As for the patch images Iv0 through Iv5 thus formed each with the average developing bias Vavg, the voltages Vp and Vs outputted from the density sensor 60 in accordance with the amounts of reflection light from the surfaces of the patch images are sampled (Step S44). In this embodiment, at 74 points (corresponding to the circumferential length L0 of the photosensitive member 2) as for the patch images Iv0 through Iv4 having the length L1 and at 21 points (corresponding to the circumferential length of the developer roller 44) as for the patch image Iv5 which has the length L3, sample data are obtained from the output voltages Vp and Vs from the density sensor 60 at sampling cycles of 8 msec. In a similar manner to that during derivation of the foundation profile (FIG. 7) described earlier, removal of spike-like noises from the sample data is executed (Step S45). And then, an "evaluation value" on each patch image is calculated (Step S46) from the resulting data after the removal of dark outputs of the sensor system, an influence of the foundation profile and the like.

As described earlier, the density sensor 60 of this apparatus exhibits a characteristic that an output level with no toner adhering to the intermediate transfer belt 71 is the largest but decreases as the amount of the toner increases. Further, an offset due to the dark outputs has been superimposed on the output. Therefore, the output voltage data from the sensor as they directly are hard to be handled as information which is for evaluating the amount of the adhering toner. Noting this, in this embodiment, thus obtained data are processed into such data which express the amount of the adhering toner, that is, converted into an evaluation value, so as to make it easy to execute the subsequent processing.

A method of calculating the evaluation value will now be more specifically described, in relation to an example of a patch image in the black color. Of six patch images developed with the black toner, an evaluation value Ak(n) for an n-th patch image Ivn (where n=0, 1, . . . , 5) is calculated from the formula below:

$$Ak(n)=1-\{Vpmeank(n)-Vpo\}/\{Vpmean_b-Vpo\}$$

The respective terms included in the formula mean the following.

First, the term Vpmeank(n) denotes a noise-removed average value of sample data outputted from the density sensor 60 as the output voltage Vp, which corresponds to the p-polarized light component of reflection light from the n-th patch image Ivn, and thereafter sampled. That is, a value Vpmeank(0) corresponding to the first patch image Iv0 for instance denotes an arithmetic average of 74 pieces of sample data which were detected as the output voltage Vp from the density sensor 60 over the length L0 of this patch image, subjected to spike-like noise removal and stored in the RAM 107. The subscript k appearing in each term of the formula above expresses that these values are on the black color.

Meanwhile, the term Vpo denotes a dark output voltage from the light receiver unit 670*p* acquired during the pre-operation 1 described earlier with the light emitter element 601 turned off. As the dark output voltage Vpo is subtracted from the sampled output voltage, it is possible to calculate a density of a toner image at a high accuracy while eliminating an influence of the dark output.

Further, the term Vpmean_b denotes an average value of sample data which were, of the foundation profile data stored in the RAM 107 obtained earlier, detected at the same positions as positions at which the 74 pieces of sample data used for the calculation of Vpmeank(n) were detected.

Hence, in a condition that no toner has adhered at all as a patch image to the intermediate transfer belt 71, Vpmeank (n)=Vpmean_b holds satisfied and the evaluation value Ak(n) accordingly becomes zero. On the other hand, in a condition that the surface of the intermediate transfer belt 71 is completely covered with the black toner and the reflectance is zero, Vpmeank(n)=Vpo holds satisfied and hence the evaluation value Ak(n)=1.

When the evaluation value Ak(n) is used instead of using the value of the sensor output voltage Vp as it directly is, it is possible to measure an image density of a patch image at a high accuracy while canceling an influence due to the condition of the surface of the intermediate transfer belt 71. In addition, because of correction in accordance with the shading of the patch image on the intermediate transfer belt 71, it is possible to further improve the accuracy of measuring the image density. In addition, this permits to normalize the density of the patch image Ivn using a value ranging from the minimum value 0, which expresses a state that no toner has adhered, to the maximum value 1, which expresses a state that the surface of the intermediate transfer belt 71 is covered with high-density toner, and accordingly express the density of the patch image Ivn, which is convenient to estimate a toner image density during the subsequent processing.

As for the other toner color than black, that is, the yellow color (Y), the cyan color (C) and the magenta color (M), since the reflectance is higher than on the black color and the amount of reflection light is not zero even when the surface of the intermediate transfer belt 71 is covered with toner, there may be a case that a density can not be accurately expressed using the evaluation value obtained in the manner above. In this embodiment therefore, used as sample data at the respective positions for calculation of evaluation values Ay(n), Ac(n) and Am(n) for these toner colors is not the output voltage Vp corresponding to the p-polarized light component but is a value PS which is obtained by dividing a value obtained by subtracting the dark output Vpo from the output voltage Vp by a value obtained by subtracting the dark output Vso from the output voltage Vs corresponding to the s-polarized light component, that is, PS=(Vp−Vpo)/(Vs−Vso), which makes it possible to accurately estimate image densities also in these toner colors. In addition, as in the case of the black color, a sensor output obtained at the surface of the intermediate transfer belt 71 prior to toner adhesion is considered, thereby canceling an influence exerted by the condition of the surface of the intermediate transfer belt 71. Further, owing to correction in accordance with the shading of a patch image on the intermediate transfer belt 71, it is possible to further improve the accuracy of measuring an image density.

For example, as for the cyan color (C), the evaluation value Ac(n) is calculated from:

$$Ac(n)=1-\{PSmeanc(n)-Pso\}/\{PSmean_b-Pso\}$$

The symbol PSmeanc(n) denotes an average value of noise-removed PS values calculated from the sensor outputs Vp and Vs at the respective positions of the n-th patch image Ivn in the cyan color. Meanwhile, the symbol Pso denotes a value PS which corresponds to the sensor outputs Vp and Vs as they are in a condition that the surface of the intermediate transfer belt 71 is completely covered with the color toner, and is the minimum possible value of PS. Further, the symbol PSmean_b denotes an average value of the values PS calculated from the sensor outputs Vp and Vs as they are sampled as a foundation profile at the respective positions on the intermediate transfer belt 71.

When the evaluation values for the color toner are defined as described above, as in the case of the black color described earlier, it is possible to normalize the density of the patch image Ivn using a value ranging from the minimum value 0, which expresses a state that no toner has adhered to the intermediate transfer belt 71 (and that PSmeanc(n)=PSmean_b is satisfied), to the maximum value 1, which expresses a state that the intermediate transfer belt 71 is covered completely with the toner (and that PSmeanc (n)=PSo is satisfied), and express the density of the patch image Ivn.

Figure 18:
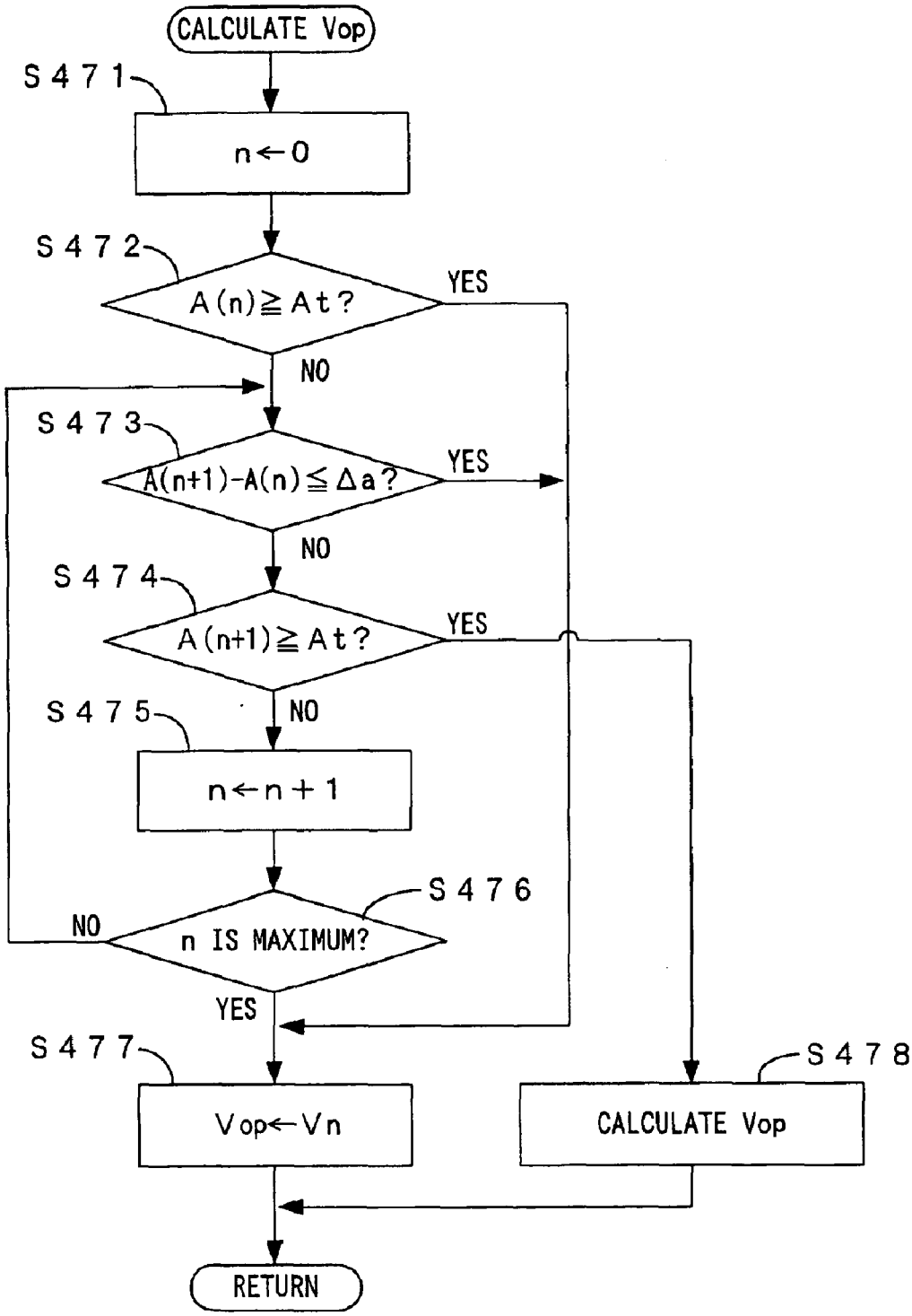
FIG. 18 is a flow chart which shows a process of calculating an optimal value of developing bias in the first embodiment.

As the densities of the patch images (to be more specific, the evaluation values for the patch images) are thus calculated, an optimal value Vop of the average developing bias Vavg is calculated based on these values (Step S47). FIG. 18 is a flow chart which shows a process of calculating the optimal value of the developing bias in this embodiment. This process remain unchanged in terms of content among the toner colors, and therefore, the subscripts (y, c, m, k) expressing evaluation values and corresponding to the toner colors are omitted in FIG. 18. However, the evaluation values and target values for the evaluation values may of course be different value among the different toner colors.

First, a parameter n is set to 0 (Step S471), and an evaluation value A(n), namely A(0), is compared with a control target value At (Akt for the black color for instance) which was calculated earlier (Step S472). At this stage, the evaluation value A(0) being equal to or larger than the control target value At means that an image density over a target density has been obtained with the average developing bias Vavg set to the minimum value V0. Hence, there is no need to study a higher developing bias, and the process is ended acknowledging that the minimum developing bias V0 at this stage is the optimal value Vop (Step S477).

On the contrary, when the evaluation value A(0) is yet to reach the control target value At, an evaluation value A(1) for a patch image Iv1 formed with a developing bias V1 which is one level higher is read out, a difference from the evaluation value A(0) is calculated, and whether thus calculated difference is equal to or smaller than a predetermined value Δa is judged (Step S473). In the event that the difference between the two is equal to or smaller than the predetermined value Δa, in a similar fashion to the above, the average developing bias V0 is acknowledged as the optimal value Vop. The reason for this will be described in detail later.

On the other hand, when the difference between the two is larger than the predetermined value Δa, the process proceeds to a step S474 and the evaluation value A(1) is compared with the control target value At. At this stage, when the evaluation value A(1) is the same as or over the control target value At, since the control target value At is larger than the evaluation value A(0) but is equal to or smaller than the evaluation value A(1), that is since A(0) $<At \leqq A(1)$, the optimal value Vop of the developing bias for obtaining the target image density must be between the developing biases V0 and V1. In short, $V0<Vop \leqq V1$.

In such a case, the process proceeds to a step S478 to calculate the optimal value Vop through computation. While various methods may be used as the calculation method, an example may be to approximate a change in evaluation value in accordance with the average developing bias Vavg as a proper function within a section from V0 to V1 and thereafter to use, as the optimal value Vop, such an average developing bias Vavg with which a value derived from the function is the control target value At. Of these various methods, while the simplest one is a method which requires to linearly approximate an evaluation value change, when the variable range of the average developing bias Vavg is properly selected, it is possible to calculate the optimal value Vop at a sufficient accuracy. Of course, although the optimal value Vop may be calculated by other method, e.g., using a more accurate approximate function, this is not always practical considering a detection error of the apparatus, a variation among apparatuses, etc.

On the other hand, in the event that the control target value At is larger than the evaluation value A(1) at the step S474, n is incremented by 1 (Step S475) and the optimal value Vop is calculated while repeating the steps S473 through S475 described above until n reaches the maximum value (Step S476). In the meantime, when calculation of the optimal value Vop has not succeeded, i.e., when any one of the evaluation values corresponding to the six patch images has not reached the target value, even after n has reached the maximum value (n=5) at the step S476, the developing bias VS which makes the density largest is used as the optimal value Vop (Step S477).

As described above, in this embodiment, each one of the evaluation values A(0) through A(5) corresponding to the respective patch images Iv0 through Iv5 is compared with the control target value At and the optimal value Vop of the developing bias for achieving the target density is calculated based on which one of the two is larger than the other. But at the step S473, as described earlier, when a difference between the evaluation values A(n) and A(n+1) corresponding to continuous two patch images is equal to or smaller than the predetermined value Δa, the developing bias Vn is used as the optimal value Vop. The reason is as follows.

As shown in FIG. 17B, the apparatus exhibits a characteristic that while an image density OD on the sheet S increases as the average developing bias Vavg increases, the growth rate of the image density decreases in an area where the average developing bias Vavg is relative large, but gradually saturates. This is because as toner has adhered at a high density to a certain extent, an image density will not greatly increase even though the amount of the adhering toner increases further. To increase the average developing bias Vavg to further increase an image density in an area wherein the growth rate of the image density is small ends up in excessively increasing the toner consumption although a very large increase in density can not be expected, and as such, is not practical. On the contrary, in such an area, with the average developing bias Vavg set as low as possible just to an extent which tolerates a density change, it is possible to remarkably reduce the toner consumption while suppressing a drop in image density to minimum.

Noting this, in this embodiment, in a range where the growth rate of the image density in response to the average developing bias Vavg is smaller than a predetermined value, a value as low as possible is used as the optimal value Vop. To be more specific, when a difference between the evaluation values A(n) and A(n+1) respectively expressing the densities of the patch images Ivn and Iv(n+1) formed with the average developing bias Vavg set to the two types of biases Vn and Vn+1 respectively is equal to or smaller than the predetermined value Δa, the lower developing bias, namely, the value Vn is set as the optimal value Vop. As for the value Δa, it is desirable that when there are two images on which evaluation values are different by Δa from each other, the value Δa is selected such that the density difference between the two will not be easily recognized with eyes or will be tolerable in the apparatus.

This prevents the average developing bias Vavg from being set to an unnecessarily high value although there is almost no increase in image density, thereby trading the image density off with the toner consumption.

The optimal value Vop of the average developing bias Vavg with which a predetermined solid image density will be obtained is thus set to any value which is within the range from the minimum value V0 to the maximum value V5. For improvement in image quality, this image forming apparatus ensures that a potential difference is always constant (325 V for instance) between the average developing bias Vavg and a surface potential in "non-scanning portion", or a portion within an electrostatic latent image on the photosensitive member 2 to which toner will not adhere in accordance with an image signal. As the optimal value Vop of the average developing bias Vavg is determined in the manner above, the charging bias applied upon the charger unit 3 by the charger controller 103, too, is changed in accordance with the optimal value Vop, whereby the potential difference mentioned above is maintained constant.

(E) Setting Exposure Energy

Figure 19:
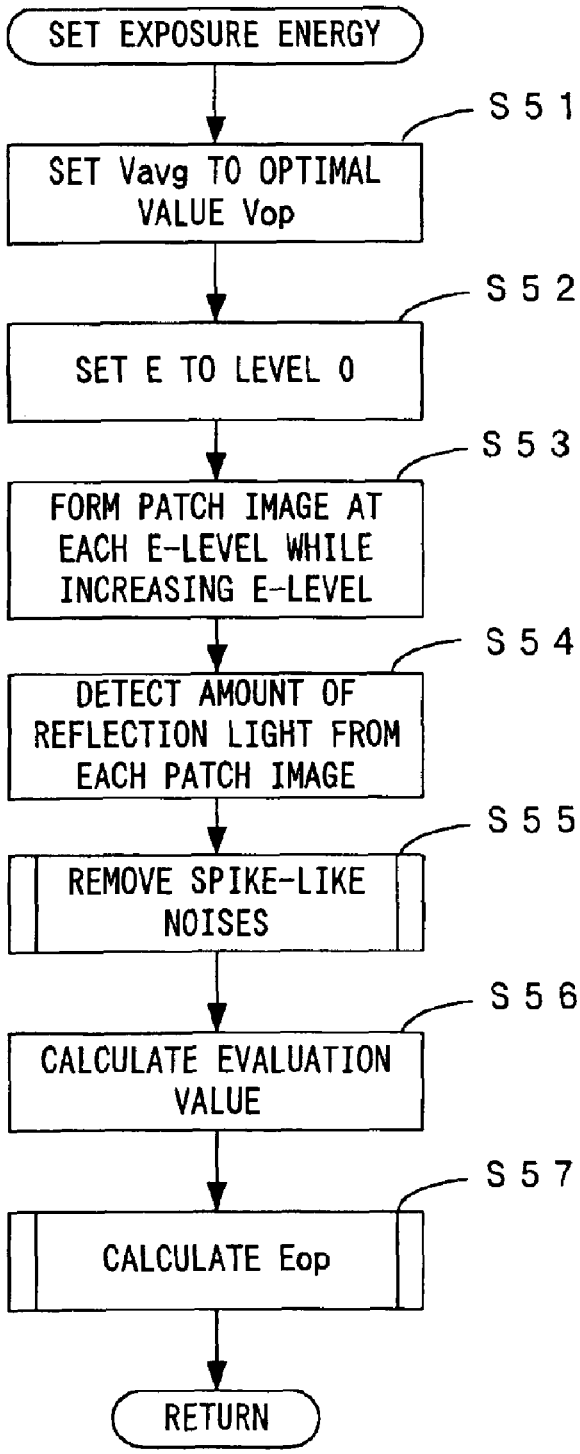
FIG. 19 is a flow chart which shows a process of setting an exposure energy in the first embodiment.

Following this, the exposure energy E is set to an optimal value. FIG. 19 is a flow chart which shows a process of setting the exposure energy in this embodiment. As shown in FIG. 19, the content of this process is basically the same as that of the developing bias setting process described earlier (FIG. 15). That is, first, the average developing bias Vavg is set to the optimal value Vop calculated earlier (Step S51), and while increasing the exposure energy E from the lowest level 0 by one level each time, a patch image is formed at each level (Step S52, Step S53). The sensor outputs Vp and Vs corresponding to the amount of reflection light from each patch image are sampled (Step S54), spike-like noises are removed from the sample data (Step S55), an evaluation value expressing a density of each patch image is calculated (Step S56), and the optimal value Eop of the exposure energy is calculated based on the result (Step S57).

During this process (FIG. 19), only differences from the developing bias setting process described earlier (FIG. 15) are patterns and the number of patch images to be formed and a calculation of the optimal value Eop of the exposure energy from evaluation values. The two processes are almost the same regarding the other aspects. These differences will now be described mainly.

In this image forming apparatus, while an electrostatic latent image corresponding to an image signal is formed as the surface of the photosensitive member 2 is exposed with the light beam L, in the case of a high-density image such as a solid image which has a relatively large area to be exposed, even when the exposure energy E is changed, a potential profile of the electrostatic latent image does not change very much. On the contrary, for instance, in a low-density image such as a line image and a halftone image in which areas to be exposed are scattered like spots on the surface of the photosensitive member 2, the potential profile of the image greatly changes depending on the exposure energy E. Such a change in potential profile leads to a change in density of a toner image. In other words, a change in exposure energy E does not affect a high-density image very much but largely affects a density of a low-density image.

Noting this, in this embodiment, first, a solid image is formed as a high-density patch image in which an image density is less influenced by the exposure energy E, and the optimal value of the average developing bias Vavg is calculated based on the density of the high-density patch image. Meanwhile, for calculation of the optimal value of the exposure energy E, a low-density patch image is formed. Hence, the exposure energy setting process uses a patch image having a different pattern from that of the patch image (FIG. 16) formed during the developing bias setting process.

While an influence of the exposure energy E over a high-density image is small, if a variable range of the exposure energy E is excessively wide, a density change of the high-density image increases. To prevent this, the variable range of the exposure energy E preferably ensures that a change in surface potential of an electrostatic latent image corresponding to a high-density image (which is a solid image for example) in response to a change in exposure energy from the minimum (level 0) to the maximum (level 3) is within 20 V, or more preferably, within 10 V.

Figure 20:
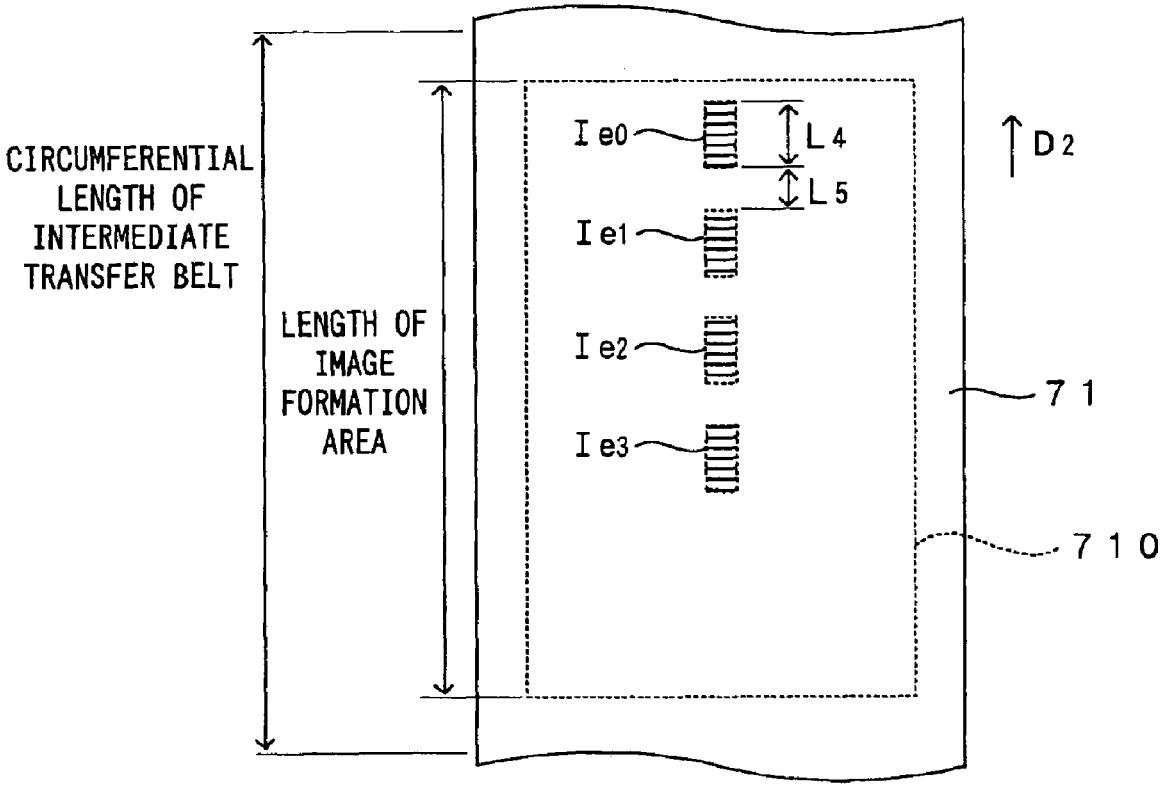
FIG. 20 is a drawing which shows a low-density patch image.

FIG. 20 is a drawing which shows a low-density patch image. As described earlier, this embodiment requires to change the exposure energy E over four stages. In this example, one patch image at each level and four patch images Ie0 through Ie3 in total are formed. A pattern of the patch images used in this example is formed by a plurality of thin lines which are isolated from each other as shown in FIG. 20. To be more specific, the pattern is a 1-dot line pattern that one line is ON and ten lines are OFF. Although a pattern of a low-density patch image is not limited to this, use of a pattern that lines or dots are isolated from each other allows to express a change in exposure energy E as a change in image density and more accurately calculate the optimal value of the exposure energy E.

Further, a length L4 of each patch image is smaller than the length L1 of the high-density patch images (FIG. 16). This is because a density variation will not appear at the cycles of rotation of the photosensitive member 2 during the exposure energy setting process since the average developing bias Vavg has already been set to the optimal value Vop. In other words, present Vop is not the optimal value of the average developing bias Vavg if such a density variation appears even in this condition. However, considering a possibility that there may be density variations associated with deformation of the developer roller 44, it is preferable an average value covering a length which corresponds to the circumferential length of the developer roller 44 is used as the density of the patch image. A circumferential length of the patch image is therefore set to be longer than the circumferential length of the developer roller 44. When moving velocities (circumferential speeds) of the surfaces of the photosensitive member 2 and the developer roller 44 are not the same in an apparatus of the non-contact developing type, considering the circumferential speeds, a patch image whose length corresponds to one round of the developer roller 44 may be formed on the photosensitive member 2.

Gaps L5 between the respective patch images may be narrower than the gaps L2 shown in FIG. 16. This is because it is possible to change an energy density of the light beam L from the exposure unit 6 in a relatively short period of time, and particularly when a light source of the light beam is formed by a semiconductor laser, it is possible to change the energy density of the light beam in an extremely period of time. Such a shape and arrangement of the respective patch images, as shown in FIG. 20, permits to form all of patch images Ie0 through Ie3 over one round of the intermediate transfer belt 71, and hence, to shorten a processing time.

Figure 21:
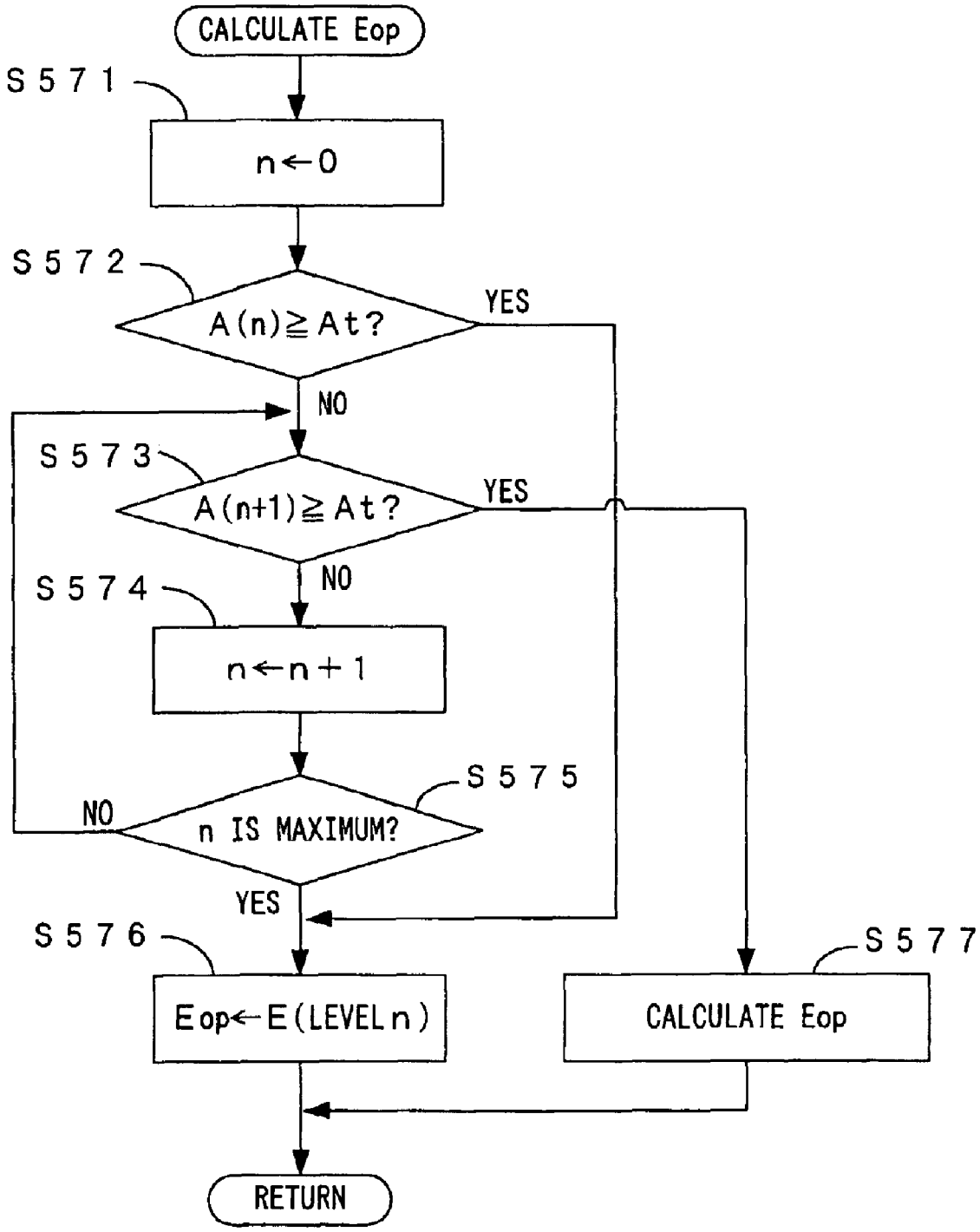
FIG. 21 is a flow chart which shows a process of calculating an optimal value of an exposure energy in the first embodiment.

As for thus formed low-density patch images Ie0 through Ie3, evaluation values expressing the densities of these images are calculated in a similar manner to that described earlier for the high-density patch images. Based on the evaluation values and control target values derived from the look-up table (FIG. 14B) for low-density patch images separately prepared from the look-up table for high-density patch images, the optimal value Eop of the exposure energy is calculated. FIG. 21 is a flow chart which shows a process of calculating the optimal value of the exposure energy in this embodiment. During this process as well, as in the process of calculating the optimal value of the direct current developing bias shown in FIG. 18, the evaluation value is compared with a target value At on the patch images starting from the one formed at a low energy level, and a value of the exposure energy E which makes the evaluation value match with the target value is then calculated, thereby determining the optimal value Eop (Step S571 through Step S577).

However, since within a range of the exposure energy E which is usually used, a saturation characteristic (FIG. 17B) found on the relationship between the solid image densities and the direct current developing bias will not be found on a relationship between the line image densities and the exposure energy E, a process corresponding to the step S473 shown in FIG. 18 is omitted. In this manner, the optimal value Eop of the exposure energy E with which a desired image density will be obtained is calculated.

(F) Post-Process

As the optimal values of the average developing bias Vavg and the exposure energy E are calculated in the manner above, it is now possible to form an image to have a desired image quality. Hence, the optimization of the density control factors may be terminated at this stage, or the apparatus may be made remain on standby after stopping the rotations of the intermediate transfer belt 71 and the like, or further alternatively, some adjustment may be implemented to control still other density control factors. The post-process may be any desired process, and therefore, will not be described here.

(G) Principles of Generation of Look-Up Tables

As described earlier, the image forming apparatus according to this embodiment refers to the look-up tables which may be as shown in FIGS. 14A and 14B in accordance with a state of use of the toner, and sets a control target value of a patch image density. The look-up tables are formed based on the following concept. Although the following will describe, as one example of a table, formation of a high-density patch image table for black toner whose characteristic is of the "type 0," namely, the table shown in FIG. 14A while referring to FIGS. 22 through 24, tables for other toner, low-density patch images and the like can be formed based on similar concept.

Figure 22:
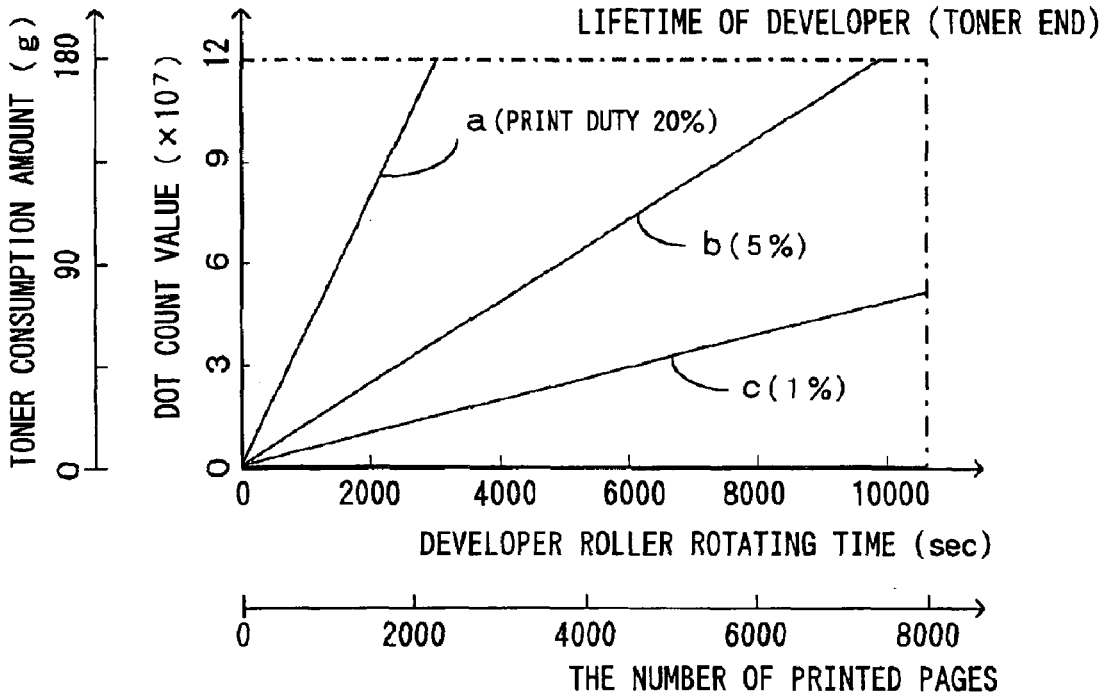
FIG. 22 is a drawing which shows a relationship between a developer roller rotating time and a dot count value during continuous formation of a plurality of images.
Figure 23:
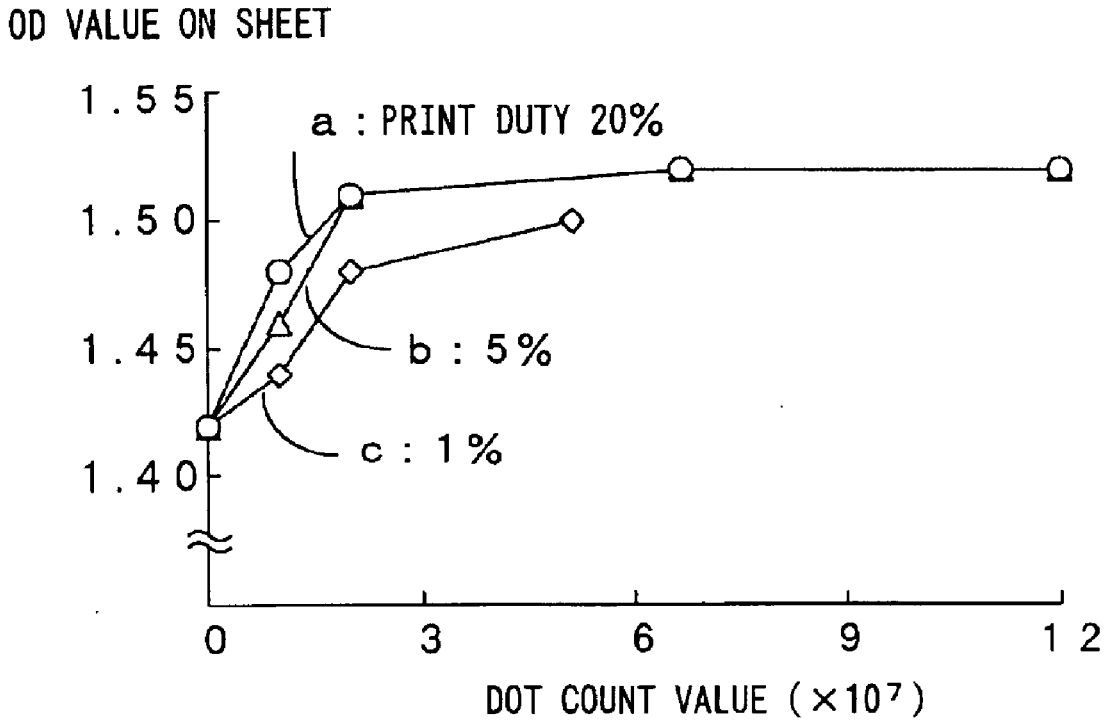
FIG. 23 is a graph which shows an example of measured changes of an OD value on a sheet with a control target value remaining constant.
Figure 24:
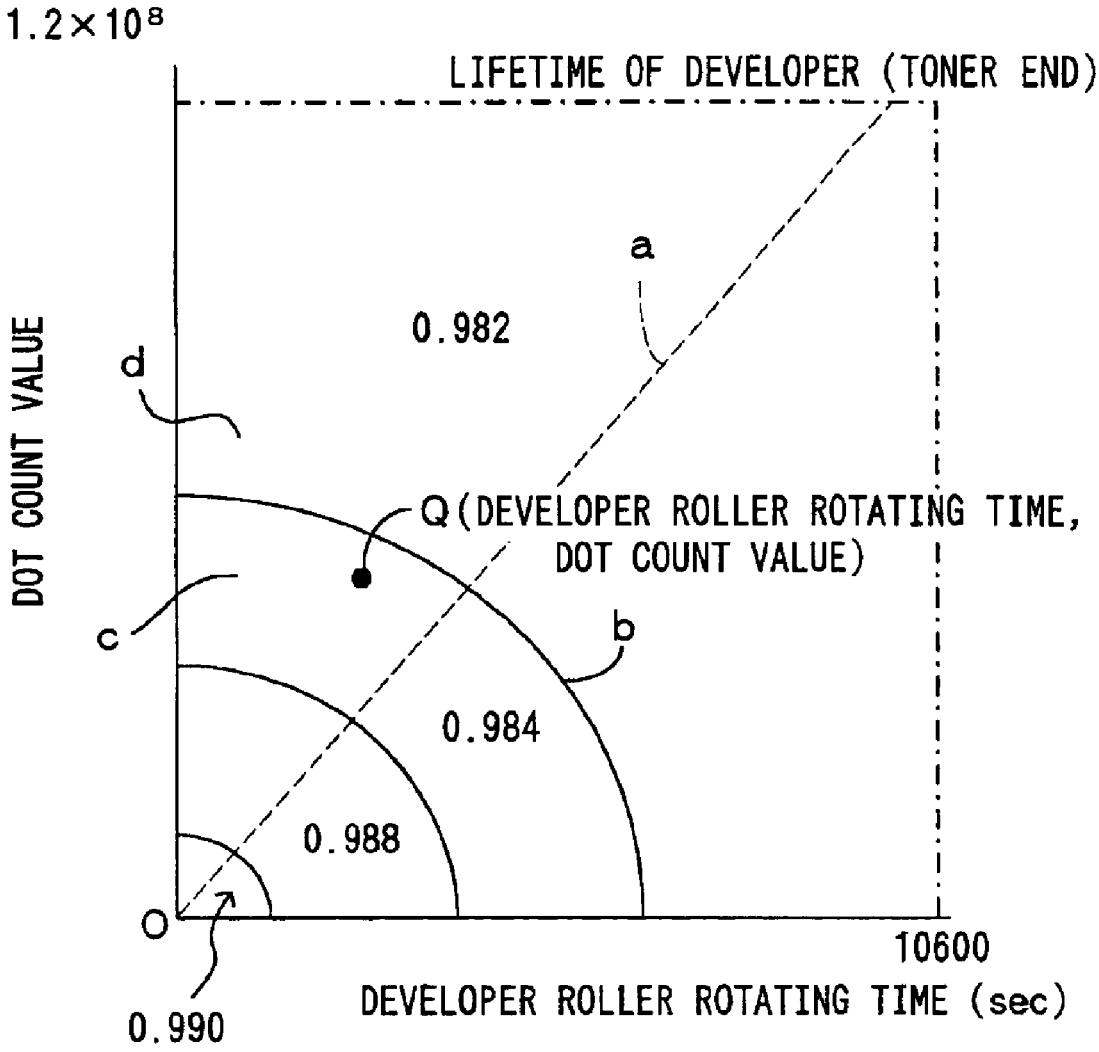
FIG. 24 is a drawing which shows an example of a preferable control target value corresponding to a change in toner characteristic.

FIG. 22 is a drawing which shows a relationship between a developer roller rotating time and a dot count value during continuous formation of a plurality of images, and FIG. 23 is a graph which shows an example of measured changes of an OD value on a sheet S with a control target value remaining constant. FIG. 24 is a drawing which shows an example of a preferable control target value corresponding to a change in toner characteristic.

As described earlier, in this image forming apparatus, a dot count value and a developer roller revolution number are integrated every time for every image formation. For instance, in the event that a plurality of images in which a print duty (a surface area ratio of a portion which actually bears toner to an image-bearing area which is equivalent to one image) is 5% are formed continuously, as denoted at the line b in FIG. 22, the dot count value and the developer roller rotating time increase as the number of printed pages increases. A print duty of 5% is generally believed to be a value which is close to a print duty of an image which represents a text document consisting only of characters and letters.

When images where large portions bear toner (e.g., images containing many filled portions and have a large print duty) are formed, more dots are formed even for the same developer roller rotating time, and hence, the gradient of the plotted dot count value increases as denoted at the line a in FIG. 22 for example. On the contrary, when the print duty is small, the gradient decreases as denoted at the line c in FIG. 22.

The developer roller rotating time expresses an approximate number of formed images (as they are converted into the number of A4-size papers) while the dot count value expresses an approximate toner consumption amount as shown in FIG. 22. However, when a large number of images are formed not continuously as described above but intermittently, rotations of the developer roller 44 which do not contribute to image formation take place before and after formation of the images, whereby the number of printed pages relative to the developer roller rotating time becomes a little smaller than that shown in FIG. 22. Further, since toner is consumed also because of splattering, fogging, etc., the correlation between the dot count value and the toner consumption amount may be somewhat different from that shown in FIG. 22. For these reasons, each linear line shown in FIG. 22 may not be always a linear line.

Hence, while it is necessary to consider such a deviation when more strict control of image densities is desired, the description here assumes that the relationship described above holds true for ease of understanding on the principle. In addition, although the toner consumption amount per dot count is 0.015 mg in FIG. 22, this numerical value includes an average toner consumption because of splattering, fogging, etc., in addition to toner transferred on a sheet S.

The dashed line in FIG. 22 denotes the lifetime of the developer, namely, the limitation of use of toner housed in the developer. In short, the toner consumption amount reaches approximately 180 g at the dot count of 12000000, which means that the toner has been almost entirely used up. As for the developer roller rotating time, an integrated value of 10600 seconds corresponds to 8000 A4-size pages of continuous printing, and further continuation of the image formation is not desirable considering an image quality. Noting this, according to this embodiment, when any one of these pieces of information reaches the value above, a message indicative of toner end is displayed in a display not shown to thereby encourage a user to exchange the developer. In addition, as clearly shown in FIG. 22, since the number of images which can be formed using one developer is different depending on a print duty, it is possible to control consumables more suitably in light of an actual state of the apparatus in the manner described above as compared to where the lifetime of each developer is controlled in accordance with the number of printed pages alone.

While maintaining the image forming conditions, namely, a combination of the image forming conditions constant, an experiment was conducted in which a large number of images are formed continuously at a constant print duty. On some of thus formed images, a relationship between an optical density (OD value) on a sheet S, the dot count value and the developer roller rotating time corresponding to an image having that optical density was identified. FIG. 23 shows the plotted relationship between the dot count value and the OD value on a sheet S. As shown in FIG. 23, the OD value is relatively low initially after the start of the experiment, whereas the OD value increases as the dot count value increases. Further, during this initial use, a density change is large in the area where the dot count value is small, and the density change decreases as the dot count value increases. Further, the larger the print duty becomes, more remarkably the density changes during the initial use.

Such a tendency is found similarly also when the developer roller rotating time and the OD value on a sheet S are plotted. Hence, to suppress such a density increase, an image density increase caused by an increase of the dot count value and an increase of the developer roller rotating time needs be eliminated, and it is therefore necessary to decrease the control target value of a patch image density in accordance with these values. In short, when an increase in image density could be beyond a tolerable range, the control target value is reduced, to thereby make it possible to suppress a density change to a predetermined range.

Noting this, a control target value which will maintain an image density approximately constant was calculated from combinations of the dot count value and the developer roller rotating time and measured image densities corresponding to the combinations, which is shown in FIG. 24. FIG. 24 denotes the following.

That is, a point Q expressing a combination of the developer roller rotating time and the dot count value gradually moves toward the top right-hand side from the initial use (the origin O in FIG. 24) of the developer, as images are formed. An amount of the movement varies depending on a print duty. When a print duty has a constant value of 5% for example, the point Q moves on the dotted line a. In general, while a print duty is not constant and the point Q therefore does not move along a linear line, the direction of the movement is always toward the top right-hand side. The point Q never moves toward the bottom side or the left-hand side.

For each one of the regions enclosed by the curves in FIG. 24, a control target value associated with an evaluation value of a high-density patch image is assigned. When the point Q moves beyond one curve in FIG. 24 to the next region as the toner is consumed more and the developer roller rotating time and the dot count value increase, the value assigned to this region becomes a new control target value. For instance, when the point Q moves beyond one curve b into the region d from the region c as the dot count value and the developer roller rotating time increase, the control target value is changed from 0.984 to 0.982.

Thus obtained curves between the respective regions in FIG. 24 serve as "isosbestic point curve" according to which the control target value is changed to thereby obtain constant image densities using this toner. These boundaries are approximated by a plurality of linear lines which are parallel to the vertical axis or the horizontal axis and accordingly simplified, and when converted in the form of a table, the resultant table becomes the look-up table shown in FIG. 14A.

Figure 25:
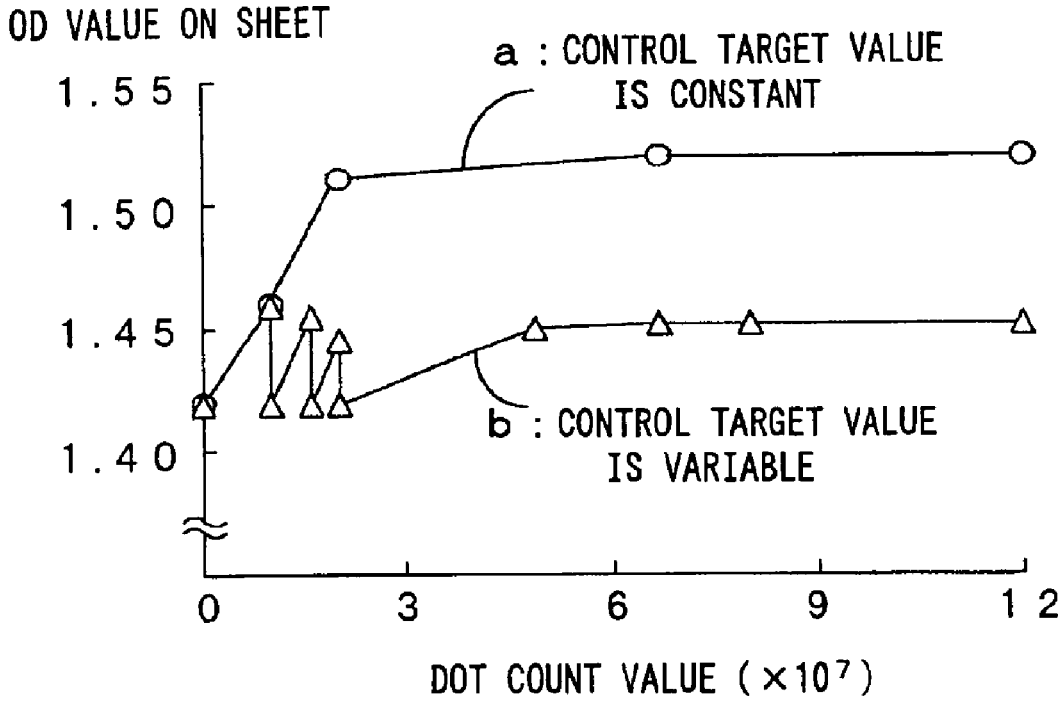
FIG. 25 is a graph which shows a result of actual measurement on image densities in a condition that the control target value is maintained constant and a condition that the control target value is changed in accordance with FIG. 14A.

As the control target value is reduced as the dot count value and the developer roller rotating time increase, whereby an increase in image density (FIG. 23) associated with a change in toner characteristic is cancelled and a toner image having a stable image density is formed. FIG. 25 is a graph which shows a result of actual measurement on image densities in a condition that the control target value is maintained constant and a condition that the control target value is changed in accordance with FIG. 14A. In the condition that the control target value is maintained constant, as denoted at the curve a in FIG. 25, the OD value on a sheet S increases together with an increase in dot count value, and the OD value eventually becomes largely different from the initial OD value. In contrast, when the control target value is variable and changed when needed, as denoted at the curve b, variations of the OD value are suppressed to be smaller. Thus, the effect of the present invention is apparent.

(III) Effect

As described above, in the image forming apparatus according to this embodiment, the density sensor 60 detect a density of a formed patch image, a condition which makes the density match with a control target value is found, and the direct current developing bias Vavg and the exposure energy E which serve as image forming conditions are optimized. At this stage, instead of maintaining the control target value constant, a target value suiting a state of the toner is determined based on information which is indicative of an operating state of the apparatus, namely, toner individuality information which is used as primary toner information and a dot count value and a developer roller rotating time which are used as secondary toner information. Hence, it is possible to form toner images which have an excellent image quality while always maintaining a constant image density regardless of a change in toner characteristics.

In addition, since toner individuality information is referred to at the time the control target value is set, it is possible to obtain the same image quality using toner having various different characteristics. This offers a user a higher degree of freedom in selecting toner, and is advantageous to a toner vender in terms of manufacturing cost since this moderates a requirement on variations in characteristics.

Further, since these pieces of information are stored in the memories disposed to the respective developers and the control target value is determined based on thus stored information, an operating condition suitable to characteristics of toner within the developers is always set. Hence, there is no problem that image densities become different between the different developers, an image density changes after attachment of the same developer to a different apparatus, etc.

Further, when a user wishes to increase or decrease an image density, a control target value is increased or decreased. Hence, optimization of image forming conditions based on thus increased or decreased control target value allows to obtain a stable image density.

(IV) Others

Although the density sensor 60 is disposed at an opposed position facing the surface of the intermediate transfer belt 71 and detects a density of a toner image primarily transferred as a patch image on the intermediate transfer belt 71 according to the embodiment described above, this is not limiting. For instance, the density sensor may be disposed at an opposed position facing a surface of a photosensitive member 2 and may detect a density of a toner image developed on the photosensitive member 2.

Further, while the density sensor 60 is formed by a reflective type photo-sensor which irradiates light toward the surface of the intermediate transfer belt 71 and detects an amount of light reflected by the surface according to the embodiment described above, instead of this, a light emitter element and a light receiver light of a density sensor may be disposed facing each other across an intermediate transfer belt for example and an amount of light transmitted by the intermediate transfer belt may be detected.

Further, although a solid image is used as a high-density patch image and an image formed by a plurality of 1-dot lines in which one line is ON and ten lines are OFF is used as a low-density patch image in the embodiment described above, the patterns of the respective patch images are not limited to these. Instead, halftone images having other patterns or the like may be used.

Further, although a control target value is determined based on toner individuality information which is "primary toner information" and a dot count value and a developer roller rotating time which are "secondary toner information" in the embodiment described above for instance, to make this simpler, a control target value may be determined based on one or two of these information. Alternatively, other information may be added further to determine a control target value.

Further, although a dot count value is used as a parameter which expresses a toner consumption amount in this embodiment, this is not limiting. For example, in an apparatus in which a sensor which senses a toner amount is disposed within a developer, a toner amount may be identified from an output from the sensor. A toner consumption amount may be calculated based on an image signal which is fed from an external apparatus.

Further, although a dot count value is set in accordance with a state of the apparatus as it is before forming a patch image in the embodiment described above, instead of this, a dot count value may be set in accordance with a state of the apparatus as it is after forming a patch image. In other words, an alternative is to acquire a state of the apparatus after forming a patch image, calculate a dot count value based on that acquisition result or predict in advance an amount of toner which could be consumed by formation of a patch image, presume a state of the apparatus after patch image formation based on the predicted amount and calculate a control target value.

Further, the procedure of the condition controlling process for the image forming conditions in the embodiment described above is one example, and other procedure may therefore be used. For instance, although the image forming operation and the condition controlling process for the image forming conditions are executed in the order of yellow, cyan, magenta and black in the embodiment described above, other order may be used.

Further, although the direct current developing bias and the exposure energy which serve as the image forming conditions for controlling an image density are variable in the embodiment described above, only one of the two may be made variable to control an image density. Alternatively, other image forming condition may be used instead. Further, the embodiment described above requires that the electrifying bias to follow the direct current developing bias, this is not limiting. Instead, the electrifying bias may be fixed or changed independently of the direct current developing bias.

Further, while the embodiment described above is directed to an image forming apparatus comprising the intermediate transfer belt 71 which serves as a transfer member for temporarily carrying a toner image which has been developed on the photosensitive member 2, the present invention is applicable also to an image forming apparatus comprising other transfer member such as a transfer drum and a transfer roller, an image forming apparatus comprising in which no transfer member is disposed and a toner formed on the photosensitive member 2 is transferred directly onto a sheet S which is a final transfer member, etc.

Further, while the embodiment described above is directed to an image forming apparatus which is capable of forming a full-color image using the four colors of yellow, magenta, cyan and black, the toner colors to be used and the number of the toner colors are not limited to the above but may be freely determined. The present invention is applicable also to an apparatus which uses only black toner to form a monochrome image.

Further, although the embodiment described above is an application of the present invention to a printer which executes the image forming operation based on an image signal from outside the apparatus, it is needless to mention that the present invention is applicable also to a copier machine which forms an image signal within the apparatus in response to pressing of a copy button for example and executes the image forming operation based on this image signal, to a facsimile machine which executes the image forming operation based on an image signal which is fed on a communications line, and the like.

<Second Embodiment>

A. Structure of Apparatus

Figure 26:
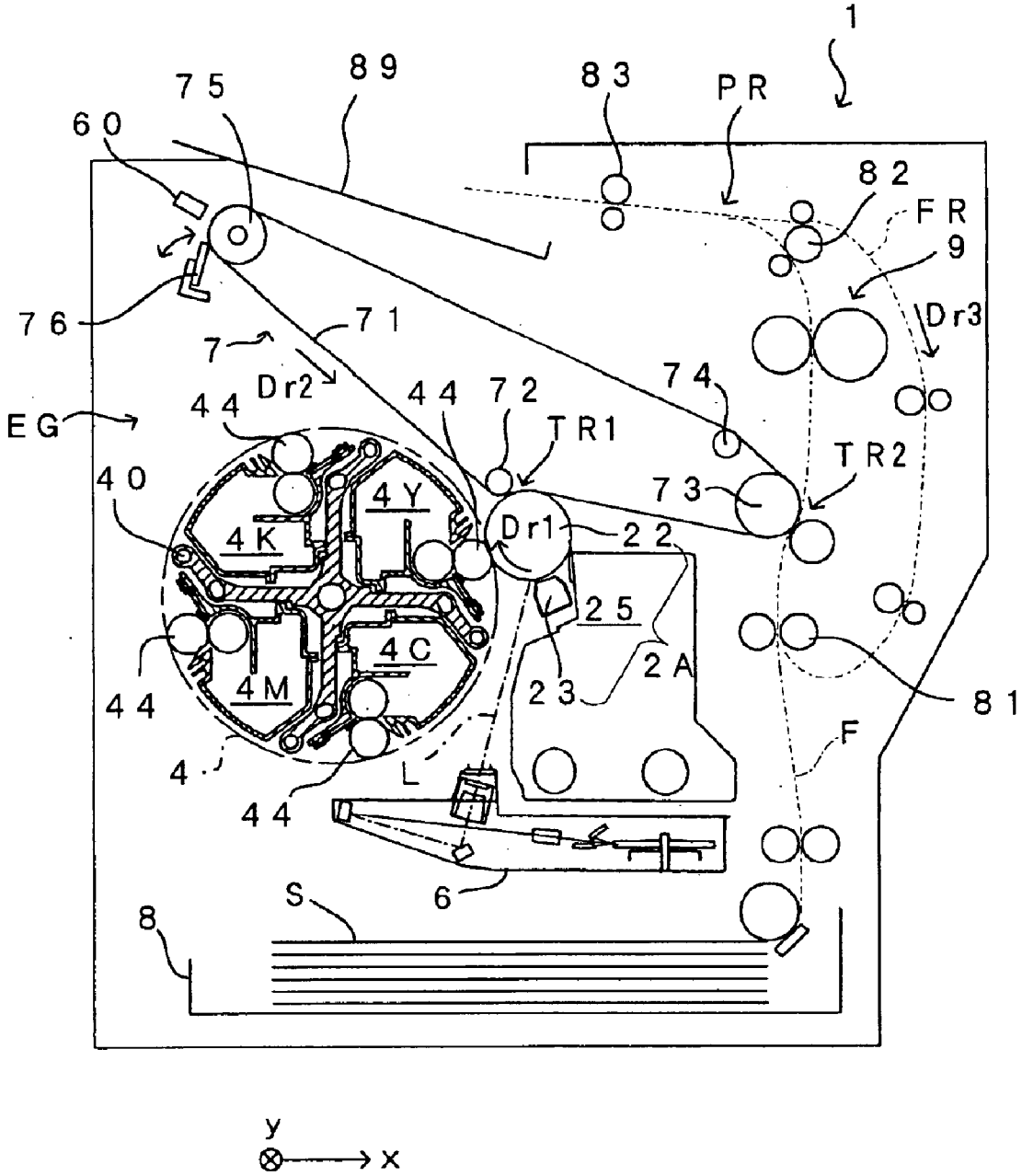
FIG. 26 is a drawing of a second embodiment of an image forming apparatus according to the present invention.
Figure 27:
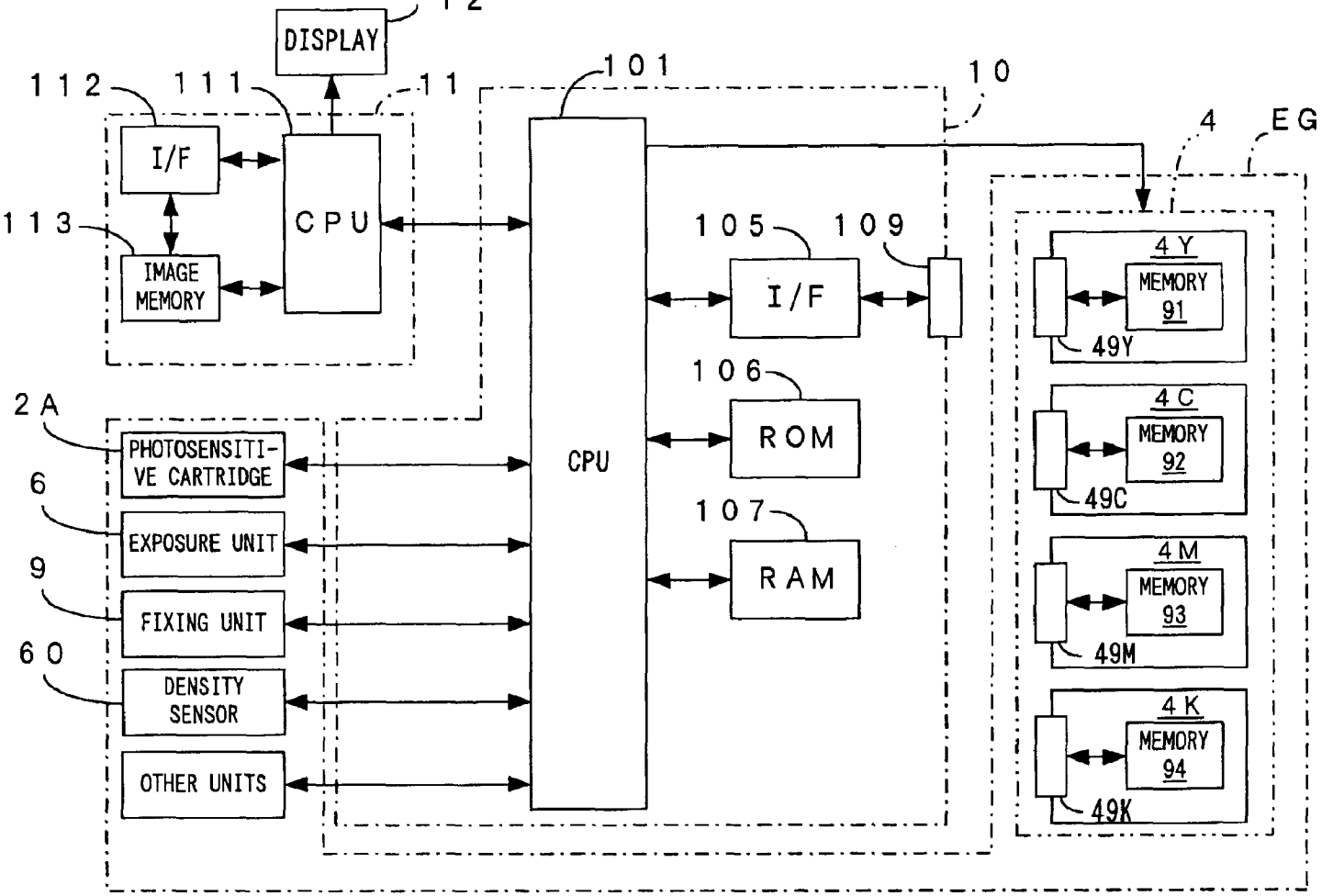
FIG. 27 is a block diagram of an electric structure of the image forming apparatus which is shown in FIG. 26.

FIG. 26 is a drawing of a second embodiment of an image forming apparatus according to the present invention. FIG. 27 is a block diagram of an electric structure of the image forming apparatus which is shown in FIG. 26. The apparatus 1 is largely different from the first embodiment with respect to the following two points but is otherwise the same in terms of structure. That is, the first difference is that a photosensitive member 22, a charger unit 23 and a cleaner 25 are integrated into one photosensitive cartridge 2A in this embodiment. The photosensitive cartridge 2A can be freely attached to and detached from the main body of the apparatus 1.

The second difference is that images can be formed on the both surfaces of a sheet S. To be specific, a gate roller 81 is disposed in front of the secondary transfer region TR2 on a feeding path F, and as the gate roller 81 rotates in accordance with the timing of rotations of the intermediate transfer belt 71, a sheet S is fed into the secondary transfer region TR2 at the predetermined timing.

Where an image is formed on the other side of the sheet S, on the other hand, the rotation of a discharge roller 83 is reversed at the point of time when a trailing end of the sheet S thus formed with the image on one side thereof is brought to a reverse position PR downstream from the pre-discharge roller 82. Thus, the sheet S is transported along a reversal feeding path FR in a direction of an arrow Dr3. Then again, the sheet S is guided into the feeding path F via place upstream from a gate roller 81. In this step, the sheet S in the secondary transfer region TR2 contacts the intermediate transfer belt 71 on the opposite side from that previously formed with the image so that an image is transferred to the other side of the sheet. In this manner, the images are formed on the both sides of the sheet S.

Figure 28:
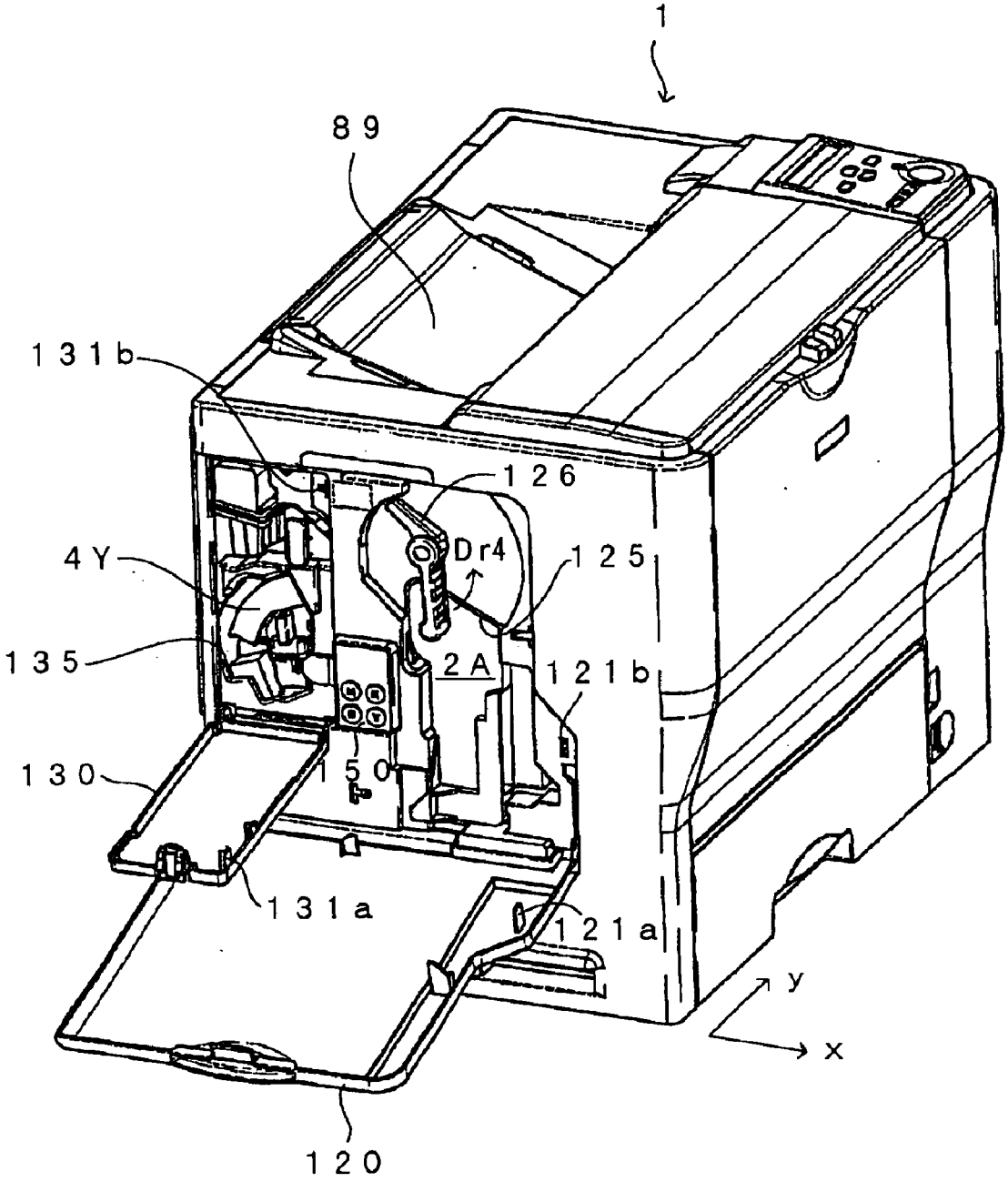
FIG. 28 is an appearance perspective view of the image forming apparatus which is shown in FIG. 26.

FIG. 28 is an appearance perspective view of the image forming apparatus which is shown in FIG. 26. As described above, in the image forming apparatus 1, the respective developers 4Y, . . . are freely attachable to and detachable from the support frame 40, and the photosensitive cartridge 2A is freely attachable to and detachable from the main body of the apparatus 1. As shown in FIG. 28, an outer cover 120 which can be freely opened and closed is disposed to a side surface of the main body of the apparatus 1. When a user opens the outer cover 120, a side surface portion of the photosensitive cartridge 2A is exposed through a photosensitive member opening 125 which is disposed to the main body of the apparatus. For unlocking, a lock lever 126 for fixing the photosensitive cartridge 2A is revolved in the arrow direction Dr4. The photosensitive member 22 can now be pulled out in the direction of a (−y)-axis shown in FIG. 28. Further, with the photosensitive cartridge 2A inserted through the photosensitive member opening 125 in the direction of a y-axis shown in FIG. 28, it is possible to mount a new photosensitive cartridge 2A. Using the lock lever 126, the photosensitive cartridge 2A is then fixed.

In addition, a developer opening 135 for attaching and detaching a developer cartridge is disposed to the main body of the apparatus. There is an inner cover 130 which can be freely opened and closed in such a manner that the inner cover 130 covers the developer opening 135. The inner cover 130 is located on the inner side to the outer cover 120. In other words, since the outer cover 120 covers even the developer opening 135, in a condition that the outer cover 120 is close, it is not possible to open the inner cover 130. On the other hand, unless the inner cover 130 is close, it is not possible to close the outer cover 120. If the developer unit 4 is remaining still at a predetermined attaching/detaching position (described later) upon opening of the inner cover 130 by a user, one of the mounted developers can be unloaded through the developer opening 135. It is also possible to mount one developer through the developer opening 135.

The outer cover 120 comprises a projection 121*a*, and there is a hole 121*b* disposed to the main body at a position which corresponds to the projection 121*a*. The inner cover 130 comprises a similar mechanism. In short, there is a projection 131*a* disposed to the inner cover 130, and there is a hole 131*b* disposed to the main body at a position which corresponds to the projection 131*a*. Behind the holes 121*a*, 131*a* and the developer opening 135, there are limit switches not shown.

Owing to this, in the image forming apparatus 1, it is possible to learn whether each one of the outer cover 120 and the inner cover 130 is open or close from a state of a point of contact in each limit switch, and further, it is possible to learn whether the photosensitive cartridge 2A has been mounted. The apparatus executes the image forming operation only when both the outer cover 120 and the inner cover 130 are close and the photosensitive cartridge 2A has been mounted.

B. General Description of the Timing of Executing Condition Controlling Process

An image forming apparatus having such a structure described above executes the condition controlling process in accordance with the following control start conditions:

(a) immediately after turning on of the apparatus;

(b) after a long period of time from the immediately precedent condition controlling process;

(c) when for each developer, a dot count of dots formed with the exposure beam L on the photosensitive member 22 and a rotating time of the developer roller 44 have been counted and these counts have reached a predetermined threshold value;

(d) at the time of exchanging of any one of the developers; and (e) at the time of mounting of a new photosensitive member 22.

The apparatus may execute the condition controlling process immediately after exchange of the developer. However, considering technical issues which will be described later, it is desirable to execute the condition controlling process only when a further prescribed condition is met in addition to the developer exchange condition (d). Noting this, according to this embodiment, the condition controlling process is executed:

(d-1) when the developer has been exchanged and the detached developer is of a different type from the attached developer; and (d-2) after a predetermined period of time from the preceding condition controlling process even when the detached developer is the same as the attached developer.

In a similar fashion to a determination on the developer, upon exchange of the photosensitive member 22, whether the attached photosensitive member is the same one as the detached photosensitive member may be determined and the timing of executing the condition controlling process may be determined in accordance with whether the detached one is the same one as the detached one.

Of the control start conditions described above, each one of the conditions (c), (d) and (e) will now be described in detail.

C. Control Start Condition (c)

In this type of the image forming apparatus, a change with time of an image density is not uniform. Rather, the extent of a density change is different depending on an operating state of the apparatus. Hence, it may be sometimes impossible to obtain a stable image density only with an adjustment of an image forming condition, such as a developing bias, at certain time intervals or for every certain number of pages. In short, an image density may substantially change because of a re-adjustment of an image forming condition, or an adjustment of an image forming condition (condition controlling process) may make a density of a pre-adjustment image greatly different from that of a post-adjustment image.

In addition, while an image density gradually changes in accordance with an increase in the number of printed pages, not only the number of printed pages but the contents of these images influence the width of the change. For instance, between images which have relatively high densities because of many filled areas, a great number of characters and letters used and the like and images which contain thin lines or only a small number of characters and letters and have a relatively low density, the amount of toner used becomes quite different even when the same number of these images are formed. Hence, a change with time of an image density, too, changes to a different extent.

Noting this, according to this embodiment, an image forming condition is optimized (condition controlling process) based on information which is indicative of a state of toner within the developer. That is, a state of toner which changes with time within the developer can be grasped with reference to the toner state information which is updated when needed. When the toner state information comes to satisfy a predetermined the image forming condition, namely, the control start condition (c), the image forming condition is optimized (condition controlling process), which permits to adjust the image forming condition at appropriate timing which considers a state of toner within the developer. As a result, the image forming apparatus is thus capable of stably forming images which have an excellent quality. This will now be described in detail with reference to relevant drawings.

Figure 29:
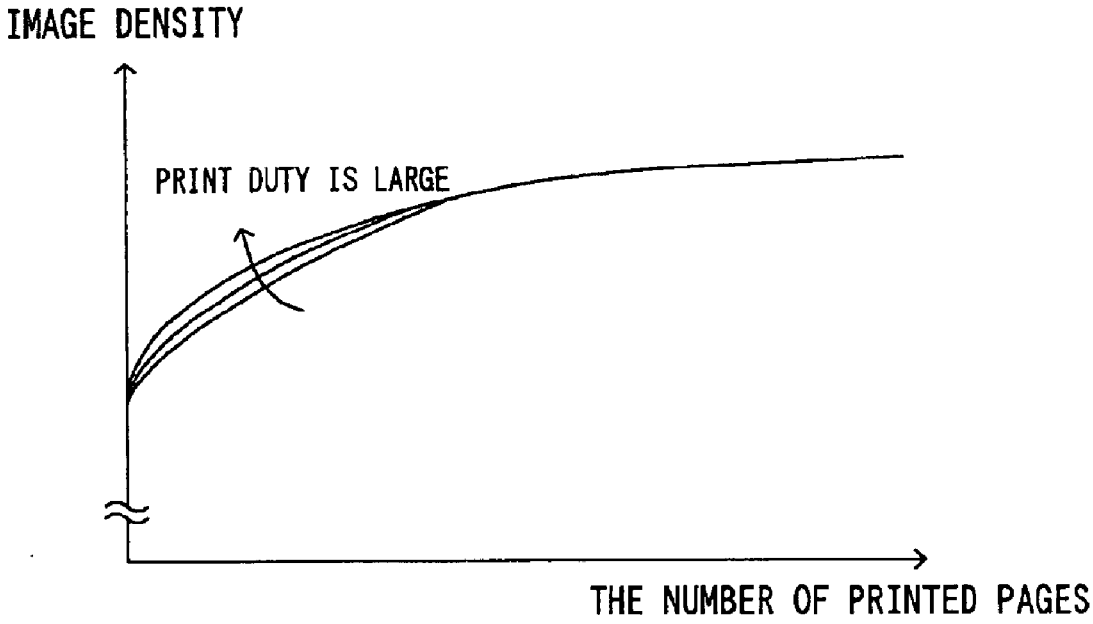
FIG. 29 is a drawing which shows an example of an image density change in response to the number of printed pages.
Figure 30:
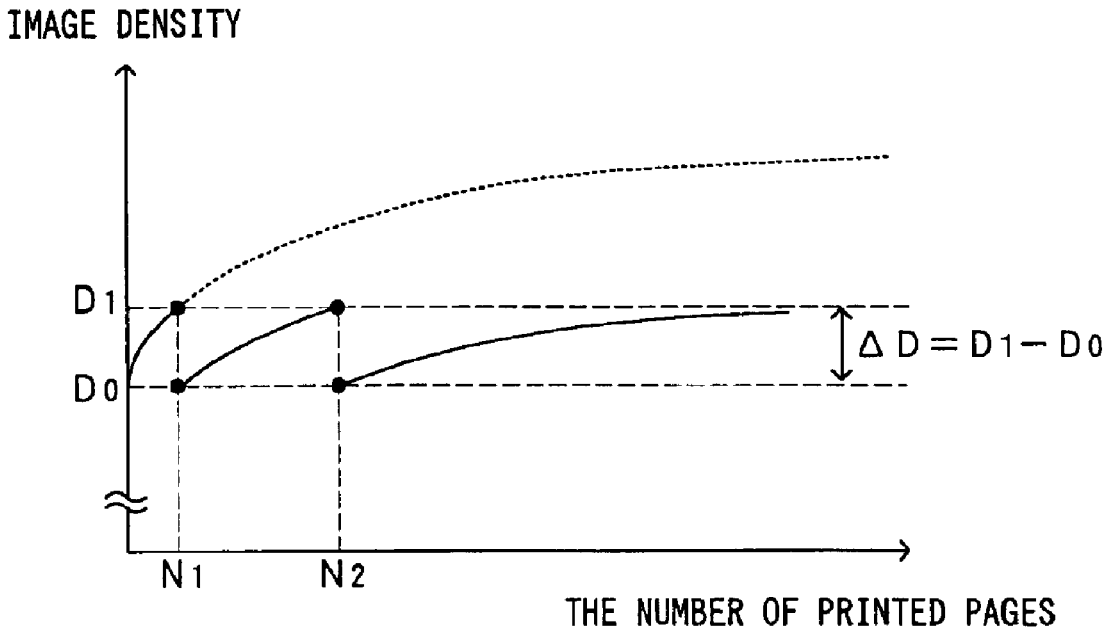
FIG. 30 is a drawing which shows the principles of setting the timing of execution of a condition controlling process.
Figure 31:
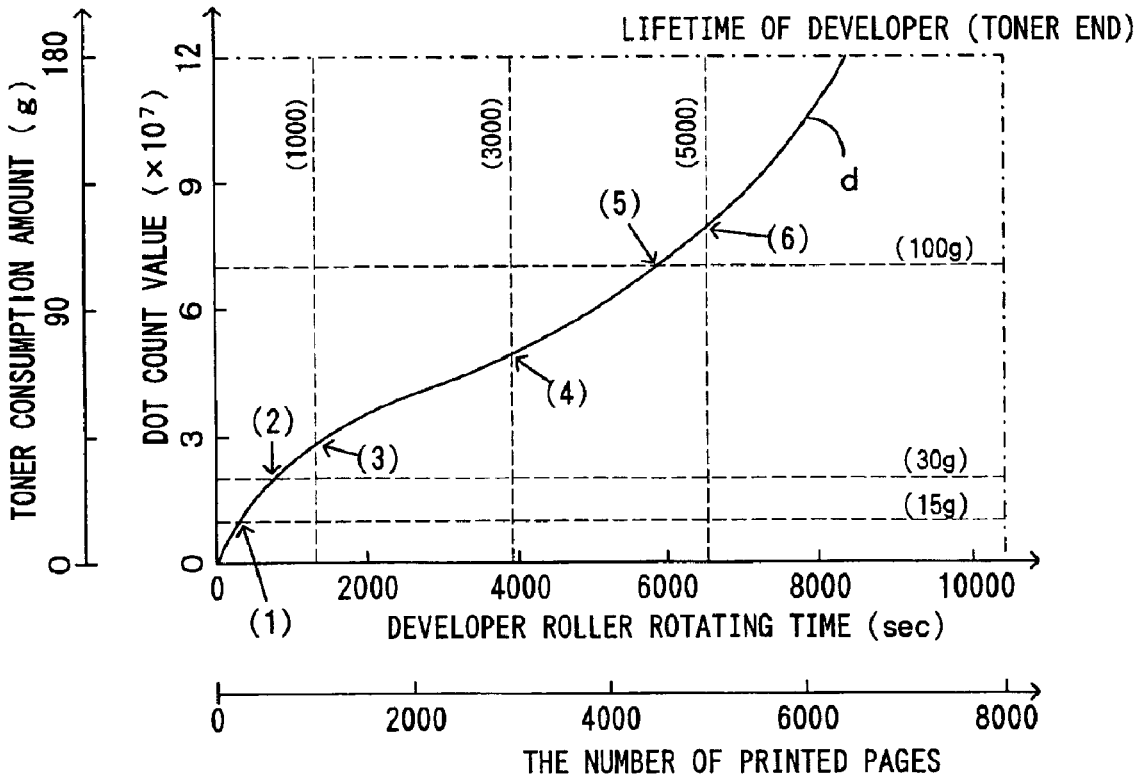
FIG. 31 is a drawing which shows the timing of executing the condition controlling process.

FIG. 29 is a drawing which shows an example of an image density change in response to the number of printed pages, and FIG. 30 is a drawing which shows the principles of setting timing of execution of a condition controlling process. FIG. 31 is a drawing which shows the timing of executing the condition controlling process.

In this type of the image forming apparatus, as a large number of images are formed while an image forming condition remains constant, an image density gradually changes in accordance with an increase in the number of printed pages. One of causes of such a density change is considered to be the following. That is, toner housed within the developer, although desired to have uniform characteristics in terms of particle diameter, electrification characteristic, etc., exhibits uneven characteristics to a certain extent in reality. The toner contains toner particles of varying particle diameters and electrification characteristics. When an image is formed using such uneven toner, selective consumption of toner occurs which is a phenomenon that toner particles exhibiting a particular characteristic alone are consumed quicker, whereas other toner particles remain not consumed that much in the developer. In consequence, a condition of a toner characteristic distribution within the developer changes as more images are formed, together with which an image density changes.

A typical example will now be discussed in which an image density increases as more images are formed as shown in FIG. 29. As shown in FIG. 29, in the case of an ordinary image forming apparatus, as for a relationship between the number of printed pages and an image density, an image density change is large at an initial stage (while the number of printed pages is small) but gradually decreases as the number of printed pages increases in general.

Further, as a print duty, namely, an area size ratio of a portion which actually seats toner to a region which corresponds to one image becomes larger, a density variation at the initial stage becomes more remarkable. This is thought to be because of a fact that a toner consumption amount increases as a print duty becomes large even when the number of printed pages remains the same and that a toner characteristic within the developer changes more rapidly.

In such an image forming apparatus, for the purpose of suppressing a change in image density, it is necessary to newly execute the condition controlling process before an image density change increases beyond a tolerable range and to thereby re-adjust an image forming condition to an optimal state. For instance, in an apparatus in which an initial image density is a density D0 as shown in FIG. 30, but for a re-adjustment of an image forming condition, an image density gradually increases as denoted at the curve. However, when an image forming condition is re-adjusted before an image density rises up to an upper limit density D1 in a tolerable range ΔD, the image density returns back to the initial density D0. In the example shown in FIG. 30, as the image forming condition is readjusted when or before the number of printed pages reaches counts N1 and N2 at which the image density becomes the upper limit density D1, an image density change can be suppressed within the tolerable range ΔD.

By the way, while the foregoing has described the relationship between the number of printed pages and an image density, more strictly speaking, the relationship holds true only when a print duty remains constant. In an actual image forming apparatus, a print duty becomes different every time an image is formed, and therefore, it is not desirable to determine the timing for optimization of an image forming condition only based on the number of printed pages.

FIG. 22 shows how a developer roller rotating time relates to a dot count value of dots formed with the exposure beam L. Since a developer roller rotating time corresponds to the total length of formed images, the developer roller rotating time is believed to generally represent the number of printed pages. In addition, when a toner adhesion amount per dot is approximately constant, the dot count value is thought to generally represent a toner consumption amount. For example, when a print duty constantly remains at 5% (which is an average print duty of a document consisting only of characters and letters), the number of printed pages is approximately in proportion to a toner consumption amount (the line b). When the print duty is larger than this, e.g., 20%, the gradient of the line increases (the line a). On the contrary, when the print duty is smaller, e.g., 1%, the gradient of the line decreases (the line c).

Since images commanding various print duties are formed during an actual image forming operation, a path of points representing combinations of a developer roller rotating time and a dot count value is not necessarily a linear line as those described above but more generally is a curve which runs over a complex path from the origin toward the top right-hand side. These values are integrated values, and hence, the curve never runs toward below or the left-hand side. However, when an image signal represents a plain image (in which nothing is printed) or when an image which does not use any one of the toner colors at all, for this toner color, a dot count value does not increase and a developer roller rotating time alone is added. The path therefore in this instance is a linear line which is parallel to the horizontal axis.

Further, when a number of images commanding particularly small print duties are formed, fatigue of toner within the developer becomes a problem. In other words, as described earlier, electrified toner failed to be used for image formation is collected back into the developer, peeled off from the developer roller 44 and supplied again for image formation. Hence, as for images commanding small print duties, an amount of toner which fails to be used and is then collected is large, the toner is repeatedly electrified and peeled off, fatigue of the toner occurs, and the characteristic of the toner gradually changes. As the characteristic of the toner changes in this fashion therefore, even when image formation is performed under the same conditions, an image density gradually changes.

The amount of toner within the developer and a characteristic of the toner change largely in shorter cycles as compared to changes with time of other characteristics of the apparatus such as a friction-induced change in characteristic of the photosensitive member 22 for instance. Thus created change in toner characteristic is one of major causes of a change with time in image density in the image forming apparatus.

As clearly described above, the timing of executing optimization of an image forming condition (condition controlling process) is extremely important, so as to maintain an image density approximately constant. Further, this timing should be determined in accordance with a state of toner which remains within the developer. However, it is difficult to accurately grasp a state of toner only based on the number of printed pages or a toner consumption amount (or a remaining toner amount). It is therefore necessary to determine the timing of executing the condition controlling process based on information which more correctly reflects the state of toner. In a conventional image forming apparatus, the timing of the condition controlling process is not necessarily appropriate, which in turn sometimes leads to problems that an image density changes largely, the toner is wasted greatly, etc.

Noting this, according to this embodiment, the condition controlling process is executed based on a dot count, which serves as a parameter of toner consumption, of dots formed with the exposure beam L and a rotating time of the developer roller 44 which serves as a parameter of toner fatigue. In short, for image formation, a dot count and a rotating time are measured and stored in the RAM 107, and the condition controlling process described below is executed when the CPU 101 determines that any one of these values reaches a predetermined threshold. That is, with the number of dots counted, an approximate remaining toner amount is grasped. Further, the extent of toner fatigue is grasped based on a relationship between a remaining toner amount and a developer roller rotating time. As the timing of executing the condition controlling process is set based on a combination of these, the condition controlling process can be executed at appropriate timing which considers a state of toner.

To be more specific, as denoted at the dotted lines in FIG. 31, more than one threshold values are determined in advance for each one of a developer roller rotating time and a dot count value. The time at which any one of these integrated values reaches each predetermined threshold is determined as the "control start condition (c)," and the condition controlling process is executed when this condition is satisfied. In this embodiment, the threshold values are as follows: 1325 seconds, 3975 seconds and 6625 seconds for a developer roller rotating time; and 1000000, 2000000 and 6666666 for a dot count value.

Of these, the threshold values of the developer roller rotating time correspond respectively to 1000 pages, 3000 pages and 5000 pages of images on A4-size papers during continuous printing. However, as described above, since the developer roller rotating time more accurately represent a state of toner within the developer, the timing of executing the condition controlling process is controlled based on the developer roller rotating time instead of the number of printed pages. In this manner, the condition controlling process is executed at appropriate timing which better suits a state of toner.

In addition, average toner consumption per dot is about 0.015 mg in this image forming apparatus. In other words, the threshold values of the dot count value mentioned above are determined to so as correspond to toner consumption amounts of 15 g, 30 g and 100 g. Included in these values are toner which is used for formation of toner images and also an amount of toner which is wasted because of splattering, fogging, etc.

As shown in FIG. 29, a variation in image density is large during an initial use of the developer but decreases gradually. The threshold values are apart from each other by small notches while the developer roller rotating time or the dot count value remains small, but become apart from each other by large notches as these values increase, as shown in FIG. 31. In other words, the condition controlling process is executed relatively frequently while a density change is large during an initial use of the developer, but is executed less frequently as a density change becomes small. As the notches for the threshold values which serve as the start condition for the condition controlling process is changed in accordance with the extent of image density variation, the condition controlling process is executed at more appropriate timing, thereby stabilizing an image density and reducing wasted toner.

Further, when a remaining toner amount becomes extremely small or when characteristics of the toner deteriorate extremely, an image quality rapidly deteriorates. Noting this, according to this embodiment, the CPU 101 determines that the developer has come to the end of its life when the dot count value has reached a value 120000000 which corresponds to a toner consumption amount of 180 g or the developer roller rotating time has reached 10600 seconds which corresponds to 8000 pages, and a message indicative of the toner end appears on a display not shown to thereby encourage a user to exchange the developer.

The information which expresses a state of toner, i.e., the developer roller rotating time or the dot count value which serves as "toner state information" of the present invention is stored in the RAM 107 disposed to the engine controller 10 for each developer, and updated or read as needed when accessed by the CPU 101. In short, the RAM 107 functions as "memory means" of the present invention in this embodiment.

In addition, for exchange of the developer, these pieces of information are written in the memories 91 through 94 which are disposed to the developers 4Y, 4C, 4M and 4K before removing the developer, and these pieces of information stored in the memories are read out as a new developer is attached. In this fashion, it is possible to properly control the history of use of this developer even when the developer is re-attached after removed once or attached to other apparatus.

In an example that a combination of a developer roller rotating time and a dot count value changes as denoted at the curve d in FIG. 31 for instance, this image forming apparatus executes the condition controlling process at the timing (1) through the timing (6) which correspond to the intersections of the respective dotted lines representing the threshold values and the curve d, because of the structure described above. Hence, it is possible to execute the condition controlling process at appropriate timing in accordance with a change of a state of toner within the developer.

Figure 32:
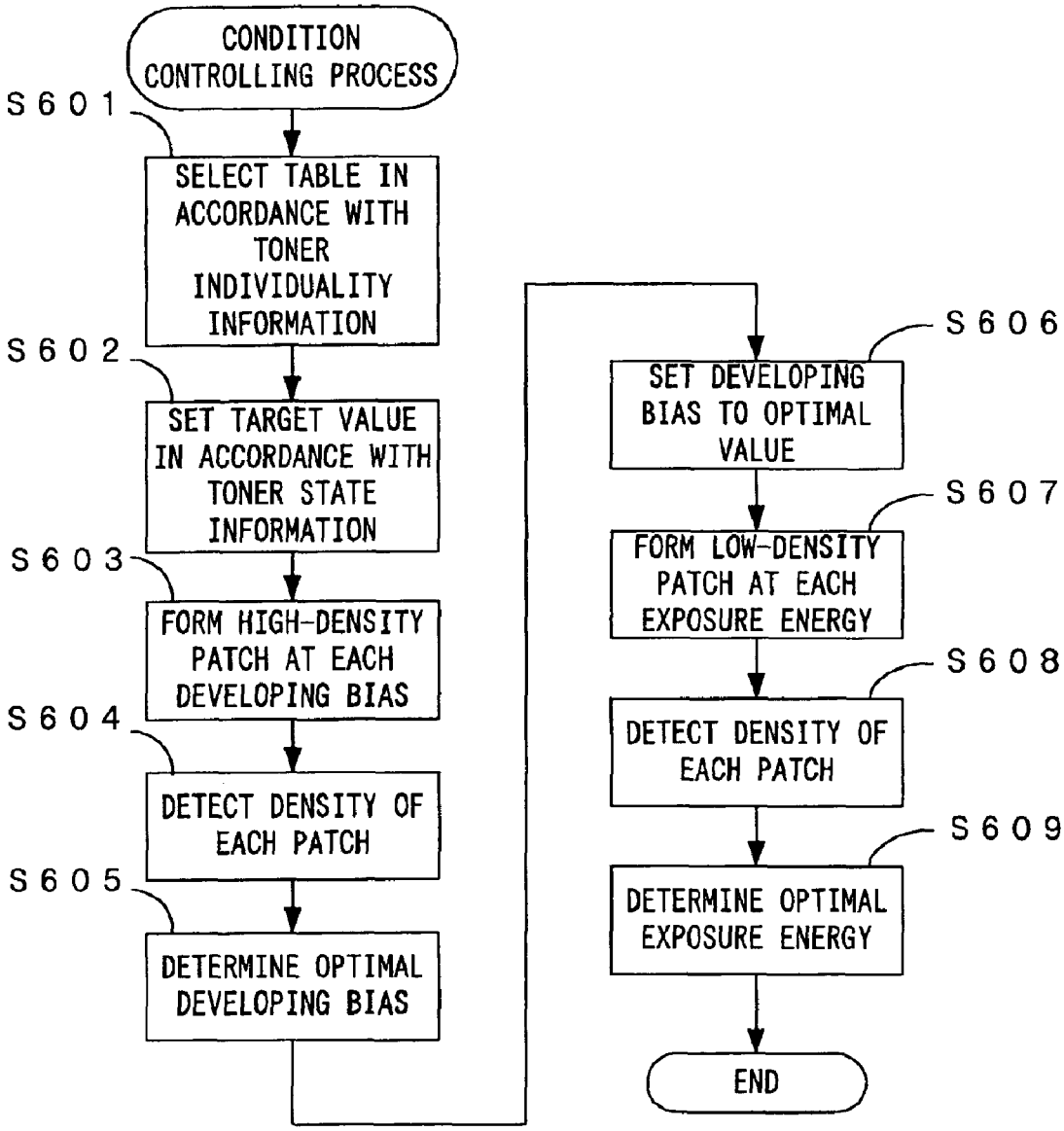
FIG. 32 is a flow chart which shows the condition controlling process according to this preferred embodiment.

FIG. 32 is a flow chart which shows the condition controlling process according to this preferred embodiment. FIGS. 33A and 33B are drawings which show an example of look-up tables which are referred to during the process which is shown in FIG. 32. An operation during the condition controlling process which is executed at such timing as above will now be described with reference to FIGS. 32, 33A and 33B. During the condition controlling process, a density target value of a patch image is set for each toner color in accordance with characteristics of toner which remains within the developer, a patch image is formed, a density of the patch image is detected, and an image forming condition is optimized based on the result of the detection and thus set density target value. While the following discusses an example on the condition controlling process for the black toner color, similar processes are performed for the other toner colors.

Considering that various characteristics of toner within the developer, such as a diameter particle and an electrification characteristic, are subtly different from each other between the individual developers due to variations arising during manufacturing of the toner, this image forming apparatus requires to measure initial characteristics of the toner at the manufacturing stage, classify the initial characteristics into a few types and assign these types to the respective developers. Information which represents which type toner introduced into the developer has will be referred to as "toner individuality information." The toner characteristic may be different between different toner manufactured to the same specifications using different manufacturing machines and of course between toner contained in different batches even when the same manufacturing machine was used.

The toner individuality information is written in the memory 94 of the developer 4K upon introduction of the toner into the developer. As the developer 4K is mounted to the developer unit 4, the CPU 101 of the engine controller 10 reads this information out, thereby making it possible to grasp the initial characteristics of the toner. Operation conditions for the respective portions of the apparatus are set in accordance with the initial characteristics, which allows to stably form images which have even better image qualities regardless of the variations created during manufacturing of the toner. In this embodiment, the memories 91 through 94 thus function as a "memory element" of the present invention.

To be more specific, in this image forming apparatus, as expressed by the example shown in FIGS. 33A and 33B, the ROM 106 comprises look-up tables which are for setting a density target value of a patch image in accordance with a developer roller rotating time and a dot count value. Further, as this type of table is prepared for each toner type and one of the tables is selected based on toner individuality information, a density target value suiting a toner type is set. FIG. 33A shows density target values of a high-density patch image described later which are determined for the black toner which corresponds to a "type 0," while FIG. 33B shows density target values of a low-density patch image described later which are determined for the same toner. These density target values are values which are normalized so that a maximum density for the chosen toner color will be 1.

The reason of changing a density target value of a patch image depending on a developer roller rotating time and a dot count value is as follows. As described later, a density of a toner image which serves as a patch image is measured in a condition that the image is carried on the intermediate transfer belt 71. Hence, a density of a toner image thus measured slightly deviates from a density of an image which has been finally transferred on a sheet S. As a particle diameter distribution of the toner within the developer 4K changes with time in accordance with selective consumption of the toner, particle diameters of the toner which form a toner image also change. Hence, an amount of the deviation above changes in accordance with a state of the toner within the developer 4K. This embodiment, in an effort to correct this deviation, requires to assume a state of the toner remaining within the developer from a developer roller rotating time and a dot count value and to change the density target value of the patch image based on the assumption. In other words, as shown in these drawings, in the look-up tables, a density target value is set in advance for each developer roller rotating time and each dot count value (which correspond to "toner individuality information" of the present invention, according to this preferred embodiment). The look-up tables thus function as "target value correlation information" of the present invention. It is needless to mention however that target value correlation information may be set in advance as a function instead of in the form of tables. This remains the same with respect to look-up tables which are shown in FIGS. 36A and 36B which will be described later.

The notches by which a density target value match with a threshold values of a developer roller rotating time and a dot count value which are control start conditions. Hence, every time these values reach the threshold values, a density target value corresponding to a state of toner is newly set, and an image forming condition is optimized based on the newly set density target value. However, in the tables shown in FIGS. 33A and 33B, the density target value remains the same between adjacent cells in some cases. In such a case, the newly set density target value is the same as the precedent value.

During this condition controlling process, as shown in FIG. 32, first, one look-up table is selected in accordance with the toner individuality information assigned to the developer 4K (Step S601). This table is referred to based on the toner state information, namely, the developer roller rotating time and the dot count value at this stage, and a density target value at this stage is set (Step S602). For instance, in the event that the developer roller rotating time is 2000 seconds and the dot count value is 1500000, a value which corresponds to this combination, which is 0.984 for a high-density patch image but 0.181 for a low-density patch image, is the density target value at this stage.

While maintaining the exposure energy E constant and changing a direct current developing bias Vavg over multiple levels, a solid image is formed as a high-density patch image at each level of the direct current developing bias (Step S603). The patch images thus formed and transferred onto the intermediate transfer belt 71 are transported as the intermediate transfer belt 71 rotates, and the density sensor 60 measures optical densities of the respective patch images as the images arrive at an opposed position facing the density sensor 60 (Step S604).

As the densities of the respective patch images formed at the respective levels of the direct current developing bias are found, an optimal value of the direct current developing bias Vavg is calculated based on this detection result and the density target value already found in the manner described above (Step S605). A bias value at which the closest value to the density target value is obtainable may be used as the optimal value. Alternatively, a correlation between the direct current developing bias Vavg and an image density may be identified from the detection result and a bias value at which the image density matches with the density target value may be calculated based on thus calculated correlation.

As the optimal value of the direct current developing bias Vavg is calculated in this manner, an optimal value of the exposure energy E is then identified. First, the direct current developing bias Vavg is set to thus calculated optimal value (Step S606), and while changing the exposure energy E over multiple levels, a thin line image in which one line is ON and ten lines are OFF for example is formed as a low-density patch image at each energy level (Step S607). In a manner similar to the above, the density sensor 60 detects densities of the respective patch images (Step S608), and an optimal value of the exposure energy E is calculated based on the detection result and the density target value which was found earlier (Step S609).

Thus calculated optimal values of the direct current developing bias Vavg and the exposure energy E are stored in the RAM 107 of the engine controller 10. For later image formation in the black color, these values are retrieved, the direct current developing bias Vavg and the exposure energy E are set based on the retrieved values, and an image is formed. This makes it possible to form an image which has an excellent quality.

Such a condition controlling process is properly executed in accordance with changes of the developer roller rotating time and the dot count value, thereby allowing to stably form an image while maintaining a change in image density small.

Figure 34:
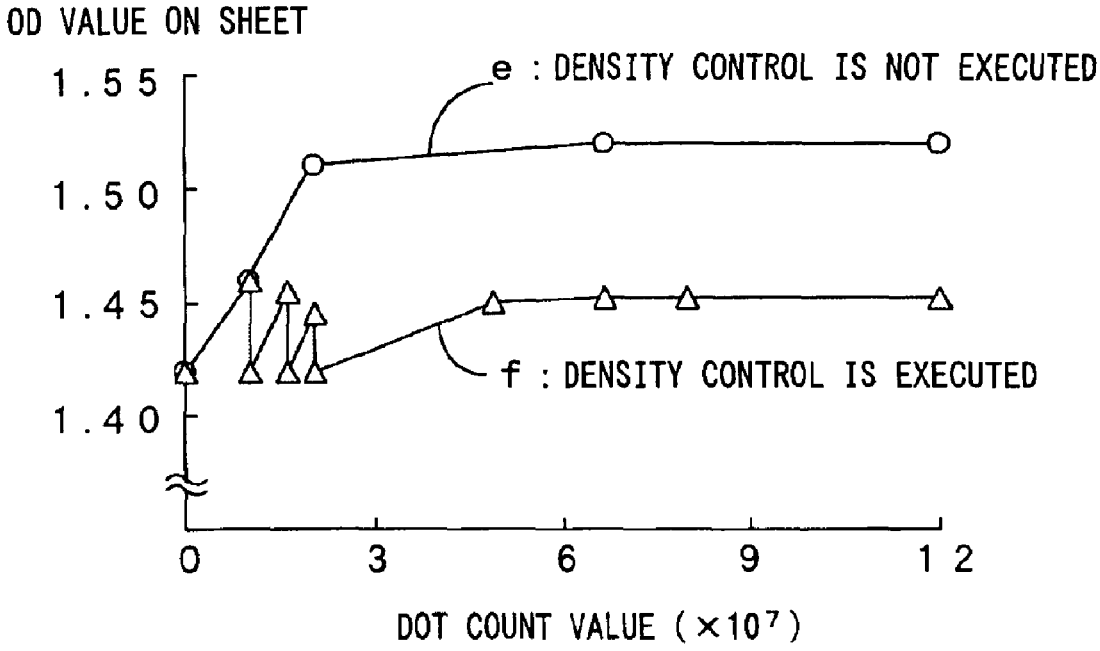
FIG. 34 is a graph which shows image density changes associated with execution of the condition controlling process.

As for the image forming apparatus having the structure as described above, a change in image density during continuous formation of a large number of images was changed. As one example of this, FIGS. 23 and 34 show an image density change during formation of solid images using the black toner.

FIG. 23 is a graph which shows image density changes at the respective print duties during image formation without execution of the condition controlling process. FIG. 34 is a graph which shows image density changes as they are with the condition controlling process of the present invention executed and image density as they are with the condition controlling process not executed. In these drawings, image densities along the vertical axis are optical densities (OD values) of an image finally transferred and fixed on a sheet S.

In an example that the condition controlling process is not executed, as shown in FIG. 23, an OD value on the sheet abruptly increases at an initial stage as the dot count value increases but the growth rate gradually decreases. A density change becomes different initially depending on a print duty, and becomes larger as the print duty increases. Such a density change trend is similarly found, when image densities are plotted relative to the developer roller rotating time which is measured along the horizontal axis. Thus, the image densities largely changes with time if the condition controlling process is not executed.

Image density changes will now be compared between where the condition controlling process is executed and where the condition controlling process is not executed, both in a condition that a print duty remains constant (e.g., 5%). The curve e in FIG. 34 corresponds to the curve representing the print duty of 5% shown in FIG. 23, and represents image density changes where the condition controlling process is not executed. On the contrary, in the event that the condition controlling process of the present invention is executed, as denoted at the curve f in FIG. 34, execution of the condition controlling process allows an image forming condition to be re-adjusted before a density change grows beyond a certain level, and changes of the image density are accordingly suppressed within a certain range. Although not shown, similar experiments were conducted while varying the print duty, and it was confirmed that image density changes were suppressed within predetermined ranges owing to execution of the condition controlling process as described above during any one of the experiments.

Figure 35:
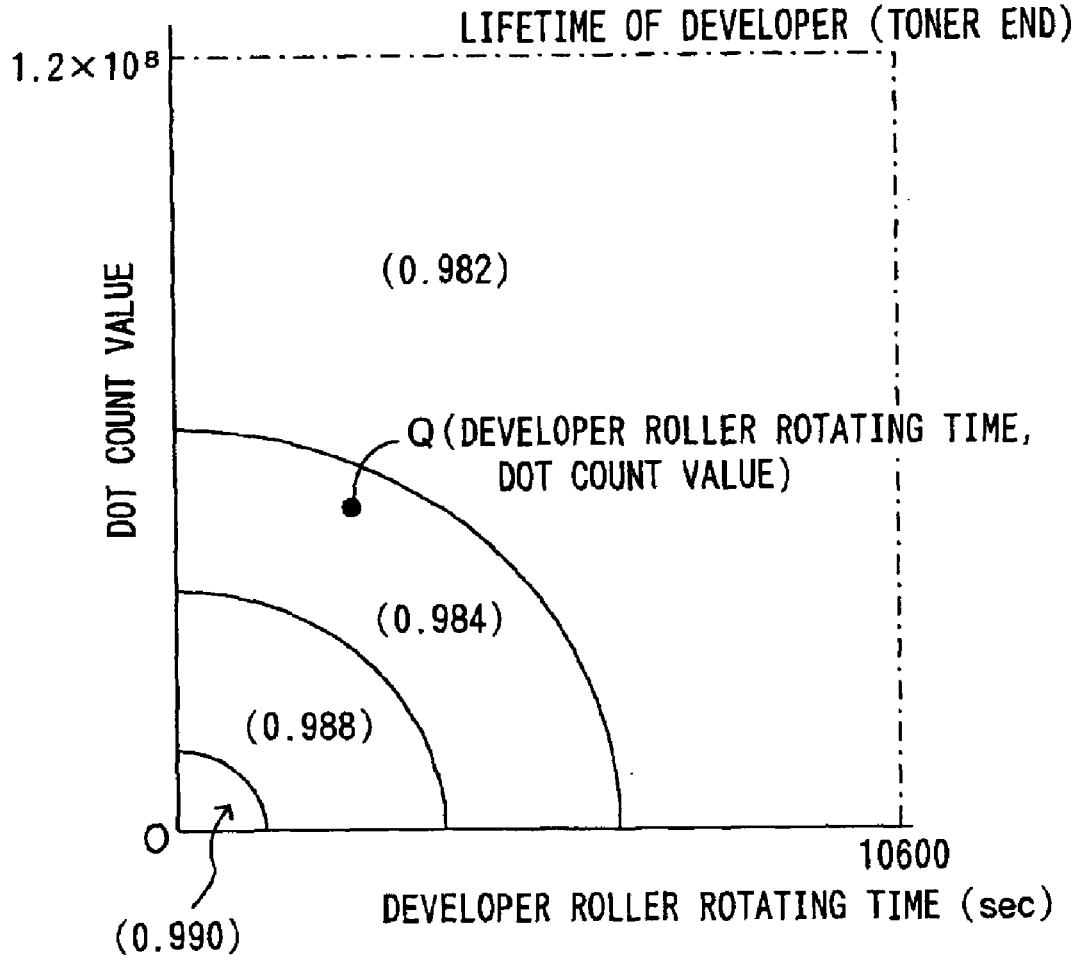
FIG. 35 is a chart for describing other method of setting a density control start condition.

FIG. 35 is a chart for describing other method of setting the control start condition. As described earlier, it is possible to assume a state of the toner within the developer from a developer roller rotating time and a dot count value. Noting this, according to this embodiment, the condition controlling process is initiated when any one of these values reaches a corresponding one of threshold values which are determined independently. However, more strictly speaking, a state of the toner is expressed as a combination of these two pieces of information. Hence, it is desirable to determine the control start condition based on a combination of these two.

For example, image densities obtainable from combinations of a developer roller rotating time and a dot count value are measured in advance through experiments, and as shown in FIG. 35, a coordinate space expressed as (the developer roller rotating time, the dot count value) is partitioned into a plurality of regions in such a manner that those combinations which realize approximately the same image densities belong to the same region. The requirement above is satisfied, as the condition controlling process is initiated when a point Q corresponding to the current developer roller rotating time and the current dot count value reaches a boundary between these regions. However, when such a determination is made, the process becomes more complicated, and also invites an increase in apparatus-related costs as such requires more memories. Hence, the condition controlling process may be executed in accordance with the chart shown in FIG. 35 in an apparatus which more strictly demands an excellent image quality for instance, whereas the condition controlling process may be executed based on the threshold values shown in FIG. 31 in a simpler apparatus. Thus, it is desirable to appropriately utilize the condition controlling process in accordance with the structure, the specifications and the like of the apparatus.

The figures in parenthesis in FIG. 35 represent examples of a density target value in each region and correspond to the figures which are included in the table shown in FIG. 33A. In this manner, even when the timing of executing the condition controlling process is to be set based on this chart, as the density target value is changed depending on a state of toner, it is possible to better suppress image density variations.

According to this embodiment, a developer roller rotating time and the number of formed dots are counted for each developer and the condition controlling process is executed for optimization of an image forming condition based on a combination of these counts, as described above. These counts represent a state of the toner remaining within the developer. Hence, control of the timing of executing the condition controlling process based on these values permits to execute the condition controlling process at proper timing in accordance with an image density change associated with a change of the state of the toner. As a result, this image forming apparatus allows to effectively suppress image density variations and stably form images which have an excellent quality.

While the embodiment described above requires to use the direct current developing bias Vavg and the exposure energy E as image forming conditions, known as image forming conditions which influence image densities are parameters including the alternating amplitude of a developing bias, an electrifying bias and an amount of toner transported by the developer roller 44, in addition to the direct current developing bias Vavg and the exposure energy E. The present invention is applicable also to an image forming apparatus which uses these parameters as image forming conditions.

Further, for instance, although the embodiment described above requires to determine the timing of executing the condition controlling process based on the dot count value and the value of the developer roller rotating time, the toner state information is not limited to these. Instead, other information which is indicative of a state of the toner remaining within the developer at each time point may be used. In an apparatus comprising a remaining toner amount sensor which analyzes an image signal fed from outside to thereby calculate a toner consumption amount or which detects a remaining toner amount within the developer for example, a remaining toner amount may be calculated from a detection result and thus calculated toner amount may be used as one toner state information. Alternatively, the number of rotations of the developer roller may be integrated instead of integrating the developer roller rotating time.

The threshold values of the dot count value and the developer roller rotating time which trigger execution of the condition controlling process are not limited to those used in the example described above. Instead, the threshold values may of course be appropriately changed in accordance with characteristics of toner to use.

For instance, in the embodiment described above, when the state of toner expressed as a combination (the developer roller rotating time, the dot count value) shifts from one cell to other cell in the example of the look-up table shown in FIGS. 33A and 33B, the condition controlling process is executed regardless of whether the density target value has been changed. However, in FIG. 33A for example, among the cells belonging to the column where the developer roller rotating time is "up to 3975," the density target values in the cell where the dot count value is "up to 6666666" and the cell where the dot count value is "up to 12000000" are equally 0.982. Hence, even when the dot count value exceeds the threshold value of 6666666, the density target value will not be changed as long as the developer roller rotating time remains belonging to the column "up to 3975." The reason the density target value will not be changed is because an expected image density variation, too, is thought to be small (FIG. 29), which permits to set the timing of executing the condition controlling process as described below.

In short, when the dot count value or the developer roller rotating time reaches the corresponding threshold value, whether the density target value should be changed may be determined with reference to the examples of the look-up table shown in FIGS. 33A and 33B. As in the embodiment described above, the condition controlling process may be executed when a change is expected but may not be executed when a change is not expected or an amount of the expected change is small (smaller than 0.001 for instance). In other words, the amount of the expected change corresponds to a "predetermined variation value" of the present invention. The "predetermined variation value" is not limited to 0.001 as described above, but may be any desired value. In a preferred embodiment described later which uses the look-up tables shown in FIGS. 36A and 36B, the "predetermined variation value" is set to optical densities (OD values) of 0.003, 0.002, etc.

One example will now be described that a combination (the developer roller rotating time, the dot count value) changes as denoted at the curve d in FIG. 31. With reference to FIG. 33A, since there is no change to the density target value at the timing (4) through the timing (6), the condition controlling process is omitted at such timing. As image density variations decrease as the developer is used longer as shown in FIG. 29 for example, the omission of the condition controlling process at such timing does not cause very large image density variations. Meanwhile, as the condition controlling process is executed less, a toner consumption amount is suppressed, the lifetime of the developer is extended, and a standby time for a user is reduced.

In addition, while the embodiment described above requires to prepare the look-up tables for different toner types and change a density target value for a patch image in accordance with a toner type, the timing of executing the condition controlling process remains the same among the toner types. On the contrary, the timing of executing the condition controlling process may be changed among the toner types. In short, a threshold value of the dot count value or the developer roller rotating time may be set for each toner type, the timing of executing the condition controlling process may be determined based on the threshold value, and the condition controlling process may be executed at different timing among different toner types.

This makes it possible to form images which have stable image densities while selectively using toner having different characteristics from each other. A wide range of characteristics of the toner can be thus used in the apparatus, which in turn allows a user to choose a toner type with a high degree of freedom, moderates a product quality requirement regarding toner characteristics for a toner vender, reduces a manufacturing cost, and improve the yield.

Further, any desired number of threshold values may be used. Look-up tables may be prepared for different toner colors. For instance, the condition controlling process may be executed based on the look-up tables which are shown in FIGS. 36A and 36B in the following manner.

FIGS. 36A and 36B are drawings which show other examples of the look-up tables. FIG. 36A show density target values for a high-density patch image which are set for black toner which corresponds to the "type 0," while FIG. 36B shows density target values for a high-density patch image which are set for magenta toner which corresponds to the "type 0." The density target values are values which are normalized so that a maximum density for the chosen toner color will be 1.

There are substantial differences as described below as clearly understood from a comparison of FIGS. 33A and 33B with FIGS. 36A and 36B. First, this embodiment uses more threshold values of the dot count value and the developer roller rotating time than the earlier preferred embodiment (FIGS. 33A and 33B). In other words, fine control is possible owing to more threshold values used. Further, noting that magenta toner has a characteristic that density variations associated with variations of the state of the toner are large, this embodiment demands to generate look-up tables using the magenta toner as a reference color. That is, when density target values are fixed values, threshold values are those values at which a density variation value exceeds an optical density (OD value) of 0.003 as shown in FIG. 36B. Similar look-up tables to the one for the magenta toner are prepared for the other colors, namely, yellow and cyan. The reason magenta toner causes large density variations is believed to be because magenta toner alone is consumed more quickly than the other colors. Since such selective consumption is thought to be dependent particularly upon the type of a pigment, it is preferable that the reference color for look-up tables is determined considering this.

On the other hand, as for the black toner, since black toner leads to smaller density variation associated with variations of the state of the toner than the magenta toner threshold values are those values at which a density variation value exceeds an optical density (OD value) of 0.002 as shown in FIG. 36A. In this embodiment, different look-up tables are thus used between black and the other colors (magenta, yellow and cyan). Although the illustrated examples are related only to a high-density patch image, the same policy is used to determine threshold values and density target values for a low-density patch image as well.

In addition, when an increased number of threshold values are set as described above, the timing of executing the condition controlling process is desirably controlled in a manner described below. The reason is as follows. It is to be noted here that unconditional execution of the condition controlling process upon arrival at the corresponding threshold value which is required in the preferred embodiment described above gives rise to a problem that the frequency of the condition controlling process increases as more threshold values are used and execution of the condition controlling process takes place despite a small density variation. Further, since the dot count value and the developer roller rotating time are generally different between the respective colors, it is rare that all colors reach the corresponding threshold values at the same time. Hence, in this sense, too, execution of the condition controlling process for every arrival at a threshold value backfires very much. Considering this, in the event that the number of threshold values in particular is increased, a desirable course of action is to execute the condition controlling process only when an additional condition that a density target value has been changed is met in addition to the condition that the dot count value or the developer roller rotating time has reached the corresponding threshold value. In other words, even when the dot count value or the developer roller rotating time has reached the corresponding threshold value, as long as a density target value is yet to be changed, the optical density (OD value) is smaller than 0.003 and density variations are therefore small. Hence, image density variations are almost ignorable even despite omission of the condition controlling process at such timing. In addition, the omission of the condition controlling process suppresses a toner consumption amount, extends the lifetime of the developer, and shorten a standby time for a user.

In the preferred embodiment described above, despite differences in densities (for high densities/for low densities), the toner colors, the toner individuality information, etc., the threshold values in the look-up tables are common, and therefore, it is necessary to set threshold values even when density target values are the same. However, standardization of the threshold values in the look-up tables is not an indispensable requirement. Rather, threshold values may be used in cells across which a density target value changes. This permits to reduce the number of threshold values to be set, and hence, the capacities of the look-up tables, thereby substantially contributing to a memory conservation.

Further, while the preferred embodiment described above relates to an image forming apparatus which is capable of forming a full-color image using four colors of yellow, magenta, cyan and black, the toner colors to be used and the number of the toner colors are not limited to the above but may be freely determined. The present invention is applicable also to an apparatus which uses only black toner to form a monochrome image.

D. Control Start Conditions (d) and (e)

In this type of the image forming apparatus, for the sake of convenience of repairing the apparatus and exchanging consumables, the respective portions of the apparatus are formed as cartridges which can be freely attached to and detached from the main body of the apparatus. Of these, a process cartridge which is used for the image forming operation may sometimes cause a changed image quality between before and after exchange of the cartridge because of variations in terms of characteristics between individual cartridges. An approach to suppress such variations in image quality may be to adjust such image forming conditions as those described above upon mounting of a process cartridge to the main body of the apparatus.

By the way, a process cartridge once detached by a user from the main body of the apparatus may sometimes be attached to the same apparatus once again. Examples of such an instance include on in which a process cartridge which needs not be exchanged has been detached by a user, one in which a process cartridge has been detached for the purpose of checking the condition of the cartridge. In such an instance, since the condition of the apparatus remains unchanged between before and after detachment, a re-adjustment of an image forming condition is not always necessary. To adjust an image forming condition (the condition controlling process) always after a cartridge has been attached despite this causes a problem that toner, a processing time and the like are wasted, fatigue of the apparatus intensifies, etc.

Noting this, according to this embodiment, the condition controlling process is not executed when the same process cartridge as the one which used to be attached has been re-attached. Hence, execution of the condition controlling process is suppressed to the minimum necessary, thereby preventing a problem of a wasteful use of toner, an increase in processing time, etc. This will now be described with reference to relevant drawings.

FIGS. 37A through 37C are schematic diagrams which show a stop position of a developer cartridge. In this image forming apparatus, a rotation controller and a rotary lock mechanism which are not shown position and fix the developer unit 4 at three types of positions which are shown in FIGS. 37A through 37C. The three types of positions are: (a) a home position; (b) a developing position; and (c) an attaching/detaching position. Of these, (a) the home position is a position at which the developer unit 4 is positioned when the apparatus 1 is in a standby state which does not require the apparatus 1 to perform the image forming operation. The home position is, as shown in FIG. 37A, such a position that the developer rollers 44 of the respective developers 4Y, . . . are all away from the photosensitive member 22 and none of the developers can be unloaded through the developer opening 135 which the main body of the apparatus may comprises.

Meanwhile, (b) the developing position is a position at which the developer unit 4 is positioned for visualization of electrostatic latent image on the photosensitive member 22 with the toner of the selected color. As shown in FIG. 37B, the developer roller 44 of one developer (which is the yellow developer 4Y in the example shown in FIG. 37B) faces the photosensitive member 22, and with a predetermined developing bias applied, the electrostatic latent image is visualized with the toner. It is not possible to unload any one of the developers through the developer opening 135 at the developing position, either. In the event that the outer cover 120 is opened during the image forming operation, the image forming operation is immediately stopped and the developer unit 4 stops after moving back to the home position.

In addition, while the developer unit 4 is remaining at the developing position, the connector disposed to one developer (the connector 49C of the developer 4C in FIG. 37B) is located at a position facing the main body connector 109. As the two connectors fit with each other, it is possible to the CPU 101 and one of the memories 91 through 94 to communicate with each other.

Further, (c) the attaching/detaching position is a position which the developer unit 4 arrives at only when any developer is to be attached or detached. As a user presses a certain button on an operation part 150, the developer unit 4 revolves to the attaching/detaching position, and as shown in FIG. 37C, the developer selected by the user comes in the developer opening 135, which makes it possible to remove the developer through the developer opening 135. However, in order to update information stored in this developer before removing the developer, the developer unit 4 is positioned at the developing position first and information is written in the memory disposed to the developer which the user wishes to remove.

FIG. 37C shows a state that the yellow developer 4Y has come to the developer opening 135. This state further permits to attach a new developer to the support frame 40 which is yet to seat any developer. At the attaching/detaching position, the developer roller 44 of any developer is away from the photosensitive member 22. It is thus possible to remove only one developer which comes to the developer opening 135 as the developer unit 4 is positioned at the attaching/detaching position. Hence, a user can never inadvertently attach or detach a developer to thereby damage the apparatus.

In this image forming apparatus 1, since the developing position and the attaching/detaching position described above are set for each one of the four developers 4Y, 4C, 4M and 4K, there are nine stop position in total for the developer unit 4, including one home position.

Such a structure described above allows the CPU 101 to learn about removal of the photosensitive cartridge 2A from the main body of the apparatus or mounting of the photosensitive cartridge 2A to the main body of the apparatus. When any developer 4Y, . . . is removed, information indicative of the state of use of the developer is updated and stored in the memory 91, . . . which is disposed to the developer 4Y, . . .

Further, the CPU 101 can assume whether at least one of the four developers 4Y, 4C, 4M and 4K has been detached or attached in the following manner. First, unless the inner cover 130 has been opened or closed, it is clear that any developer has not been detached or attached. On the other hand, in the event that a user has opened or closed the inner cover 130, when the developer unit 4 has stopped at the attaching/detaching position, as a possibility, the developer (the developer 4Y in the example shown in FIG. 28) exposed in the developer opening 135 may have been removed. An alternative possibility is that a new developer has been mounted through the developer opening 135. On the contrary, when the developer unit 4 did not stop at the attaching/detaching position, any developer can not be attached or detached.

In other words, in this embodiment, the developer exposed in the developer opening 135 may have been attached or removed when the inner cover 130 has been opened or closed with the developer unit 4 positioned at the attaching/detaching position, whereas the developers are otherwise never attached or detached.

Noting this, according to this embodiment, when the inner cover 130 has been opened or closed with the developer unit 4 positioned at the attaching/detaching position, the CPU 101 tries to communicate with the memory disposed to the developer which used to be within the developer opening 135. For instance, when the inner cover 130 is opened or closed with the developer unit 4 positioned at the attaching/detaching position which is shown in FIG. 37C (and therefore it is the developer 4C that can be attached or detached), the developer unit 4 is rotated to the developing position which is shown in FIG. 37B, thereby moving the main body connector 109 toward the developer connector 49C. At this stage, the two connectors fail to fit with each other when the developer 4C has already been removed and a communication is not possible. On the contrary, when the developer 4C has been attached, the two connectors fit with each other and the CPU 101 reads a content stored in the memory 92 which is disposed to the developer 4C.

Stored in the memory 92 are various types of information unique to this developer, namely, "identification information" of the present invention. Hence, the CPU 101 compares the information which the CPU 101 has just read with information which the CPU 101 has read earlier during a previous communication or information which has earlier been updated and stored in the main body of the apparatus based on this information. The CPU 101 can thus determine whether the currently attached developer 4C is the same developer which used to be mounted to the main body of the apparatus during a previous communication or a different developer. It is possible to confirm whether any developer has been removed or attached, in this manner.

In the image forming apparatus 1 having such a structure described above, image forming conditions need be re-adjusted upon exchange of the photosensitive cartridge 2A or any one of the four developers 4Y, 4C, 4M and 4K. This is because photosensitive cartridges and developers are different in characteristics from each other and a combination of these causes a density variation of an image which is formed using these. In this embodiment, therefore, when a user closes the outer cover 120, the CPU 101 adjusts the image forming conditions as shown in FIG. 38 in accordance with a program which is stored in advance in the ROM 106.

Figure 38:
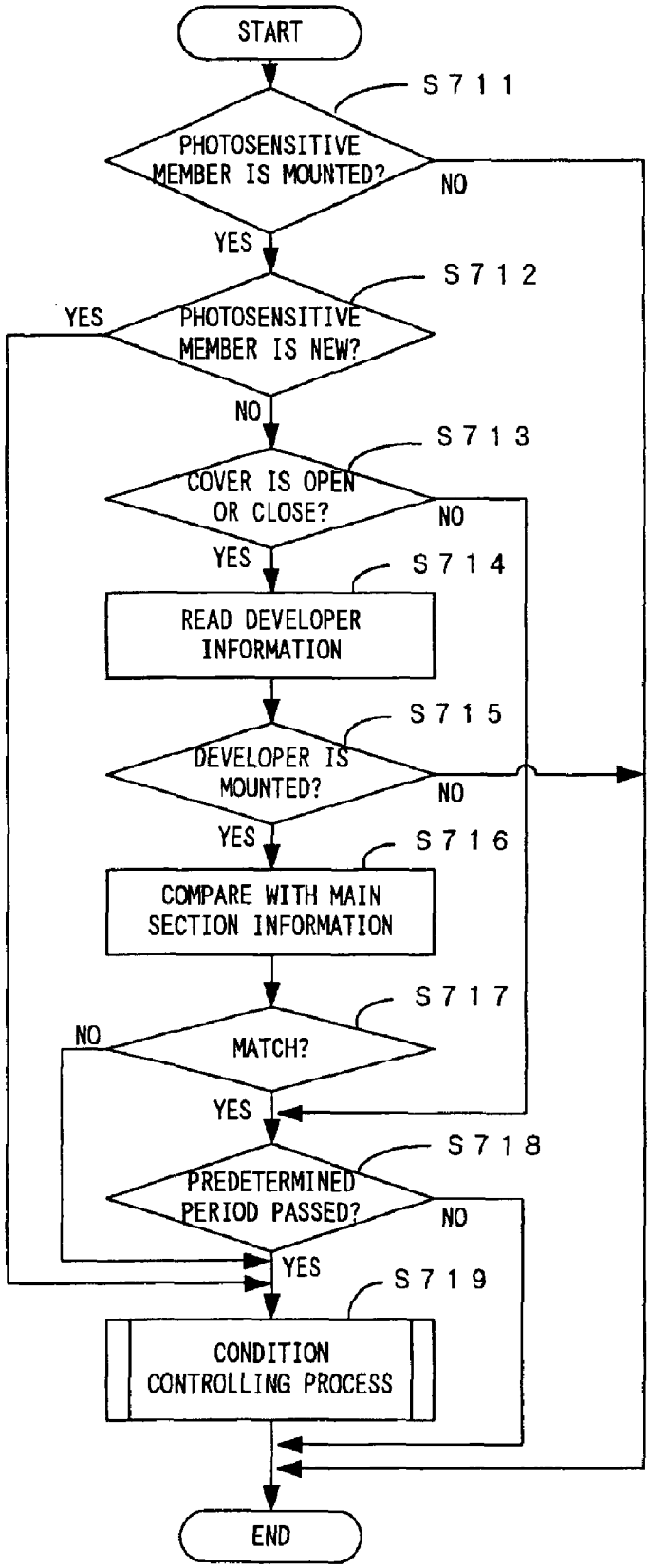
FIG. 38 is a flow chart which shows an image forming condition adjusting process.

FIG. 38 is a flow chart which shows an image forming condition adjusting process. Detecting that a user has closed the outer cover 120, the CPU 101 first determines whether the photosensitive cartridge has been mounted to the main body of the apparatus or not (Step S711). The CPU 101 terminates the process if the photosensitive cartridge has not been mounted, but determines whether the photosensitive cartridge 2A is a new cartridge when finding that the photosensitive cartridge has been mounted (Step S712). Whether the photosensitive cartridge 2A is a new cartridge is determined in the following manner.

Figure 39:
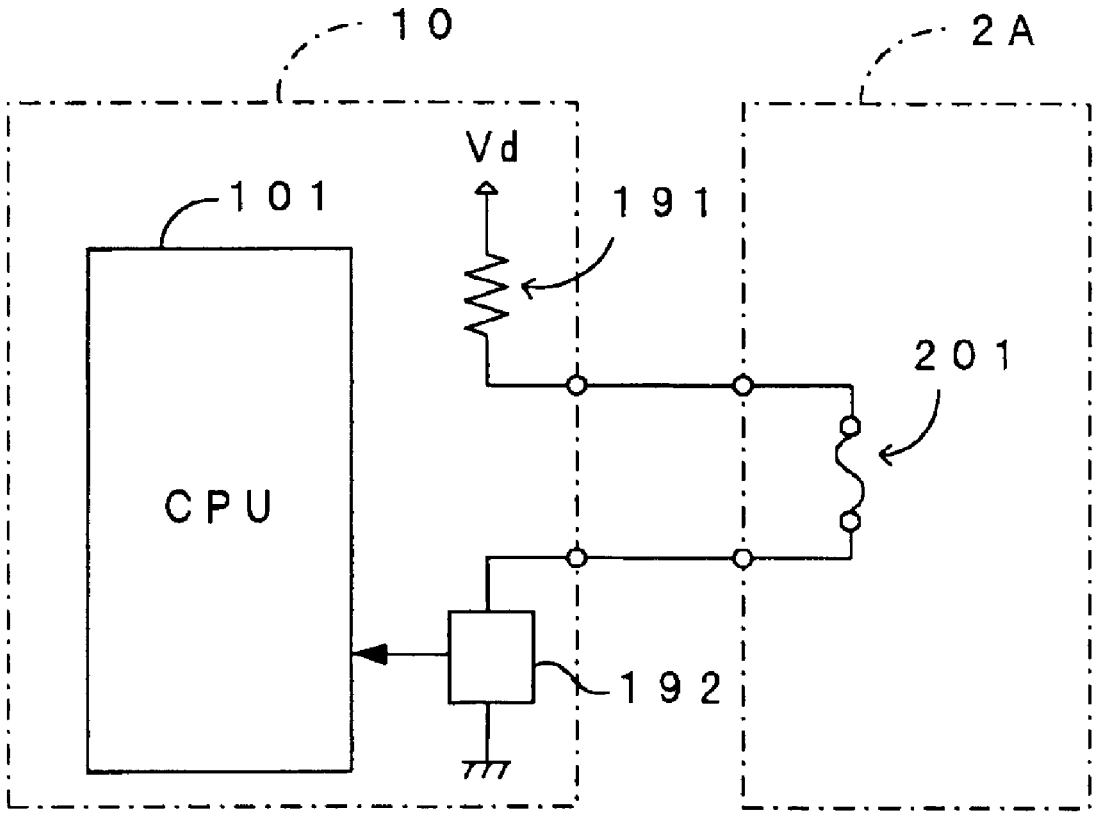
FIG. 39 is a drawing which shows a new developer sensing mechanism which senses a photosensitive cartridge.

FIG. 39 is a drawing which shows a new developer sensing mechanism which senses a photosensitive cartridge. A fuse 201 is disposed to the photosensitive cartridge 2A. As the photosensitive cartridge 2A is mounted to the main body of the apparatus, the fuse 201 is electrically connected with the engine controller 10. In other words, a resistor 191, the fuse 201 and a current detector 192 are connected in series between a power source terminal Vd of the engine controller 10 and the ground.

The resistor 191 is disposed to serve as a current limiter which ensures that the series circuit carries such a current which exceeds a rated current of the fuse 201 but does not impose an excessive load upon the power source. Meanwhile, the current detector 192 outputs to the CPU 101 a signal which corresponds to a value of a current carried by the series circuit.

As a new photosensitive cartridge 2A is mounted to the main body of the apparatus, a current which exceeds the rated current of the fuse 201 flows through the series circuit, and the current detector 192 detects this current. At this stage, the fuse 201 gets blown. In other words, the fuse 201 has had already blown and the series circuit fails to be formed in a photosensitive cartridge which was used once, and therefore, no current flows.

As the current detector 192 detects the current which flows through the fuse 201 which is disposed to the photosensitive cartridge 2A in this manner, whether the photosensitive cartridge 2A is a new cartridge is determined. That is, in this embodiment, it is the fuse 201 that records identification information which is indicative of the photosensitive cartridge 2A is a new cartridge or not.

The description will be continued referring to FIG. 38 again. When the judgment at the step S712 is YES, i.e., when the photosensitive cartridge 2A is a new cartridge, it is necessary to adjust the image forming conditions, and therefore, a condition controlling process at a step S719 is executed. This condition controlling process, which will be described later, is a process for adjusting the image forming conditions so that an image density will be controlled to a predetermined target density.

When the photosensitive cartridge 2A is not a new cartridge, whether the inner cover 130 has been opened or closed while the outer cover 120 was open is determined (Step S713). In the event that the inner cover 130 has not been opened or closed, this means that any developer has not been attached or detached and a state of the apparatus has not changed from before, and therefore, the process ends. On the other hand, in the event that the inner cover 130 has been opened or closed, since there is a possibility that any developer has been attached or detached, information stored in the memory of the developer is read (Step S714).

Since a condition that the CPU 101 can not communicate with the memory means that the developer has not been attached, the process ends if this condition applies (Step S715). When the CPU 101 can communicate, information which is read is compared with information stored in the main body of the apparatus, namely, information regarding the developer stored in the RAM 107 which is disposed to the engine controller 10 (Step S716). "Information regarding the developer" includes information regarding a serial number assigned to the developer, the color of toner the developer houses and a production batch, a remaining toner amount, an integrated value of a rotating time of the developer roller 44, etc. Since these pieces of information are saved in the memory 91, . . . before removal of the developer 4Y, . . . , when the earlier removed developer is the same as the newly attached developer, these pieces of information must be equal to each other between the developer and the main body. On the contrary, when the earlier removed developer is different from the newly attached developer, e.g., when a different developer has been attached or when an once removed developer is re-attached after used in other apparatus, any one of these pieces of information must be different.

In the event that a different developer has been attached from the one removed earlier, it is necessary to re-adjust image forming conditions for the purpose of suppressing variations in image density associated with variations in characteristics between the developers. In light of this, when a result of the comparison identifies that the two fail to match with each other, that is, when the attached developer is different from the one which used to be attached before, the apparatus proceeds to the step S719 to thereby execute the condition controlling process and accordingly adjust the image forming conditions (Step S717). In order to deal with a situation that the developer removed earlier from the apparatus was used in other apparatus in particular, it is desirable to make this judgment using the information which changes in accordance with the use of the developer.

On the other hand, when the two pieces of information match with each other, this means that the attached developer is the very developer which used to be originally attached the main body of the apparatus and that a state of the developer has not changed from the state at the time of removal from the main body of the apparatus. In other words, since the developer removed earlier is the same as the currently attached developer, it is not always necessary to re-adjust the image forming conditions. In the event that a developer once removed by a user is re-attached once again, it is not necessary to re-adjust the image forming conditions, and further, a re-adjustment will merely end up in wasting toner and a processing time. A re-adjustment therefore is not desirable.

However, in the event that a long period of time has passed since the precedent condition controlling process, e.g., when the apparatus has long been left unused with the developer removed, an environment surrounding the apparatus such as a temperature and a humidity level may has largely changed. In such an instance, therefore, even when the attached developer is the very developer which was removed earlier, it is desirable to re-adjust the image forming conditions.

Noting this, a counter incorporated within the CPU 101 measures an elapsed time from precedent execution of the condition controlling process. When the elapsed time is over a predetermined period (such as two hours), even if the attached developer is the very developer which used to be attached before, the condition controlling process is executed. On the contrary, when the elapsed time is shorter than the predetermined period, the process ends (Step S718).

In this manner, according to this embodiment, the following condition controlling process is executed when a new photosensitive cartridge is found mounted (the control start condition (e)), and when it is found that a developer has been exchanged and a different developer from the one used to be attached before is currently attached (the control start condition (d-1), i.e., it is found that the developer before the removal is not the same as the developer after the removal) and that the predetermined period has already passed since the earlier condition controlling process (d-2)), both at the time that the outer cover 120 has been just closed. The condition controlling process is not however otherwise executed.

Figure 40:
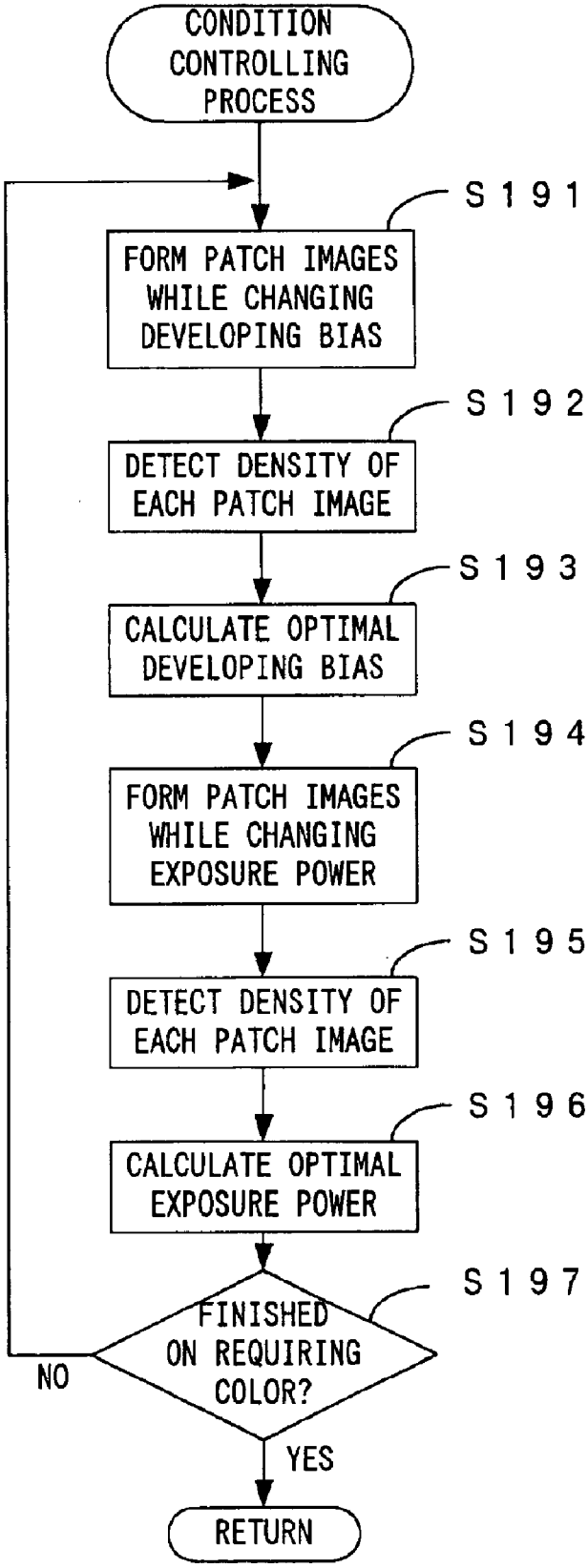
FIG. 40 is a flow chart which shows the condition controlling process according to this preferred embodiment.

FIG. 40 is a flow chart which shows the condition controlling process according to this preferred embodiment. Many proposals have been made already on this type of the image forming apparatus, and those proposed techniques are applicable to this preferred embodiment. The flow chart in FIG. 40 is one of such known techniques, and therefore, will now be described only generally.

During this condition controlling process, a developing bias which is fed to each developer and an intensity of the exposure beam L (hereinafter referred to as an "exposure power") are varied as control factors which influence an image quality. With these adjusted for each toner color, and the image forming conditions are accordingly controlled to optimal conditions which attain a desired image density.

To be more specific, first, toner images having a predetermined pattern (which may be solid images for instance) are formed as patch images while varying the developing bias over multiple stages using the attached photosensitive cartridge and the attached developer (Step S191), and the density sensor 60 detect densities of these patch images transferred onto the intermediate transfer belt 71 one after another (Step S192). Since this allows to identify a relationship between the developing bias which serves as a control factor and an image density, an optimal value of the developing bias which attains a target density is calculated based on thus identified relationship (Step S193).

Following this, in a similar manner, patch images (which may be thin line images for example) are formed while varying the exposure power over multiple stages and densities of the patch images are detected (Step S194, Step S195). An optimal value of the exposure energy E is then calculated based on the result (Step S196).

After the process on one toner color ends in this manner, when there is any other toner color which needs a similar process (Step S197), the apparatus returns to the step S191 and the process above is repeated on that toner color.

Which one of the toner colors may receive the condition controlling process at this stage can be determined in the following fashion for instance. First, in the event that a new photosensitive cartridge 2A is attached, since it is the photosensitive cartridge 2A that is used for formation of a toner image in any one of the toner colors, it is necessary to execute the condition controlling process described above for all toner colors.

On the other hand, in the even that any one of the developers is exchanged, the following two types of concepts can be used. The first is to execute the condition controlling process for all toner colors when there is even one developer which has been exchanged. This reduces differences in terms of image quality between the different toner colors, and allows to form images in an even better quality. The second is to execute the condition controlling process only for the toner color which corresponds to the exchanged developer. Since it is not always necessary to re-adjust the image forming conditions as for those developers which have not been exchanged, a re-adjustment may be carried out only for the toner color which corresponds to the exchanged developer, to thereby reduce a period of time needed for the process and a toner consumption amount. Which one of these to implement may be determined in accordance with the specifications of the apparatus.

As the toner colors for which the condition controlling process should be executed are determined in accordance with a state of the apparatus and the condition controlling process is executed for all necessary ones among the toner colors one after another, optimal values of the direct current developing bias and the exposure power are determined for each toner color. As for those toner colors for which the condition controlling process has not been executed, values calculated during the precedent condition controlling process may be used as they are.

Thus calculated optimal values of the direct current developing bias and the exposure power are stored in the RAM 107 of the engine controller 10. For image formation, these values are read out from the RAM 107 and used as current developing bias and exposure power settings, to thereby form images at a predetermined target density.

This condition controlling process may be executed in other instances than upon closing of the outer cover 120 as described above. For example, the condition controlling process may be executed regularly at certain constant time intervals, e.g., immediately after the power source of the apparatus has been turned on or every time the number of printed pages reaches a predetermined figure, which ensures a stable image quality regardless of an environment surrounding the apparatus, a change with time in characteristics of the apparatus, etc.

As described above, requiring to re-adjust the image forming conditions upon attachment of a new photosensitive cartridge or developer, this embodiment realizes stable formation of images which have excellent qualities. However, when the photosensitive cartridge which has just been attached is not a new one or when the developer which has just been attached is the same one which was removed earlier, the condition controlling process is not executed. In this manner, execution of the condition controlling process is suppressed to the minimum necessary, thereby preventing a problem of a wasteful use of toner, an increase in processing time (which is a standby time for a user), etc.

As described above, in this preferred embodiment, the photosensitive cartridge 2A and the respective developers 4Y, 4C, 4M and 4K correspond to a "process cartridge" of the present invention. The fuse 201 disposed to the photosensitive cartridge 2A and the memories 91 through 94 disposed to the respective developers correspond to "record means" in which identification information is recorded which distinguishes this process cartridge from other process cartridge having the same function. Of these, the memories 91 through 94 correspond to a "memory part" of the present invention. Further, the CPU 101 functions as "control means" and "clock means" of the present invention.

Although the preferred embodiment above demands to execute the condition controlling process "when a newly attached developer is not the same one which was removed earlier," the following alternative may be exercised.

In other words, a re-adjustment of an image forming condition which has already been once adjusted becomes necessary when owing to exchange of a developer, a state of the apparatus as it was during the earlier adjustment is different from the current state of the apparatus. Noting this, the condition controlling process may be executed "when a newly attached developer is different from a developer which used to be attached at the time of the earlier execution of the condition controlling process."

In such a condition, a state that the two developers are recognized as the same developer is such a state that "the newly attached developer is the very developer which used to be attached at the time of the earlier execution of the condition controlling process, and has been re-attached as it was at the time of removal (without getting used in other apparatus, etc.). Hence, it is needless to mention that the condition "a newly attached developer is the same developer, in terms of the state of use as well, which used to be attached at the time of the earlier execution of the condition controlling process" is not a condition which requires the newly attached developer to be "the same" in the present invention. This is because a developer remains to be recognized as "the same" developer even when a state of use of this developer has changed as a result of a continuously use in the apparatus after execution of the condition controlling process.

In the preferred embodiment above, the condition controlling process is executed upon attachment of a new developer and the corresponding memory is written with information which represents a state of use of this developer at the time of removal of the developer. Therefore, the developer which is determined to be "the developer which was removed earlier" from the information stored in the memory is usually the same as "the developer which used to be attached at the time of the earlier execution of the condition controlling process." In short, while a judgment regarding whether these developers are the same one or different ones (the step S717 in FIG. 38) in the preferred embodiment above includes a judgment regarding whether the newly attached developer is the same as "the developer which was removed earlier" and also a judgment regarding whether the newly attached developer is the same as "the developer which used to be attached at the time of the earlier execution of the condition controlling process."

Further, while the preferred embodiment above requires to determine whether the photosensitive cartridge 2A is a new cartridge by determining whether the fuse 201 carries a current or not, other means may be used to sense a new cartridge. For instance, a small tongue may be disposed to the photosensitive cartridge in such a manner that the tongue will be broken as the cartridge is attached to the main body of the apparatus, whereby the photosensitive cartridge is a new one is determined based on whether the tongue is broken or not.

Further, although the CPU 101 can communicate with the memory 91, . . . as the main body connector 109 mechanically fits with the developer connector 49Y, . . . with the developer unit 4 positioned still at the developing position according to the preferred embodiment above requires, this is not limiting. Instead, the communication may be realized non-contact, for instance as a wireless communication.

Further, although the preferred embodiment above is directed to an image forming apparatus which comprises the photosensitive cartridge 2A and the developers 4Y, 4C, 4M and 4K as process cartridges, other portions of the apparatus which contribute to formation of an image, such as the exposure unit, may be formed as a removable process cartridge which can be freely attached to and detached from the main body of the apparatus.

E. Other Control Start Conditions

As described above, it is not always necessary to re-adjust the image forming conditions as for those developers which have not been exchanged. Hence, a re-adjustment for the toner color which corresponds to the exchanged developer makes it possible to reduce a period of time needed for the process and a toner consumption amount. To be more specific, the CPU 101 executes an image quality managing operation as that shown in FIG. 41 when needed, determines on each toner color whether it is necessary to execute the condition controlling process in each color, and then executes a condition controlling process which aims at an adjustment of the image forming conditions (FIG. 44) for the toner color for which it was determined that it would be necessary to execute the process. This will now be described in detail with reference to relevant drawings.

Figure 41:
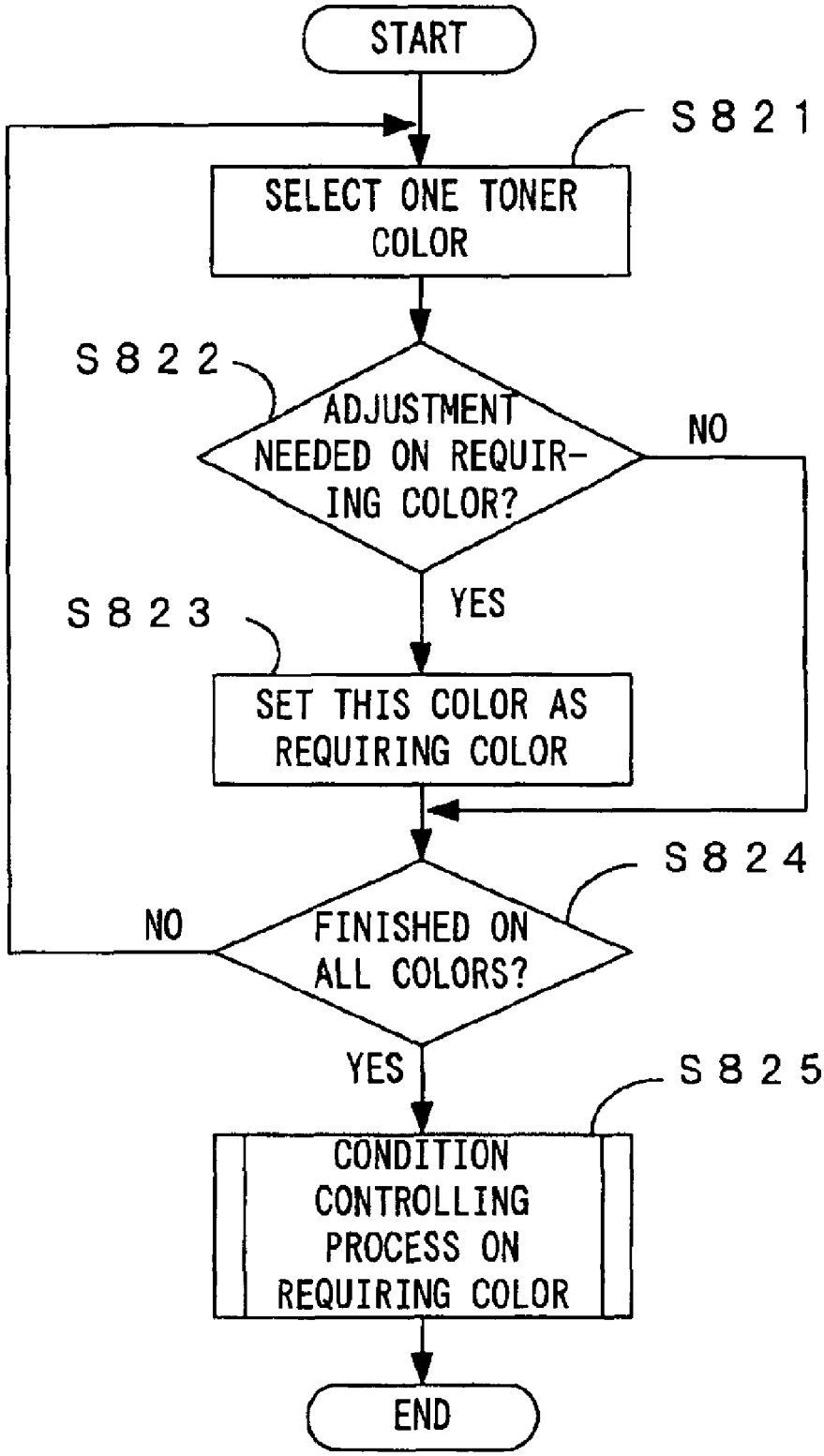
FIG. 41 is a flow chart which shows an image quality managing operation according to this preferred embodiment.

FIG. 41 is a flow chart which shows an image quality managing operation according to this preferred embodiment. During this process, first, one of the respective toner colors of yellow, magenta, cyan and black is selected (Step S821), and whether it is necessary to re-adjust in the selected color is determined (Step S822). A specific way of determining the necessity will be described later in detail. The toner color for which a re-adjustment is determined necessary is then set as a "requiring color" (Step S823). On the contrary, when a re-adjustment is determined unnecessary, the toner color is not set as a requiring color.

After the steps S821 through S823 described above are repeated for all toner colors (Step S824), only one of the four toner colors of yellow, magenta, cyan and black which requires the condition controlling process is set as a requiring color. Following this, the condition controlling process which is represented at the Step S825 is executed only for this toner color set as the requiring color.

Figure 42:
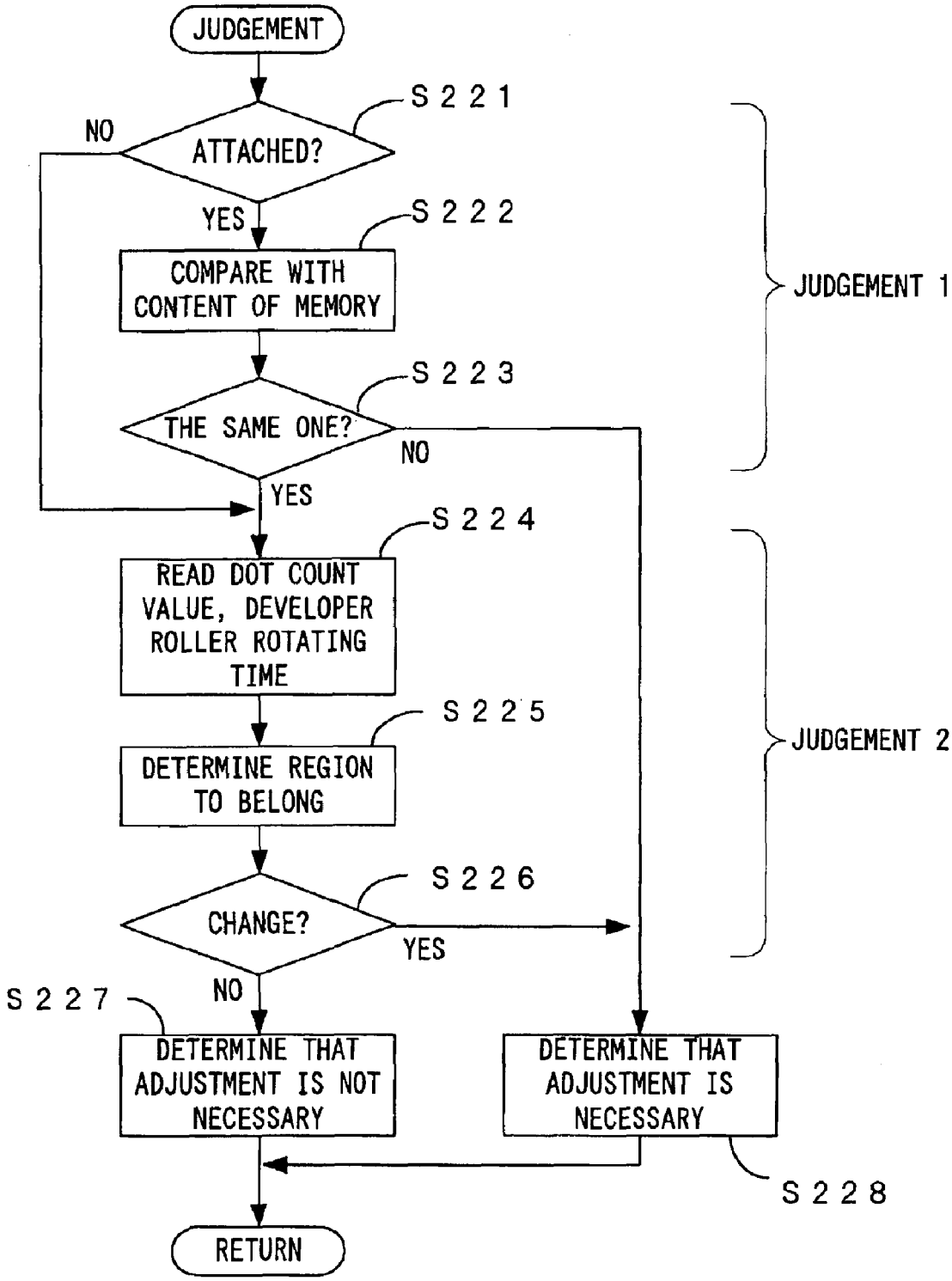
FIG. 42 is a flow chart which shows a process of determining whether an adjustment at a step S22 shown in FIG. 41 is necessary.

FIG. 42 is a flow chart which shows a process of determining whether the adjustment at the step S822 shown in FIG. 41 is necessary. During this process of determining whether the adjustment is needed, as shown in FIG. 42, two stages of judging steps, namely, as a judgment 1 (Step S221 to Step S223) and a judgment 2 (Step S224 to Step S226) are made on each toner color, thereby determining whether the image forming conditions need be adjusted for each toner color.

The judgment 1 is a judging process which corresponds to a second invention. That is, depending on whether the developer for the toner color, whether the image forming conditions need be adjusted is determined. To be more specific, whether a user has attached this developer to the main body of the apparatus is checked (Step S221).

Whether the developer has been attached or not can be determined based on whether a cover (not shown) which is disposed for free opening and closing to the main body of the apparatus and covers the developer unit 4 has been opened or closed. In short, a cover sensor formed by a limit switch for instance is disposed which detects whether the cover has been opened or closed, and whether the cover has been opened or closed is determined based on an output signal from the cover sensor. In the event that the cover has been opened or closed, it is assumed that the developer has been removed or attached. In addition, whether the developer has been attached can be determined based on whether the CPU 101 can communicate with the memory disposed to the developer after the cover was closed. A judgment here is "YES" when the cover has been opened or closed and the CPU 101 can communicate with the memory disposed to the developer after the cover was closed, whereas a judgment here is "NO" in other instances, i.e., when the cover has neither been opened nor closed or when the CPU 101 can not communicate although the cover has been opened or closed (that is, the developer has not been attached).

When a judgment at the step S221 is NO, i.e., when the developer has not been attached, the apparatus proceeds to the step S224 and the judgment 2 which will be described later is made. On the contrary, when a judgment at this step is YES, i.e., when the developer has been attached, information stored in the memory disposed to the developer is read out and matched up against information which is saved in the RAM 107 of the engine controller 10 (Step S222). This is a step for determining whether the attached developer is the very developer which was removed earlier from the main body of the apparatus.

As described earlier, in this apparatus, information regarding the state of use of this developer is written in the memory of the developer before removal of the developer. Hence, in the event that the developer once removed is re-attached, information read out from the memory must coincide with the content which has been written earlier. This remains the same when the developer has not been removed or attached after although the cover alone was merely opened or closed. On the other hand, when the attached developer is a different developer which was removed earlier or when the attached developer is the same one but the state of use of the developer has changed, these two pieces of information fail to match with each other.

In this preferred embodiment, when the attached developer is the very developer which was removed earlier and use in other apparatus or supplementary injection of toner has not caused any change in a state of use of the developer, it is determined that the developer removed earlier is "the same" developer which has just been attached.

In this manner, information written in the memory during earlier removal is saved in the engine controller 10, this information is compared with information which is read out from the memory which is disposed to the developer which has been attached next, and whether the currently attached developer is the same developer which was removed earlier is determined based on this result (Step S223).

When a judgment here is "NO," that is, when the two developers are not the same developer, the image forming conditions need be readjusted. The apparatus therefore proceeds to a step S228 without making the judgment 2, and determines that "it is necessary to adjust the image forming conditions" for this developer.

On the contrary, when a judgment at the step S223 is "YES," that is, when the two developers are the same developer, it means that this developer has been re-attached as is after once removed from the main body of the apparatus. In this case, since there is not change in the state of use of the developer, it is always necessary to re-adjust the image forming conditions. Conversely, to adjust the image forming conditions leads to a wasteful use of toner, a processing time, etc. When the attached developer is the same developer which was removed earlier, therefore, the apparatus proceeds to the step S224 to thereby make the judgment 2 and determine whether the image forming conditions need be adjusted.

The judgment 2 is a judging process for determining whether the image forming conditions need be adjusted in light of a state of use of the developer. Noting that a variation of characteristics of toner within the developer, which is included in a state of use of the developer, is fairly influential over an image quality, the judgment is made based on information regarding the state of use of the toner within the developer, to be more specific, an integrated count value of the number of dots formed on the photosensitive member 22 by the exposure unit 6 in the corresponding toner color (hereinafter referred to as a "dot count value") and an integrated value of a rotating time of the developer roller 44 (hereinafter referred to as a "developer roller rotating time").

The "dot count value" referred to here is information which denotes a consumption amount of toner within the developer. While the simplest method of assuming a toner consumption amount or a remaining toner amount is to calculate from an integrated value of the number of printed pages, since an amount of toner consumed for formation of one image does not remain constant, it is difficult to identify an accurate toner amount by this method. Meanwhile, representing the number of dots visualized with toner on the photosensitive member 22, the number of dots formed on the photosensitive member 22 by the exposure unit 6 accurately represents a toner consumption amount. Noting this, according to this embodiment, a dot count is obtained upon formation of an electrostatic latent image on the photosensitive member 22 by the exposure unit 6 which is to be developed by the developer, thus found dot count is stored in the RAM 107, and this dot count value is used as a parameter which is indicative of a consumption amount of the toner within the developer.

In the meantime, a "developer roller rotating time" is a numerical value which expresses an approximate number of formed images, and at the same time, information which is indicative of characteristics of the toner which remains within the developer. In other words, not all of the toner carried on the surface of the developer roller 44 is not used for formation of an image. At least a part of the toner is returned back into the developer without contributing to image formation, and re-used during subsequent image formation. Repeated use gradually leads to fatigue of the toner, which changes characteristics of the toner. In short, even when all of the toner has been consumed, the characteristics of the toner within the developer gradually change in accordance with an increase in rotating time of the developer roller 44.

That is, these pieces of information are information which is indicative of the state of use of the developer which is attached to the main body of the apparatus, and at the same time, "toner state information" which is indicative of the state of the toner within the developer. The state of the toner within the developer is assumed based on these two types of information, namely, a combination of a dot count value which is indicative of a toner consumption amount and a developer roller rotating time which is indicative of the number of printed pages. Whether the image forming conditions need be adjusted is then determined in accordance with thus assumed state of the toner. These pieces of information are stored in the RAM 107 of the engine controller 10, and when values expressed as these pieces of information are changed as a result of execution of the image forming operation, these pieces of information are updated as needed.

Figure 43:
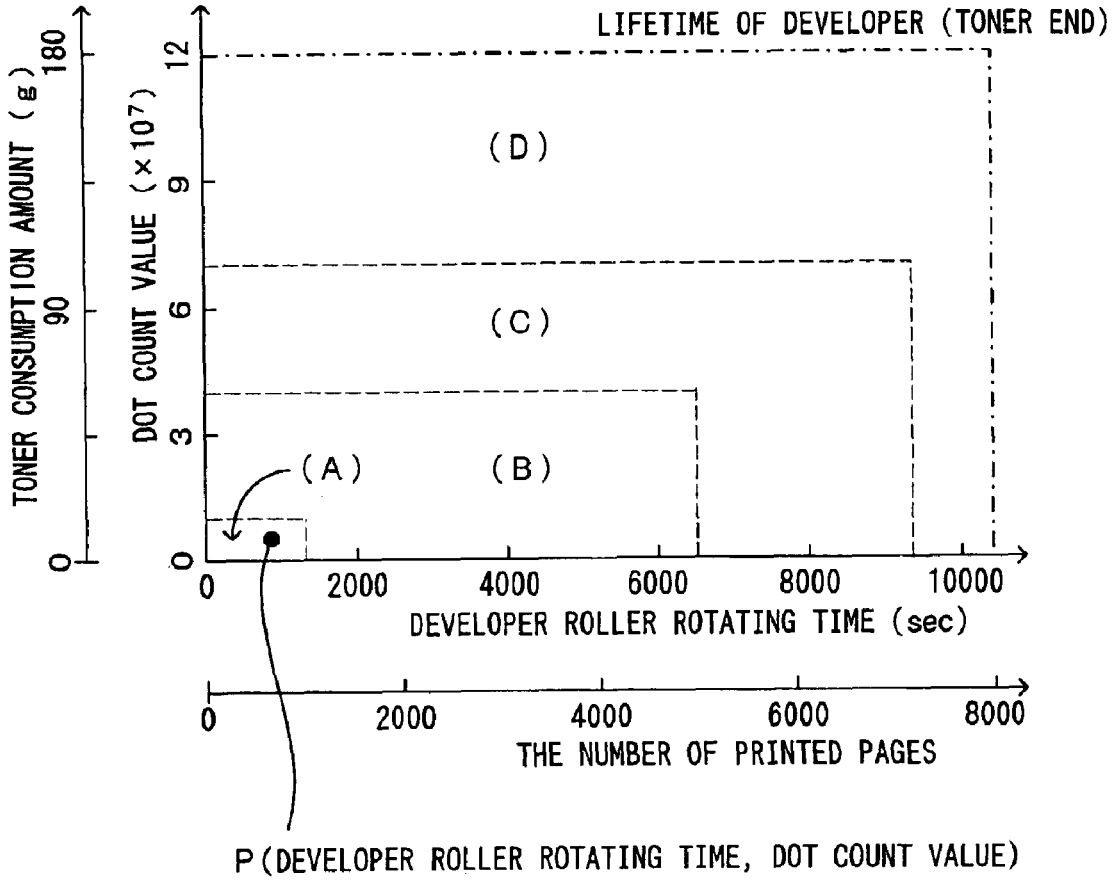
FIG. 43 is a principles drawing for describing a judgment 2.

FIG. 43 is a principles drawing for describing the judgment 2. A state of the toner expressed by a combination of a dot count value and a developer roller rotating time is classified into four states, and as for the judgment 2, the timing of a transition of the toner state from one stage to the next stage is determined as timing to adjust the image forming conditions. That is, an imaginary coordinate plane expressed as combinations of a dot count value and a developer roller rotating time is divided into four regions (A) through (D) which are shown in FIG. 43. The timing that a point P (the developer roller rotating time, the dot count value) expressed as a combination of a dot count value and a developer roller rotating time at a certain point in time moves from one region to other region is the timing to adjust the image forming conditions.

Of these, the region (A) is a region that a toner consumption amount is 15 g or less and the number of printed pages is 1000 or smaller. When the point P stays within the region (A), the toner is relatively new at this point in time and a remaining amount is still large. The region (B) is a region which is defined by subtracting the region (A) from a region in which a toner consumption amount is 60 g or less and the number of printed pages is 5000 or smaller. The region (B) thus corresponds to a state that the toner has somewhat deteriorated as compared to how it used to be within the region (A). In a similar manner, the region (C) is a region that a toner consumption amount is 100 g or less and the number of printed pages is 7000 or smaller, while the region (D) is such a region within the region (C) in which a toner consumption amount and the number of printed pages are beyond these and the developer accordingly comes to the end of its life (toner end).

While the point P remains within one region, it is considered that a change in image quality is small and the image forming conditions are maintained. On the contrary, when the point P moves from one region to other region, since a change in image quality increases, the image forming conditions are re-adjusted at the time of the movement of the point P.

Referring to FIG. 42 again, a content of the process of making the judgment 2 will now be described. The. CPU 101 reads a dot count value and a developer roller rotating time on the developer corresponding to the toner color which are stored in the RAM 107 of the engine controller 10 (Step S224). From these values, which one of the regions the point P currently belongs to is determined (Step S225). A result of the judgment is stored in the RAM 107.

The judgment made earlier as the judgment 2 is then compared with the judgment which has just been made as the judgment 2, and whether there is a change is determined (Step S226). In the event that these two judgments are different from each other, i.e., the region to which the point P belongs to has changed (YES at Step S226), the apparatus proceeds to the step S228 and it is determined that the image forming conditions need be adjusted on this toner color. On the contrary, when the two judgments are the same, i.e., the region to which the point P belongs to has not changed (NO at Step S226), it is determined that the image forming conditions need not be adjusted (Step S227). In this manner, when the point P reaches to such a point which corresponds to a boundary between two adjacent regions (FIG. 43), it is determined that the image forming conditions need be adjusted.

During this judging process, as described above, as for one toner color, it is determined that the image forming conditions need be adjusted when a different developer from the developer which was removed earlier is attached (Judgment 1) and when a dot count value and a developer roller rotating time, which express a state of the toner within the developer, constitute a predetermined combination judgment 2). This the content of a judgment at the step S822 shown in FIG. 41.

The content of the condition controlling process (Step S825 in FIG. 41) will now be described. A number of proposals have been made on this type of condition controlling process, and these proposed techniques are applicable to this embodiment, too. This process is one of such known techniques, and therefore, will now be described only generally.

Figure 44:
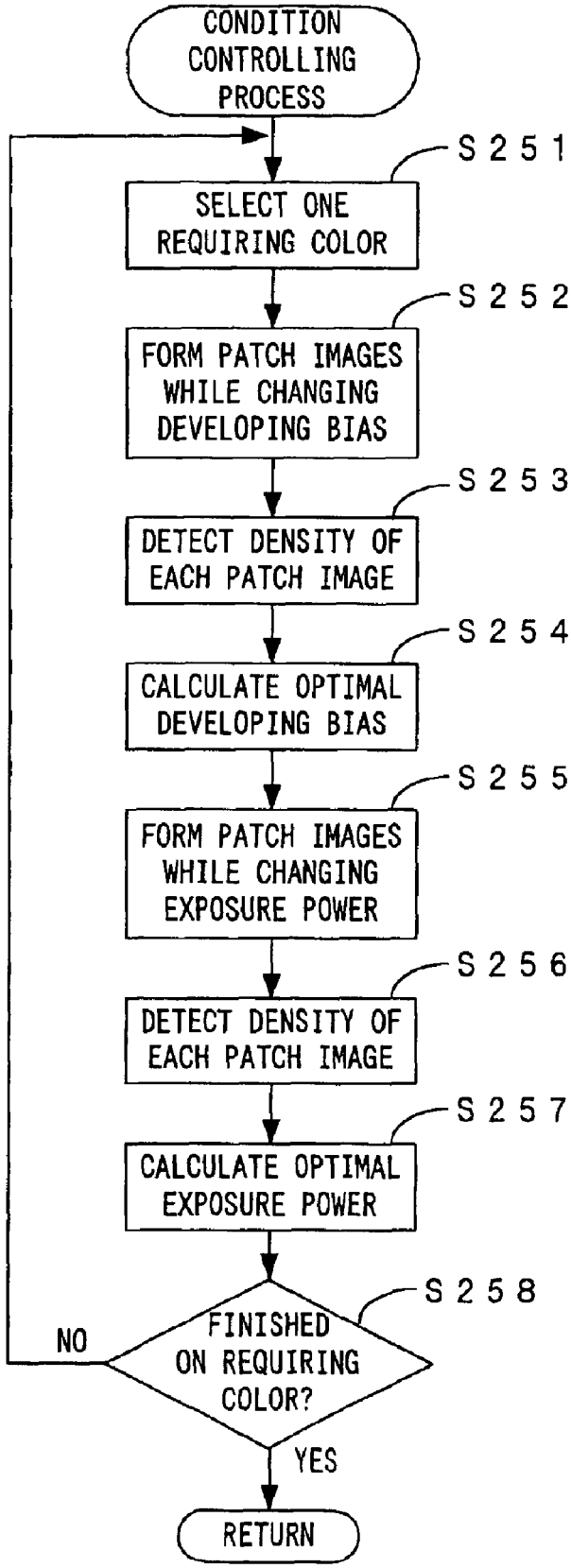
FIG. 44 is a flow chart which shows the condition controlling process according to this preferred embodiment.

FIG. 44 is a flow chart which shows the condition controlling process according to this preferred embodiment. During the condition controlling process, the developing bias which is fed to each developer and an intensity of the exposure beam L (hereinafter referred to as an "exposure power") are made variable as control factors which influence an image quality, and these are adjusted for each toner color, whereby the image forming conditions are controlled to optimal conditions which realize a predetermined image density.

To be more specific, first, one of the toner colors which are determined to be requiring colors in the form of the judgments described above is selected (Step S251). Using the developer corresponding to the chosen toner color, toner images having a predetermined pattern (which may be solid images for instance) are formed as patch images while varying the developing bias over multiple stages (Step S252). The density sensor 60 detect densities of these patch images transferred onto the intermediate transfer belt 71 one after another (Step S253). Since this allows to identify a relationship between the developing bias which serves as a control factor and an image density, an optimal value of the developing bias which attains a target density is calculated based on thus identified relationship (Step S254).

In a similar manner, patch images (which may be thin line images for example) are formed while varying the exposure power over multiple stages and densities of the patch images are detected (Step S255, Step S256). An optimal value of the exposure energy is then calculated based on the result (Step S257).

After the process on one toner color ends in this manner, when there is any other toner color which needs a similar process (Step S258), the apparatus returns to the step S251 and the process above is repeated on that toner color.

As the toner colors for which the condition controlling process should be executed are determined in accordance with a state of the apparatus and the condition controlling process is executed for all necessary ones among the toner colors one after another, optimal values of the direct current developing bias and the exposure power are determined for each toner color. As for those toner colors on which the condition controlling process has not been executed, values calculated during the precedent condition controlling process may be used as they are.

Thus calculated optimal values of the direct current developing bias and the exposure power are stored in the RAM 107 of the engine controller 10. For image formation, these values are read out from the RAM 107 and used as current developing bias and exposure power settings, to thereby form images at a predetermined target density.

As described above, according to this embodiment, when a different developer from the developer which was removed earlier is attached for one toner color and when a dot count value and a developer roller rotating time, which express a state of the toner within the developer, constitute a predetermined combination, it is determined that a readjustment of the image forming conditions is necessary for this toner color, and the image forming conditions are thereafter adjusted for this toner color. Hence, it is possible to stably form images which have an image quality while suppressing variations of the image quality caused by exchange of the developer, a change in toner characteristics, etc.

The re-adjustment of the image forming conditions is executed only for those toner colors which are determined to require a re-adjustment, but is not executed on the other toner colors. In this fashion, the condition controlling process is executed merely for requiring toner colors only when such is necessary. Hence, it is possible to effectively suppress an increase of a running cost and a drop in throughput without wasting the toner, a processing time, etc.

In the event that a change which could possibly influence image qualities for all toner colors has arisen, e.g., upon exchange of the photosensitive cartridge 2A, it is desirable to execute the condition controlling process for all toner colors independently of the judgments described above.

As described above, according to this embodiment, the CPU 101 of the engine controller 10 functions as "control means" of the present invention. Further, the RAM 107 functions as "memory means" of the present invention, and the memories 91 through 94 disposed to the respective developers 4Y, 4C, 4M and 4K function as a "memory part" of the present invention.

Meanwhile, boundaries between the respective regions shown in FIG. 43 which correspond to combinations of a dot count value and a developer roller rotating time which express states of toner and the associated developer correspond to a "control start condition" of the present invention. When a combination of these two reaches any boundary between the regions, the control start condition is met and the condition controlling process is executed.

The present invention is not limited to the preferred embodiments above, but may be modified in various manners in addition to the preferred embodiments above, to the extent not deviating from the object of the invention. For instance, although the preferred embodiment described immediately above requires to make the judgment 1 which corresponds to the second invention and the judgment 2 which corresponds to the first invention one after another, these judgments may be made independently of each other. That is, whether to adjust the image forming conditions may be determined in accordance with only the judgment 1 or the judgment 2.

Further, although the preferred embodiments above use a combination of a dot count value and a developer roller rotating time which expresses a state of use of the developers, or more specifically, a state of toner, information regarding a state of use of the apparatus is not limited to this but may be any other desired information. For instance, in an apparatus which comprises a toner counter which counts a remaining amount of toner within the developer, a count value may be used. Alternatively, a toner consumption amount calculated through analysis of an image signal fed from a host computer may be used instead. A proper combination of these pieces of information may also be used.

In addition, while the preferred embodiments above require to classify a state of toner into four stages as shown in FIG. 43 and execute the condition controlling process when there is a change between these stages, the number of the classifications, where the boundaries between the stages are located and the like is not limited to the above but may be freely determined. Further, these classifications, the boundaries and the like may be different between different toner colors in light of toner characteristics of each toner color, which is needless to mention.

Further, although each developer comprises a memory and information regarding each developer is stored in the corresponding memory according to the preferred embodiments above, this is not limiting. For example, the present invention is applicable also to an apparatus in which no memory is disposed to developers and a main body of the apparatus provides central control of states of use of the respective developers. In addition, while the memories of the developers are read or written in only when the developers are attached or detached, the present invention is applicable also to an apparatus in which information regarding each developer is stored in the memory of each developer and the stored information is updated and stored when needed.

Further, although the preferred embodiments above require to optimize the image forming conditions by adjusting the developing bias and the exposure power which are used as control factors regarding the image forming conditions, as described earlier, various types of techniques other than the known techniques described above may be applied to the content of the condition controlling process and the control factors.

Further, while the preferred embodiments above are directed to applications of the present invention to an apparatus which forms an image using toner of the four colors of yellow, magenta, cyan and black, the types and the number of the toner colors are not limited to the above but may be determined freely. The present invention is applicable not only to an apparatus of the rotary developer type but also to an image forming apparatus of the so-called tandem type in which developers corresponding to the respective toner colors are aligned in line along the direction of transportation of sheets. Further, the present invention is applicable not only to an apparatus of the electrophotographic type as those described in relation to the preferred embodiments above but also to image forming apparatuses in general.

F. Others

The present invention is not limited to the preferred embodiments above, but may be modified in various manners in addition to the preferred embodiments above, to the extent not deviating from the object of the invention. For instance, although the preferred embodiments described above are related to an application of the invention to a printer which executes the image forming operation based on an image signal from outside the apparatus, it is needless to mention that the present invention is applicable also to a copier machine which forms an image signal within the apparatus in response to pressing of a copy button for example and executes the image forming operation based on this image signal, to a facsimile machine which executes the image forming operation based on an image signal which is fed on a communications line, and the like.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus, comprising:

an image carrier which is capable of carrying an electrostatic latent image;

a developer in which toner is housed and which transports said toner toward a surface of said image carrier;

image forming means which applies a predetermined developing bias to said developer, to thereby move said toner to said image carrier, visualize said electrostatic latent image formed on the surface of said image carrier with said toner, and consequently forms a toner image; and memory means which stores toner state information which expresses a state of said toner housed within said developer, wherein said toner state information is updated in accordance with an operating state of said apparatus and stored; and a toner image is formed as a patch image when said toner state information satisfies a predetermined control start condition, an image forming condition which influences an image density is optimized based on a toner density of said patch image, and an image density is consequently controlled.

2. The image forming apparatus of claim 1, wherein said image forming condition is set such that the toner density of said patch image will approximately match with a predetermined density target value, thereby optimizing said image forming condition; and said density target value is changed depending on said toner state information.

3. The image forming apparatus of claim 2, wherein optimization of said image forming condition is executed when said density target value is changed, and said image forming condition is set such that the toner density of said patch image will approximately match with thus changed density target value.

4. The image forming apparatus of claim 1, wherein a plurality of image forming conditions are set in relation to said toner state information; and when a rate of a change of an image density to a change of said toner state information is large, said plurality of image forming conditions are set so that optimization of said image forming conditions will be executed more frequently than where said rate is smaller.

5. The image forming apparatus of claim 1, further comprising exposure means which makes a light beam expose on the surface of said image carrier which is electrified to a predetermined surface potential, to thereby form an electrostatic latent image on the surface of said image carrier, wherein used as said toner state information are a dot count, which is the number of dots formed on the surface of said image carrier by the exposure with said light beam, and an operating time of said developer; and said control start condition is that at least one of said dot count and said operating time reaches a predetermined threshold value.

6. The image forming apparatus of claim 5, wherein said developer comprises a toner carrier which rotates in a predetermined direction while carrying toner on a surface of said toner carrier to thereby transport said toner to an opposed position facing said image carrier; and a rotating time of said toner carrier is used as said operating time of said developer.

7. The image forming apparatus of claim 1, wherein target value correlation information is set in advance which associates density target values with the respective pieces of said toner state information; and said control start condition is that said toner state information corresponding to an operating state of said apparatus reaches said predetermined threshold value and a predetermined variation is met by or surpassed by a difference between a density target value as it is when said toner state information has just reached said threshold value and a density target value as it was before said toner state information reached said threshold value.

8. The image forming apparatus of claim 7, wherein even though said toner state information corresponding to the operating state of said apparatus has reached said predetermined threshold value, when said predetermined variation is yet to be surpassed by said difference between said density target value as it is when said toner state information has just reached said threshold value and said density target value as it was before said toner state information reached said threshold value, optimization of said image forming conditions is not executed.

9. The image forming apparatus of claim 8, wherein said variation is an optical density of 0.03 or smaller.

10. The image forming apparatus of claim 7, wherein said apparatus forms a color image using a plurality of mutually different colors of toner, and forms a monochrome image using black color toner of said plurality of colors; and said target value correlation information on said black color is different from said target value correlation information on other than said black color.

11. The image forming apparatus of claim 7, wherein said apparatus forms a color image using a plurality of mutually different colors of toner;

said target value correlation information is set in advance on a reference color which is one color among said plurality of colors which is consumed the fastest; and said target value correlation information on the other colors matches with said target value correlation information on said reference color.

12. The image forming apparatus of claim 1, wherein said control start condition is changed in accordance with an initial state of said toner which is housed within said developer.

13. The image forming apparatus of claim 1, further comprising a main body, wherein said developer comprises a memory element which can be freely attached to and detached from said main body and which functions as at least a portion of said memory means.

14. An image forming method in which an electrostatic latent image is formed on a surface of an image carrier, a predetermined developing bias is applied to a developer which houses toner, said toner accordingly moves toward said image carrier, said electrostatic latent image is visualized with said toner, and a toner image is consequently formed, wherein toner state information which expresses a state of said toner housed within said developer is updated in accordance with an operating state of said apparatus; and when said toner state information satisfies a predetermined control start condition, a toner image is formed as a patch image, an image forming condition which influences an image density is optimized based on a toner density of said patch image, and an image density is consequently controlled.

15. The image forming method of claim 14, wherein a light beam is made expose on the surface of said image carrier which is electrified to a predetermined surface potential, to thereby form an electrostatic latent image on the surface of said image carrier; and used as said toner state information are a dot count, which is the number of dots formed on the surface of said image carrier by the exposure with said light beam, and an operating time of said developer, and that said control start condition is that at least one of said dot count and said operating time reaches a predetermined threshold value.

16. An image forming apparatus, comprising:

a main body;

a process cartridge which can be freely attached to and detached from said main body; and control means which forms a toner image as a patch image using said process cartridge which is attached to said main body, detects a density of said patch image, and executes a condition controlling process which is for controlling of an image forming condition based on a result of the detection, wherein when said process cartridge attached to said main body is removed from said main body and thereafter again attached to said main body, said control means determines whether thus attached process cartridge is the same as the process cartridge removed earlier, and when determining that the two are not the same, said control means executes said condition controlling process, but when determining that the two are the same, said control means does not execute said condition controlling process.

17. The image forming apparatus of claim 16, wherein said process cartridge comprises record means which records identification information which is for distinguishing a process cartridge which is attached to said main body from other process cartridges; and said control means makes said judgment based on said identification information which is recorded in said record means of said process cartridge.

18. The image forming apparatus of claim 17, wherein in at least one of said process cartridges, disposed as said record means is a memory part in which information indicative of a state of use of this process cartridge is stored, and at least a portion of information stored in said memory part is used as said identification information.

19. The image forming apparatus of claim 18, wherein when said process cartridge comprising said memory part is to be removed from said main body, prior to the removal, said control means makes said memory part of said process cartridge store the information indicative of a state of use of this process cartridge; and upon attachment of said process cartridge comprising said memory part to said main body, when said identification information stored in said memory part of the attached process cartridge matches with said identification information stored in said memory part of the process cartridge which was removed prior to the attachment, said control means determines that these process cartridges are the same, but when these pieces of information fail to match with each other, said control means determines that these process cartridges are not the same.

20. The image forming apparatus of claim 18, wherein said process cartridge comprising said memory part is a developer which houses toner; and in said developer, information indicative of a state of use of said toner within said developer is stored in said memory part.

21. The image forming apparatus of claim 16, wherein a plurality of developers which house mutually different colors of toner can be attached to and detached from said main body as said process cartridge; and when said control means determines, as said judgment which is made at the time that any one of said plurality of developers is attached to said main body, that there is a developer which is not the same, said control means executes said condition controlling process only on a toner color which corresponds to this developer which has just been determined not to be the same among said plurality of toner colors.

22. The image forming apparatus of claim 17, wherein within at least one of said process cartridges, information indicative of whether this process cartridge is a new cartridge is recorded in said record means as said identification information.

23. The image forming apparatus of claim 16, further comprising clock means which measures an elapsed time since execution of said condition controlling process, wherein when said process cartridge is attached after said elapsed time exceeded a predetermined period of time, said condition controlling process is executed regardless of said judgment.

24. An image forming apparatus, comprising:

a main body;

a process cartridge which can be freely attached to and detached from said main body; and control means which forms a toner image as a patch image using said process cartridge which is attached to said main body, detects a density of said patch image, and executes a condition controlling process which is for controlling of an image forming condition based on a result of the detection, wherein when said process cartridge is attached to said main body, said control means makes a judgment regarding whether thus attached process cartridge is the same as a process cartridge which used to be attached to said main body before execution of said condition controlling process which took place prior to the attachment, and when determining that the two are not the same, said control means executes said condition controlling process, but when determining that the two are the same, said control means does not execute said condition controlling process.

25. The image forming apparatus of claim 24, wherein said process cartridge comprises record means which records identification information which is for distinguishing a process cartridge which is attached to said main body from other process cartridges; and said control means makes said judgment based on said identification information which is recorded in said record means of said process cartridge.

26. The image forming apparatus of claim 25, wherein in at least one of said process cartridges, disposed as said record means is a memory part in which information indicative of a state of use of this process cartridge is stored, and at least a portion of information stored in said memory part is used as said identification information.

27. The image forming apparatus of claim 26, wherein when said process cartridge comprising said memory part is to be removed from said main body, prior to the removal, said control means makes said memory part of said process cartridge store the information indicative of a state of use of this process cartridge; and upon attachment of said process cartridge comprising said memory part to said main body, when said identification information stored in said memory part of the attached process cartridge matches with said identification information stored in said memory part of the process cartridge which was removed prior to the attachment, said control means determines that these process cartridges are the same, but when these pieces of information fail to match with each other, said control means determines that these process cartridges are not the same.

28. The image forming apparatus of claim 26, wherein said process cartridge comprising said memory part is a developer which houses toner; and in said developer, information indicative of a state of use of said toner within said developer is stored in said memory part.

29. The image forming apparatus of claim 25, wherein within at least one of said process cartridges, information indicative of whether this process cartridge is a new cartridge is recorded in said record means as said identification information.

30. The image forming apparatus of claim 24, wherein a plurality of developers which house mutually different colors of toner can be attached to and detached from said main body as said process cartridge; and when said control means determines, as said judgment which is made at the time that any one of said plurality of developers is attached to said main body, that there is a developer which is not the same, said control means executes said condition controlling process only on a toner color which corresponds to this developer which has just been determined not to be the same among said plurality of toner colors.

31. The image forming apparatus of claim 24, further comprising clock means which measures an elapsed time since execution of said condition controlling process, wherein when said process cartridge is attached after said elapsed time exceeded a predetermined period of time, said condition controlling process is executed regardless of said judgment.

32. An image forming method in which a process cartridge for image formation can be freely attached to and detached from a main body of an apparatus, a toner image is formed as a patch image using said process cartridge which is attached to said main body, a density of said patch image is detected, and a condition controlling process which is for controlling of an image forming condition is executed based on a result of the detection, wherein when said process cartridge attached to said main body is removed from said main body and thereafter again attached to said main body, whether thus attached process cartridge is the same as the process cartridge removed earlier is determined, and said condition controlling process is executed when it is determined that the two are not the same, but said condition controlling process is not executed when it is determined that the two are the same.

33. An image forming method in which a process cartridge for image formation can be freely attached to and detached from a main body of an apparatus, a toner image is formed as a patch image using said process cartridge which is attached to said main body, a density of said patch image is detected, and a condition controlling process which is for controlling of an image forming condition is executed based on a result of the detection, wherein when said process cartridge is attached to said main body, a judgment is made regarding whether thus attached process cartridge is the same as a process cartridge which used to be attached to said main body before execution of said condition controlling process which took place prior to the attachment, and when it is determined that the two are not the same, said condition controlling process is executed, but when it is determined that the two are the same, said condition controlling process is not executed.

34. An image forming apparatus, comprising:

a main body;

a plurality of developers which can each be freely attached to and detached from said main body; and control means which forms toner images as patch images using said developers which are attached to said main body, and executes a condition controlling process, which is for controlling of an image forming condition for formation of toner images using said developers, based on a detection result on densities of said patch images, wherein on each one of said developers which are attached to said main body, said control means determines whether it is necessary to execute said condition controlling process on each developer based on information indicative of a state of use of said each developer, and when determining that said condition controlling process needs be executed on at least one developer, said control means executes said condition controlling process on the developer which has just been determined to require said condition controlling process, but does not execute said condition controlling process on the other developers.

35. The image forming apparatus of claim 34, further comprising memory means which stores said information.

36. The image forming apparatus of claim 34, wherein each developer comprises a memory part which stores information indicative of a state of use of this developer.

37. The image forming apparatus of claim 34, wherein on at least one of said developers which are attached to said main body, when said information indicative of a state of use of this developer satisfies a predetermined control start condition which has been set in advance for this developer, said control means determines that it is necessary to execute said condition controlling process on this developer.

38. The image forming apparatus of claim 34, wherein said information includes toner state information which is indicative of a state of use of toner which is housed within said developers which are attached to said main body.

39. An image forming apparatus, comprising:

a main body;

a plurality of developers which can each be freely attached to and detached from said main body; and control means which forms toner images as patch images using said developers which are attached to said main body, and executes a condition controlling process, which is for controlling of an image forming condition for formation of toner images using said developers, based on a detection result on densities of said patch images, wherein when at least one developer was removed from said main body and a new developer has been attached to said main body, said control means executes said condition controlling process on the attached developer but does not execute said condition controlling process on the other developers which have been remaining attached to said main body since before the attachment.

40. A control method for an image forming apparatus in which a plurality of developers can each be freely attached to and detached from a main body of an apparatus, wherein toner images are formed as patch images using said developers which are attached to said main body, and a condition controlling process, which is for controlling of an image forming condition for formation of toner images using said developers, is executed based on a detection result on densities of said patch images; and on each one of said developers which are attached to said main body, whether it is necessary to execute said condition controlling process on each developer is determined based on information indicative of a state of use of each developer, and when it is determined that it is necessary to execute said condition controlling process on at least one developer, said condition controlling process is executed on the developer which has just been determined to require said condition controlling process, but said condition controlling process is executed on the other developers.

41. A control method for an image forming apparatus in which a plurality of developers can each be freely attached to and detached from a main body of an apparatus, wherein toner images are formed as patch images using said developers which are attached to said main body, and a condition controlling process, which is for controlling of an image forming condition for formation of toner images using said developers, is executed based on a detection result on densities of said patch images; and when at least one developer was removed from said main body and a new developer has been attached to said main body, said condition controlling process is executed on the attached developer but not on the other developers which have been remaining attached to said main body since before the attachment.

42. An image forming apparatus, comprising:

an image carrier which is capable of carrying an electrostatic latent image;

a developer in which toner is housed and which transports said toner toward a surface of said image carrier;

image forming means which applies a predetermined developing bias to said developer, to thereby move said toner to said image carrier, visualizes said electrostatic latent image formed on the surface of said image carrier with said toner, and consequently forms a toner image; and density detecting means which detects a toner density of a toner image which is formed as a patch image, wherein a density target value of said patch image is changed in accordance with an operating state of said apparatus; and an image forming condition which influences an image density is optimized based on said density target value and the toner density of said patch image detected by said density detecting means, whereby an image density is controlled.

43. The image forming apparatus of claim 42, wherein said density target value is set in accordance with characteristics of said toner which is housed in said developer.

44. The image forming apparatus of claim 43, wherein said density target value is set in accordance with a combination of primary toner information, which is indicative of toner characteristics as they are at the time of introduction of said toner into said developer, and secondary toner information which is indicative of a state of use of said toner corresponding to an operating state of said apparatus.

45. The image forming apparatus of claim 44, wherein said secondary toner information includes information regarding a remaining toner amount of said toner within said developer.

46. The image forming apparatus of claim 45, further comprising exposure means which makes a light beam expose on the surface of said image carrier which is electrified to a predetermined surface potential, to thereby form an electrostatic latent image on the surface of said image carrier, wherein said remaining toner amount is calculated based on the number of dots formed by said exposure means.

47. The image forming apparatus of claim 44, wherein said developer comprises a toner carrier which rotates in a predetermined direction while carrying toner on a surface of said toner carrier to thereby transport said toner to an opposed position facing said image carrier; and said secondary toner information includes information regarding the number of revolutions of said toner carrier.

48. The image forming apparatus of claim 44, wherein said developer comprises memory means which stores at least one of these pieces of information.

49. The image forming apparatus of claim 42, wherein said density target value is increased or decreased in accordance with a density change request made by a user.

50. An image forming method in which an electrostatic latent image is formed on a surface of an image carrier, a predetermined developing bias is applied to a developer which houses toner, said toner accordingly moves toward said image carrier, said electrostatic latent image is visualized with said toner, and a toner image is consequently formed, wherein a density target value is changed in accordance with an operating state of an apparatus, a toner density of a toner image formed as a patch image is detected, and an image forming condition which influences an image density is optimized based on a result of the detection and said density target value, whereby an image density is controlled.

51. The image forming method of claim 50, wherein said density target value is set in accordance with a combination of primary toner information, which is indicative of toner characteristics as they are at the time of introduction of said toner into said developer, and secondary toner information which is indicative of a state of use of said toner corresponding to an operating state of said apparatus.

* * * * *